US012420967B2

(12) United States Patent
Oh

(10) Patent No.: US 12,420,967 B2
(45) Date of Patent: Sep. 23, 2025

(54) SYSTEM OF ASSEMBLING LOW AND HIGH-PRESSURE PODS

(71) Applicant: Sung Oh, West Covina, CA (US)

(72) Inventor: Sung Oh, West Covina, CA (US)

( * ) Notice: Subject to any disclaimer, the term of this patent is extended or adjusted under 35 U.S.C. 154(b) by 0 days.

(21) Appl. No.: 18/223,697

(22) Filed: Jul. 19, 2023

(65) Prior Publication Data

US 2023/0391484 A1 Dec. 7, 2023

Related U.S. Application Data

(60) Provisional application No. 63/390,371, filed on Jul. 19, 2022, provisional application No. 63/390,456, filed on Jul. 19, 2022.

(51) Int. Cl.

| | |
|---|---|
| ***B65B 29/02*** | (2006.01) |
| ***B65B 7/28*** | (2006.01) |
| ***B65B 29/10*** | (2006.01) |
| ***B65B 43/46*** | (2006.01) |

(52) U.S. Cl.

CPC ..... *B65B 29/025* (2017.08); *B65B 7/2878* (2013.01); *B65B 29/10* (2013.01); *B65B 43/46* (2013.01); *B65B 2220/14* (2013.01)

(58) Field of Classification Search

CPC combination set(s) only.
See application file for complete search history.

(56) References Cited

U.S. PATENT DOCUMENTS

2012/0058226 A1* 3/2012 Winkler ..... A47J 31/3695 426/431

* cited by examiner

*Primary Examiner* — Praachi M Pathak
(74) *Attorney, Agent, or Firm* — Scott R. Hansen; Viking IP LAW

(57) ABSTRACT

A system of assembling first and second types of pods includes a first assembly apparatus for packing first type of pods such as low-pressure coffee pods, and a second assembly apparatus for partially packing second types of pods where a second type of filter is packed with a second beverage ingredient without a container. The assembled filter with the second beverage ingredient is passed to the first assembly apparatus where the outer container and the lid may be applied to assemble the second type of pods to brew high-pressure beverages such as espresso. The second type of pods can optionally include a third beverage ingredient separated by a perforated barrier between the second and third beverage ingredients.

18 Claims, 35 Drawing Sheets

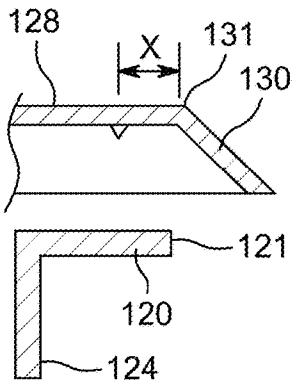
FIG. 4M
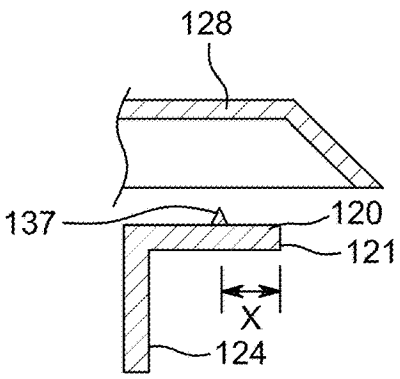
FIG. 4N
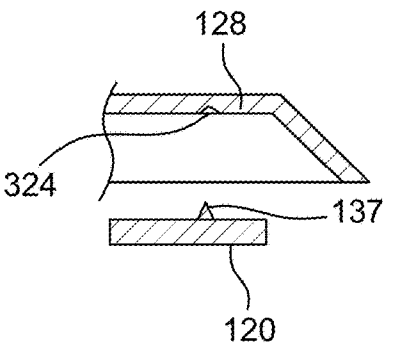
FIG. 4O
FIG. 4P
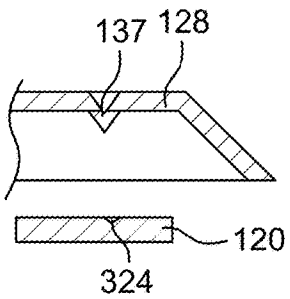
FIG. 4Q
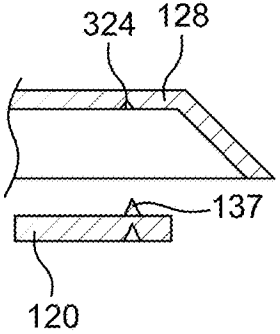
FIG. 4R
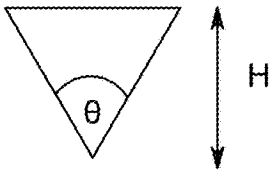
FIG. 4S

SYSTEM OF ASSEMBLING LOW AND HIGH-PRESSURE PODS

RELATED APPLICATION

This application claims priority to U.S. Provisional Application 63/390,456, filed Jul. 19, 2022, entitled "BEVERAGE POD WATER SEALING SYSTEM," to Ser. No. 63/390,371 filed Jul. 19, 2022, entitled "PACKAGING BOX WITH HANDLE," and to Ser. No. 63/055,767, entitled "SYSTEM OF ASSEMBLING LOW AND HIGH-PRESSURE PODS," all of which are hereby incorporated by reference.

BACKGROUND OF THE INVENTION

Field of the Invention

A single-serve pod may be adapted to releasably seal the upper portion of a filter to a rim of the container to hermetically seal the beverage ingredient therein and to separate the upper portion of the filter from the rim to drain the extract beverage from the pod; and in particular, to seal the upper portion to the rim in a substantially consistent manner to allow the upper portion to separate around the circumference of the rim in a substantially similar manner.

Background of the Invention

The following background discussion is not an admission that the matters discussed below are citable as prior art or common general knowledge. Rather, the general background information disclosed herein is directed at describing the problem(s) associated with the current state of the art, and a need for a better solution.

Single-serve pod systems for brewing beverages such as coffee and espresso are popular for their convenience and variety of different flavored beverages offered. One of the problems with such a brewing system is that an outlet needle is generally needed to pierce through the pod to drain the beverage from the pod, which can get clogged and contaminate the beverage. For example, the coffee beverage packed in coffee pods is organic, which means that over time bacteria and mold can grow inside the outlet needle and along the path the coffee beverage flows within the brewer before pouring into the mug, unless the brewer is rinsed regularly, which is not done by many users. In most instances, coffee is brewed at about 190° F. (88° C.), which is hot enough to kill most bacteria and mold, however, as the beverage drains from the brewer the bacteria and mold wash away with the beverage, which can hinder the taste of the coffee. Accordingly, there is a need for a single-serve pod that can drain the beverage without the need of an outlet needle.

INVENTION SUMMARY

One of the aspects of the invention is to provide a method of assembling a beverage pod including a filter having an extension, and a container having a rim, the method comprising: positioning the extension of the filter juxtaposed to the rim of the container; sealing peelably the extension to the rim where a predetermined amount of sealing force is formed between the extension and the rim such that an application of force upon the extension of at least the predetermined amount of sealing force separates the extension from the rim; and sealing a lid to the extension with heat to minimize increasing the predetermined amount of sealing force between the extension and the rim.

Another aspect of the invention is to provide a method of assembling a beverage pod including a filter having an extension, and a distributor having an outer flange, the method comprising: filling the filter with a first beverage ingredient; sealing the flange of the distributor to the extension of the filter; placing the filter filled with the beverage ingredient into a container with the extension juxtaposed to the rim; sealing peelably the extension to the rim where a predetermined amount of sealing force is formed between the extension and the rim such that an application of force upon the extension of at least the predetermined amount of sealing force separates the extension from the rim; and sealing a lid to the extension with heat to minimize increasing the predetermined amount of sealing force between the extension and the rim.

Yet another aspect of the invention is to provide a system of assembling first and second types of pods where each pod has a filter with an extension releasably sealed to a rim of a container, the system comprising: a first assembly apparatus having a first end and a second end, the first assembly apparatus including: a first conveyor belt having a plurality of drums adapted to move from the first end to the second end; a first picker adapted to place a container into one of the plurality of drums; a second picker adapted to place a first type of filter into the container such that the extension of the filter rest upon the rim of the container; a first filler adapted to fill the first type of filter with a predetermined amount of a first beverage ingredient; a first sealer adapted to peelably seal the extension of the filter to the rim of the container such that the extension separates from the rim upon an application of a predetermined force on the extension; a second sealer adapted to seal a lid onto the extension with minimal effect on the predetermined force needed to separate the extension from the rim; and a second assembly apparatus having a first end and a second end, the second assembly apparatus including: a second conveyor belt having a plurality of drums adapted to move from the first end to the second end; a third picker adapted to place a second type of filter into one of the plurality of drums on the second conveyor belt; a second filler adapted to fill the second type of filter with a predetermined amount of a second beverage ingredient; a fourth picker adapted to place a distributor with a flange over the second beverage ingredient and juxtaposed to the extension of the second type of filter; a third sealer adapted to seal the flange of the distributor to the extension of the second type of filter; and a third conveyor belt adapted to pass an assembled second type of filter packed with the second beverage ingredient therein to first assembly apparatus to place the assembled second type of filter between the first and second pickers to insert the assembled second type of filter into the container, wherein the first type of pod is assembled by activating the first assembly apparatus, and the second type of pod is assembled by activating the second assembly apparatus and passing the assembled second type of filter to the first assembly apparatus and placing the assembled second type of filter into the container and activating the first and second sealers.

BRIEF DESCRIPTION OF THE DRAWINGS

The invention can be better understood with reference to the following drawings and description. The components in the figures are not necessarily to scale, emphasis is instead placed upon illustrating the principles of the invention.

Moreover, in the figures, the referenced numerals designate the corresponding parts throughout the different views.

FIGS. 4M through 4R illustrate a number of alternative embodiments of providing an energy director between the extension and the rim.

FIG. 4S illustrates an enlarged view of the energy director.

FIG. 6B shows an inverted expanded perspective view of the first type of pod of FIG. 6A, while

FIG. 7B shows an inverted expanded perspective view of the second type of pod of FIG. 7A, while

DETAILED DESCRIPTION OF THE INVENTION

Figure 1B:
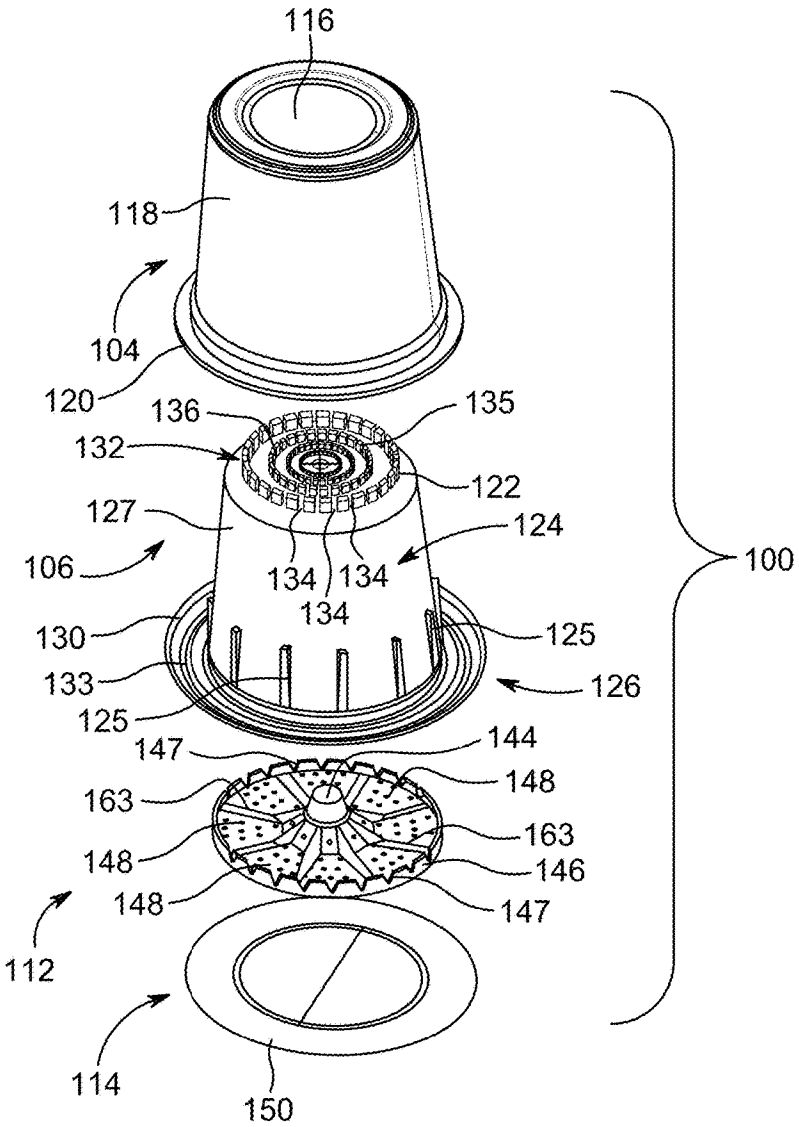
FIG. 1B shows an inverted expanded perspective view of the pod of FIG. 1A.

The various aspects of the invention can be better understood with reference to the drawings and descriptions described below. The components in the figures, however, are not necessarily to scale, and emphasis is instead placed upon illustrating the principles of the various aspects of the invention. The claimed invention is not limited to apparatuses or methods having all of the features of any one apparatus or method described below or to features common to multiple or all of the apparatuses described below. The claimed invention may reside in a combination or subcombination of the apparatus' elements or method steps described below. It is possible that an apparatus or method described below is not an example of the claimed invention. In general, when the terms "may", "is", and "are" are used as a verb in the description corresponding to a particular subject matter, these terms are generally used in this disclosure as an expression of a possibility of such subject matter rather than as a limiting sense such as when the terms "shall" and "must" are used. For example, when the description states that the subject matter "may be" or "is" circular, this is one of many possibilities, such that the subject matter can also include an oval, square, regular, irregular, and any other shapes known to a person ordinarily skilled in the art rather than being limited to the "circular" shape as described and/or illustrated in the corresponding referenced figure(s). In addition, when the term "may", "is", and "are" are used to describe a relationship and/or an action, these terms are generally used in this disclosure as an expression of a possibility. For example, when the description states that a subject matter A "may be" or "is" adjacent to a subject matter B, this can be one of many possibilities including the possibility that the subject matter A is not adjacent to the subject matter B or that the subject matter A may be connected, coupled, or engaged with the subject matter B as it would be understood by a person ordinarily skilled in the art.

Moreover, it is within the scope of the invention to combine the various embodiments disclosed relating to one or more particular drawings and their corresponding descriptions with one or more of the other drawings and their corresponding descriptions disclosed herein and/or other references incorporated herein by reference where such a combination may be combined and practiced by one ordinarily skilled in the art. The phrase "single-serve beverage pod" or "beverage pod" or the like in this disclosure generally refers to a single brewing process where a desired volume of beverage is brewed to serve one cup of beverage, however, it is within the scope of the invention to have a pod that packs sufficient beverage substance to brew multiple cups of beverage from a single brewing process or from multiple brewing processes. Also, the term "beverage substance" or "beverage ingredient" or the like generally refers to the underlying article when mixed with liquid such as water formulates a beverage such as coffee, tea, fruit drinks, punch, lemonade, soda, cocoa, milk, soup, energy drink, liquid medicine, cannabis, and the like. For instance, for coffee, the beverage substance may be coffee ground, instant powder coffee, and/or concentrated coffee in liquid form that can be diluted with water for consumption. For tea, the beverage substance may be tea ground, instant powder tea, and/or concentrated tea in liquid form that can be diluted with water for consumption. For baby milk, the beverage substance may be milk powder or concentrated milk liquid. For medicine such as for the flu or cold, the beverage substance may be in the powder or liquid form which can be dissolved with a predetermined portion of the heated water to brew a proper portion of the liquid medicine. *Cannabis* may be also provided in dried ground or powder form. In addition, the beverage substance may be provided in the form of pellets that are infused with desired flavors; and once the pellets are exposed to liquid such as water, the trapped flavors may be released by the pellets, which are then absorbed by the mixing liquid to formulate a beverage with the desired flavor. As such, the beverage substance may be in the form of ground, powder, liquid, pellets, and the like; and the beverage substance may be formulated from single or multiple ingredients. The same referenced numerals referred to in the drawings and descriptions generally correspond to the same or similar parts throughout the disclosure.

Figure 1A:
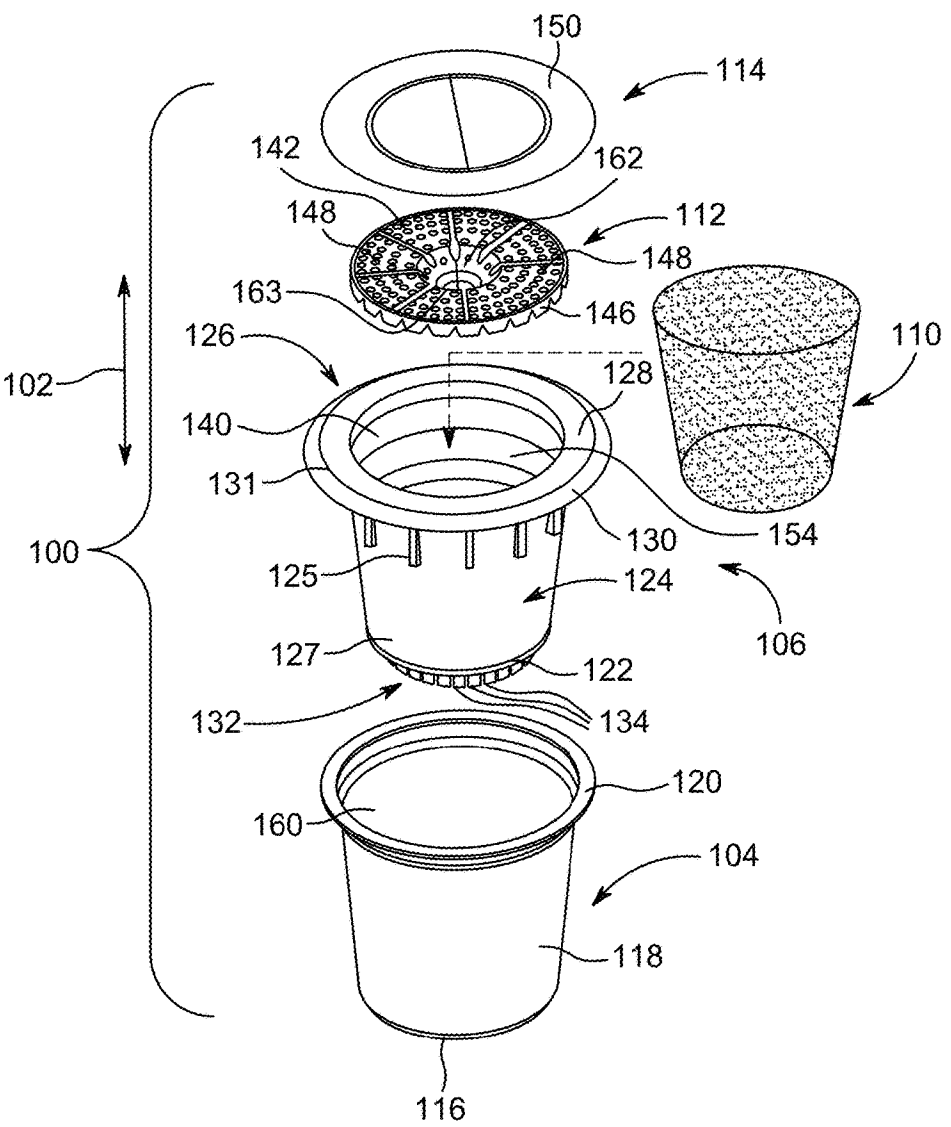
FIG. 1A shows an upright expanded perspective view of a pod along a longitudinal axis.

FIG. 1A shows an upright expanded perspective view of a pod 100 along a longitudinal axis 102 configured to brew beverages such as coffee and espresso; and FIG. 1B shows an inverted expanded perspective view of the pod 100 along the axis 102 to show the top and bottom views, respectively, of the various components of the pod 100. The pod 100 may include a container 104, a filter 106 adapted to receive beverage ingredient 110, a distributor 112, and a lid 114. The container 104 may have a base 116 that extends upwardly to form a sidewall 118 and then extends outwardly to form a rim 120 defining an opening 160. The container 104 may be formed from a variety of materials and from single or multilayered sheets sandwiched together to form a hermetically sealed barrier to protect the beverage ingredients contained therein from atmospheric oxygen entering the container. The container may be formed from a variety of materials known to one skilled in the art. In this regard, the container 104 may be formed in a manner described in U.S. Pat. No. 10,336,498 issued Jul. 2, 2019, entitled "CONTAINER WITH IMPROVED PUNCTUREABILITY", by Foster et al., which is hereby incorporated by reference in its entirety. In particular, the container 104 may be formed by a molding and thermoforming process of thermoplastic material, which may be substantially impermeable and imperforate. For example, the thermoplastic materials may include polyolefins such as polypropylene and polyethylene, polystyrene, nylon, and other polymers; and in particular, thermoplastic material may be a bio-based resin, readily recyclable, and/or comprise of at least a portion of recycled material such as a recycled polypropylene base resin.

The filter 106 may have a base 122 that extends upwardly to form a sidewall 124 and then extends outwardly to form an extension 126, which may be defined by one or more sections including a first section 128 and a second section 130. The first extension 128 may define an opening 154 adapted to receive the beverage ingredient 110. The first section may extend outwardly to a predetermined distance indicated by a reference numeral 131, and the second section 130 may extend farther therefrom outwardly in a beveled manner or downward sloping manner relative to the first section 128 towards the base 122. The extension 126 may have a line of weakness 133 between the first and second extensions 128 and 130 to allow the second extension 130 to weaken or separate from the first section 128 along the line of weakness 133, if desired. As discussed in more detail below, the line of weakness may allow the first section 128 to separate more readily from the rim 120 of the container. The first section 128 may extend outwardly at a distance, as indicated by the reference numeral 131, such that the first section 128 may extend farther out laterally than the rim 120 to allow the first section 128 to lay upon or overlap the rim 120 when the filter 106 is placed within the container 104. The base 122 of the filter 106 may have a plurality of holes 136 where the size and number of the holes 136 may be predetermined to control the flow of the beverage through the holes 136 to provide a desired pressure within the filter 106, as discussed in more detail below. The base 122 may also have at least one retainer wall 132 with a plurality of slits 134, as discussed in more detail below.

The container 104 may be adapted to receive the filter 106 and the first section 128 of the extension 126 may be releasably sealed or adhered to the rim 120 of the container 104 where upon a force applied to the underside of the second section 130, the first section 128 may peel, separate, and/or snap off from the rim 120. In this regard, the releasable bond(s) may be utilized such as the embodiments disclosed in US Published Application No. 2014/0161936, published Jun. 12, 2014, entitled CONTAINER WITH REMOVALE PORTION by Trombetta et al., which is hereby incorporated by reference in its entirety. Alternatively, the first section 128 of the filter 104 may be ultrasonically sealed to the rim 120 of the container 104 such as with the torsional ultrasonic welding method where high-frequency vibrational energy may be applied tangentially as disclosed in U.S. Patent numbers: (1) U.S. Pat. No. 10,554,004 entitled "Sonotrode, device and method for producing a join" issued Feb. 4, 2020; and (2) U.S. Pat. No. 10,532,424 entitled "Device for welding components by means of ultrasound" issued Jan. 14, 2020, both Assigned to Telsonic Holding AG, which are hereby both incorporated by references in their entirety.

The distributor 112 may have a base 142 with an outer skirt 146 adapted to engage with the inner side 140 of the sidewall 124 juxtaposed to the first extension 128 such that the base 142 may be adjacent to the first section 128 of the extension 126. The skirt 146 may extend upwardly and/or downwardly to engage with the inner side 140 of the sidewall. The base 142 may have a protrusion 144 extending towards the inner space within the filter 106. The protrusion 144 may form a cavity 162 sized to receive an inlet liquid injection member, as discussed in more detail below, such as an inlet needle to inject heated water into the filter 106. The base 142 may have a plurality of holes 148 to allow the heated water to pass therethrough to substantially distribute the water over the opening 154 of the filter 106. The size of the holes 148 may be less than the average size of the beverage ingredient 110. This may substantially prevent the beverage ingredient 110 from entering the protrusion area 144 thereby substantially preventing the beverage ingredient from clogging the inlet injection member, which can cause the brewing mechanism to malfunction.

The sidewall 124 may have one or more ribs 125 extending outwardly. The extending ribs 125 may be formed on the exterior side 127 of the sidewall 124 adjacent to the extension 126. As the filter 106 is inserted into the container 104, the extending ribs 125 may engage with the sidewall 118 of the container 104 to center the filter 106 relative to the container 104 such that the filter 106 may be substantially aligned with the filter 106 along the axis 102 of the pod 100. The distributor 112 may be placed over the beverage ingredient packed within the filter 106 and the skirts 146 may be engaged or sealed within the interior side 140 of the sidewall 124 of the filter 106 such that the beverage ingredient 110 may be substantially compact between the distributor 112 and the base 122. The distributor 112 may have a skirt 146 with cutouts 147 around the circumference of the skirt 146 to allow the outer area of the distributor 112 to flex and bend. The protrusion 144 may have an inverted bell like shape to enlarge the area of the cavity 162 adapted to receive the inlet member of the brewing mechanism. The enlarged cavity 162 may also allow the outer area of the distributor 112 to flex and bend more readily.

The manner in which the beverage ingredient is packed within the filter 106 may be predetermined to control the density of the beverage ingredient 110 therein to substantially prevent air pockets, gaps, and channels from forming within the ingredient 110 during manufacturing, shipping, handling, and during the brewing process. As a general rule, beverage ingredient 110 with greater density may require greater pressure to push the heated liquid through the beverage ingredient 110, which can extract more intense flavor from the beverage ingredient 110 in less time. Once the first section 128 of the filter 106 is separated from the rim 120, as discussed in more detail below, the distributor 112 may flex to substantially contain the ingredient 110 within the filter 106 to avoid forming air pockets therein. The lid 114 may be placed over the filter 106 and the outer edge 150 of the lid 114 may be sealed and/or bonded to the first section 128 of the filter 106. In particular, the lid 114 may be formed from a flexible liner with sufficient tensile strength to resist tearing due to the high-pressure during the brewing process.

The pressure developed within the beverage ingredient 110 can determine the type of beverage brewed such as coffee under lower pressure and espresso under higher pressure. A number of other factors can determine the pressure developed within the beverage ingredient 110 such as the pressure and temperature of the heated water injected into the beverage ingredient, the grind size and density of the beverage ingredient, the size and number of holes 136 in the base 122 of the filter 106, the depth of the beverage ingredient, and etc. The base 122 may have a predetermined number of holes sized to allow the beverage to pass therethrough but substantially prevent the beverage ingredient packed within the filter 106 from passing through the holes due to pressure within the filter during the brewing process. For instance, the sidewall 124 may be substantially solid to direct most of the beverage, if not all, to pass through the holes 136 on the base 122. Moreover, the extending ribs 125 extending from the sidewall 124 may substantially maintain its shape under the desired brewing pressure conditions. The number and/or size of the holes 136 formed in the base 122 may be predetermined to provide sufficient resistance to flow of beverage to develop the desired brewing pressure within the beverage ingredient to brew a desired beverage. For example, to brew espresso under high-pressure from about 6 to 15 bars, the coffee beans may be finely grounded where the average grind size may be from about 40 to about 450 microns, and to brew coffee under low-pressure from about 1 to 4 bars, the coffee may be grounded more coarsely where the average grind size may be from about 500 to about 1,000 microns; and to substantially prevent the grinds from passing through the holes, the size of the holes 136 may be less than the average grind size of the coffee grounds. The holes may have a variety of shapes such as circular, square, rectangular, regular and irregular configuration.

Along with the size of the holes 136, the number of holes 136 provided in the base 122 may be predetermined to develop the desired pressure within the filter 106 to brew the intended beverage such as espresso or coffee. That is, the brewing mechanism may inject heated water into the pod 100 at a pressure up to about 19 bars but some of the pressure may be released through the coffee ground and through the filter 106 such that the espresso flavor beverage may be extracted from the finer coffee ground at about 8 bars, for example, with the difference of 11 bars of pressure being released, in this example. That is, the pressure within the filter may largely depend upon the size of the beverage ingredient and the size and number of holes 136. For instance, for low-pressure coffee, coarser ground coffee may be packed within the filter 106 and the size and number of holes 136 may be greater than that of the holes 136 to brew espresso, and substantial pressure may be released through the coffee ground and through the filter 106 such that coffee may be extracted from the coarser coffee ground at about 3 bars, for example, with the difference of 16 bars of pressure being released.

In general, for low-pressure coffee, the size of the holes 136 may be less than an average grind size or less than the lower end of the distribution of the grind sizes to brew coffee where the average grind size may be from about 450 to about 1,000 microns; and in particular from 500 to about 700 microns. Note that some soluble may have an average grind size of about 1,000 to 2,500 microns. For instance, coffee ground may have grind size distribution from 500 to 700 microns with an average or mean grind size of about 600 microns. With such grind size distribution and average, the size of the holes 136 to brew coffee may be less than about 600 microns or less than 500 microns to substantially prevent coffee ground from passing through the holes and to release the pressure within the coffee grounds to brew coffee. Alternatively, the pod 100 may include a paper filter between the holes 136 and the coffee ground, although not necessary, to allow the beverage to pass while preventing the smaller coffee sediments from passing therethrough during brewing process. Moreover, it is within the scope of the invention to have the size and number of holes 136 in the base 122 to be independent of the grind size of the beverage ingredient 110 where the size of the holes 136 may be sized to substantially prevent the ingredient sediment from passing through the holes 136.

FIG. 1B shows at least one retainer wall 132 extending from the base 122. In particular, the base 122 may have a plurality of retainer walls 132 extending therefrom with layers of retainer walls 132 forming a pathway between two adjacent retainer walls 132, and with a plurality of slits 134 on each of the retainer wall 132, as discussed in more detail below. The retainer walls 132 may have distal ends 135 that contour the shape of the inner side of the base 116 of the container 104.

Figure 1D:
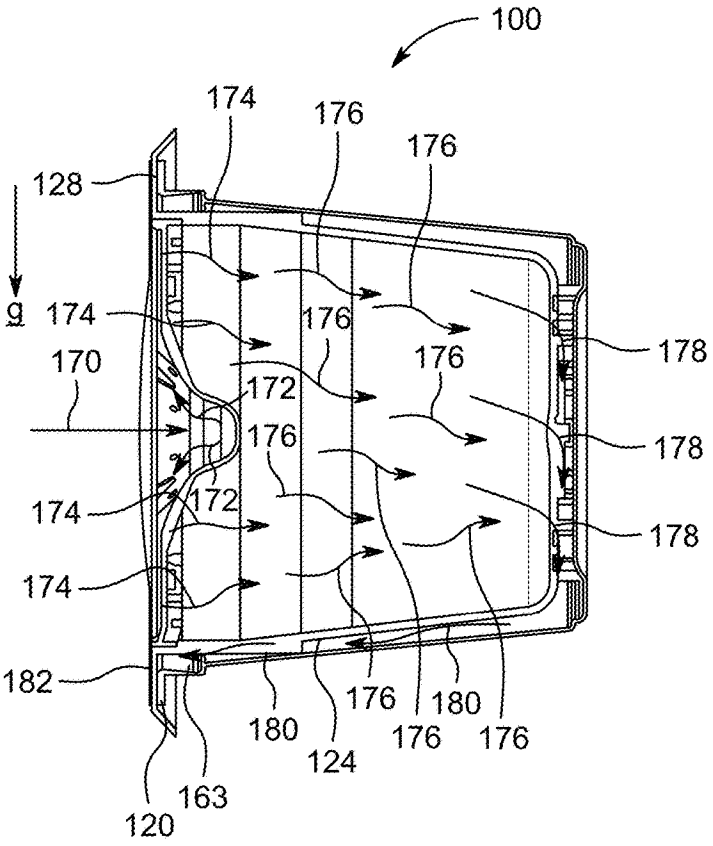
FIG. 1D shows a cross-sectional view of the assembled pod in a brewing orientation.
Figure 1C:
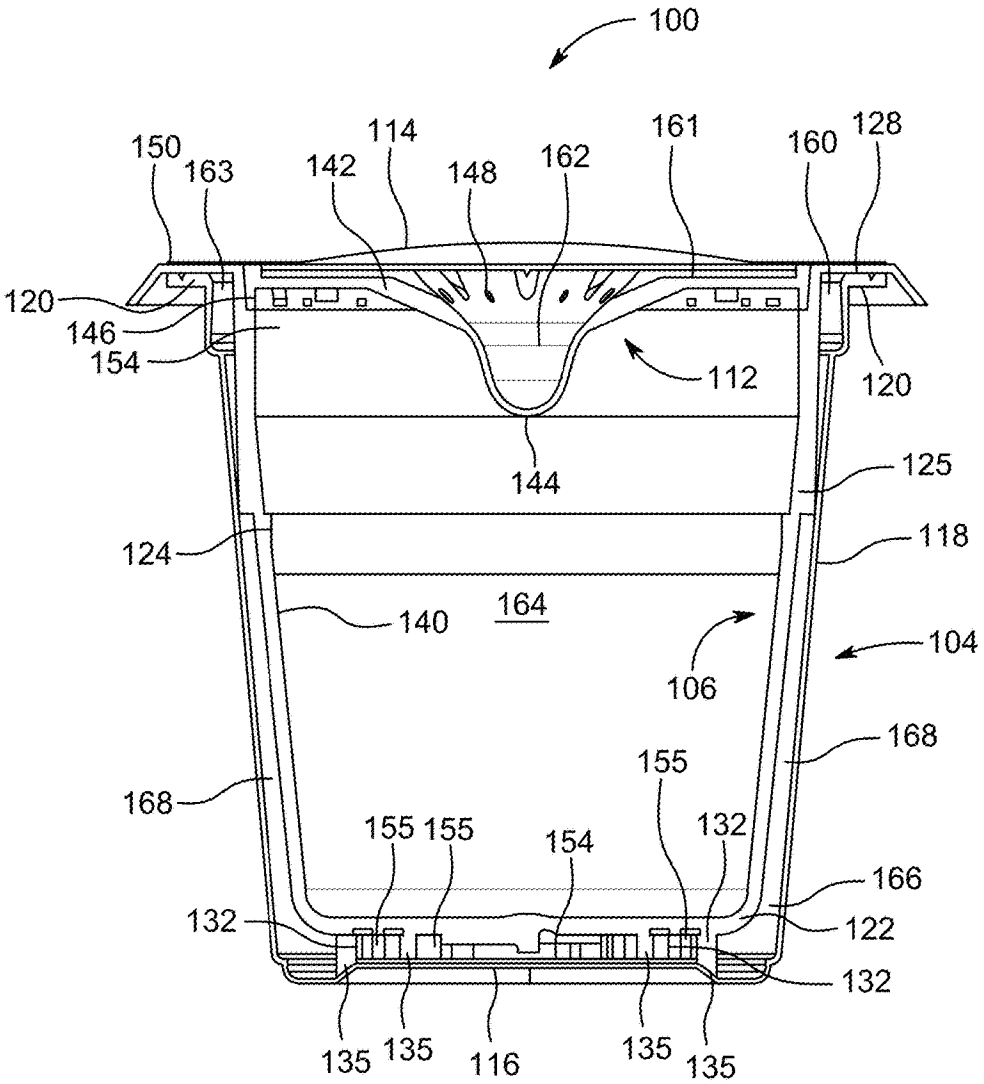
FIG. 1C shows a cross-sectional view of the assembled pod without the beverage ingredient.

FIG. 1C shows a cross-sectional view of an assembled pod 100 without the beverage ingredient 110 where the interior of the container 104 may be divided into different chambers including the cavity 162 that extends outwardly to form the gap 161 between the lid 114 and the base 142 of the distributor as discussed above; and a first chamber 164 and a second chamber 166. The first chamber 164 may be generally defined as the interior space of the filter 106 or the space between the distributor 112 and the second chamber 166. The second chamber 166 may be generally defined as the space between the filter 106 and the container 104. The cavity 162 may be adapted to receive an inlet member (not shown) from a high or low-pressure brewing mechanism and the heated water from the inlet may flow along the gap 161 to distribute the heated water in a substantially even manner through the holes 148 to more evenly mix with the beverage ingredient 110 to extract the beverage such as espresso or coffee from the ingredient 110. The base 122 of the filter 106 may be in close approximation to the base 116 of the container 104 to enlarge the first chamber 164 to pack about 6 to 18 grams of coffee ground to brew about 0.8 to about 3 oz of espresso or 6 to 14 oz of coffee. The size and number of holes 136 provided on the base 122 may be predetermined to brew a desired beverage such as espresso or coffee. The circumference or diameter of the sidewall 124 of the filter 106 may be less than the circumference or diameter of the sidewall 118 of the container 104 such that a pathway 168 may be provided between the two sidewalls 124 and 118 around the circumference of the sidewall 124 of the filter 106.

The assembled pod 100 may have the lid 114 as a proximal end, and the base 116 of container 104 may represent a distal end of the pod 100. The pod 100 may have a first pathway 155 along the distal end of the pod, and a second pathway 168 from the distal end to the proximal end of the pod. In particular, the first pathway 155 may be formed between the base 122 of the filter and the base 116 of the container 104, and a second pathway 168 may be formed between the sidewall 124 of the filter and the sidewall 118 of the container. The first pathway 155 may be formed by extending the distal ends 135 of the individual retainer walls 132 from the base 122 such that distal ends 135 may substantially contour the inner side 154 of the base 116 of the container 104 thereby minimizing the gap between the distal ends 135 and the base 116 or have the distal end 135 engage with the base 116 of the container 104. As discussed in more detail below, the individual retainer walls 132 may be spaced apart from each other thereby forming the first pathways 155 between the adjacent walls 132 with the holes 136 formed in the base 122 along the pathway between adjacent walls. In particular, the holes 136 may be formed between adjacent walls 132, and the walls 132 may have the slits 134 to allow the first pathways 155 to traverse across from the inner wall to the outer walls.

The extending ribs 125 may engage with the sidewall 118 of the container 104 to center the filter 106 relative to the container 104. This may allow the assembled pod 100 to substantially maintain the second pathway 168 that is substantially uniform between the two sidewalls 118 and 124 around the circumference of the sidewall 124. The second pathway 168 may extend from the distal end of the filter to the proximal end of the pod 100. In particular, the sidewall 124 may generally extend upwardly from the base 122 in a taper or expanding manner relative to the longitudinal axis 102, in part, to enlarge the size of the first chamber 164 to be able to pack more beverage ingredient. As the sidewall 124 extends upwardly towards the proximal end of the pod 100, the sidewall 124 may extend in a substantially parallel manner relative to the longitudinal axis 102 to enlarge a gap 163 between the rim 120 and the sidewall 124 at the proximal end. As discussed in more detail below, the enlarged gap area 163 may slow down the flow of the beverage flowing along the second pathway 168 so that the beverage may drain from the pod more smoothly thereby minimizing spattering of the beverage as it drains.

The extending ribs 125 may also engage with the sidewall 118 of the container 104 during the brewing process such that the lateral force applied to the interior side 140 of the sidewall 124 may transfer to the sidewall 118 of the container 104. During the brewing process, the pod 100 may be placed in the brewing chamber (not shown), which includes a holder (not shown) adapted to receive the pod 100. The holder may support the outer contour of the container 104 such as the sidewall 118 and the base 116, which in turn supports the sidewall 124 and the retainer walls 132 of the filter 106. This may substantially prevent the filter 106 from deforming along the sidewall 124 and the base 122 due to the internal high-pressure within the filter 106, such as when brewing high-pressure beverages like espresso. That is, the extending ribs 125 between the two sidewalls 124 and 118, and the retainer walls 132 between the two bases 122 and 116 may substantially transfer the stress on the filter 106 to the holder in order to substantially maintain the first and second pathways 155 and 168 open. Note that various components of the pod 100 may be assembled in a variety of different orders, and the assembly process is not limited to the steps discussed above.

FIG. 1D shows the pod 100 in a substantially horizontal position in reference to the gravitational direction g, which may be a brewing position of the pod 100. As discussed in more detail below, during the brewing process, the heated water may be injected into the pod 100 through the lid 114 and into the cavity 162 as indicated by the direction arrow 170; and thereafter, the heated water may flow along the following path within the pod 100: (1) as indicated by the direction arrows 172, the protrusion 144 may redirect the heated water towards the lid 114 or the proximal end; (2) as indicated by the direction arrows 174, the heated water may flow along the gap 161 between the lid 114 and the distributor 112 and exit through the holes 148 in the base 142 of the distributor 112 and mix with the beverage ingredient 110 within the first chamber 164; (3) as indicated by the direction arrows 176, the heated water may extract the beverage from the beverage ingredient 110 and the pressure from the heated water injected into the cavity 162 may direct the beverage towards the distal end 122 of the filter 106; (4) as indicated by the direction arrows 178, the beverage may then pass through the holes 136 on the base 122 and flow along the first pathway 155, as discussed in more detail below; and (5) as indicated by the direction arrows 180, with the pod 100 in the substantially horizontal orientation, the gravity may direct the beverage to flow along the second pathway 168, which may be along the six O'clock position of the pod 100 when viewing the first extension 128 as a face on a clock, and the bottom 182 of the first extension 128 may represent the six O'clock position. Note that it is within the scope of the invention to have the pod in a variety of other orientations rather than on a horizontal orientation such as facing downwards or upwards, where in the upward position, the pressure within the pod may force the beverage upwards to drain from the gap.

The external ribs 125 may maintain a uniform second pathway 168 such that the pod 100 may be brewed in any rotational orientation about the first extension 128. In other words, the pod may be inserted into a brewing mechanism in any rotational direction since the gap in the second pathway 168 is substantially similar around the circumference of the two sidewalls 118 and 124. As discussed above, the gap 163 between the proximal end of the sidewall 124 and the rim 120 may be enlarged to slow down the flow of beverage near the proximal end so that the beverage may drain more smoothly from the pod 100 via a gap formed between the extension 126 and the rim 120, as discussed in more detail below. Note that the sidewall 124 of the filter 106 may not have holes to substantially direct the beverage to flow towards the distal end 122 of the filter 106 and substantially prevent the beverage from passing through sidewall 124. However, it is within the scope of the invention to have holes in the sidewall 124 depending on the application. In addition, the distributor 112 may or may not be utilized depending on the application. If the distributor is not utilized, then the heated water from the brewing chamber may be directed towards the beverage ingredient 110.

Figure 2A:
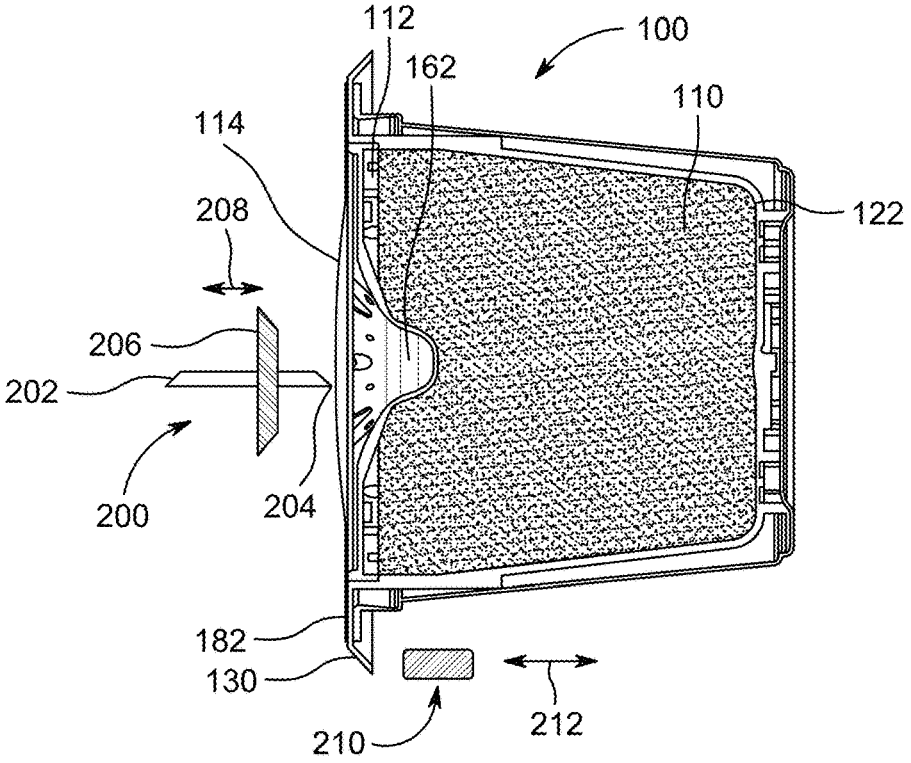
FIG. 2A shows a cross-sectional view of the pod in a brewing orientation juxtaposed to an inlet member and a detaching member.

FIGS. 2A through 2D show cross-sectional views of the pod 100 in different stages to illustrate a manner and method of brewing a beverage with the pod 100. In this example, FIG. 2A shows the pod 100 in a substantially horizontal position or brewing orientation as discussed above in reference to FIG. 1D, packed with beverage ingredient 110 within the first chamber 164. For example, the beverage ingredient 110 may be coffee ground to brew low-pressure coffee with an average coffee grind size from about 500 microns to about 1,000 microns, or brew high-pressure espresso with an average coffee grind size from about 40 microns to about 400 microns; and the size and number of holes 136 may be smaller than the average coffee grind size to substantially prevent the coffee ground from passing through the holes 136 in the base 122, but release the pressure within the first chamber 164. In the brewing orientation, the pod 100 may be juxtaposed to an inlet member 200 having an inlet end 202 and a tip 204 with a gasket 206 therebetween. The member 200 may be adapted to slide relative to the pod 100 as indicated by the double ended direction arrow 208, or the pod may be adapted to slide relative to the member 200, or both elements 100 and 200 may be adapted to slide or move relative to each other simultaneously or sequentially. The member 200 may be positioned relative to the pod 100 such that the tip 204 may be juxtaposed to the lid 114 in order to penetrate the cavity 162 of the distributor 112. The pod 100 may also be juxtaposed to a detaching member 210 position behind the second extension 130 at about the six O'clock position 182, as discussed above in reference to FIG. 1D, and in reference to the gravitational direction g. The detaching member 210 and the pod 100 may be adapted to slide relative to each other as indicated by the double ended direction arrow 212 where one or both elements 100 and 210 may move relative to each other simultaneously or sequentially.

Figure 2B:
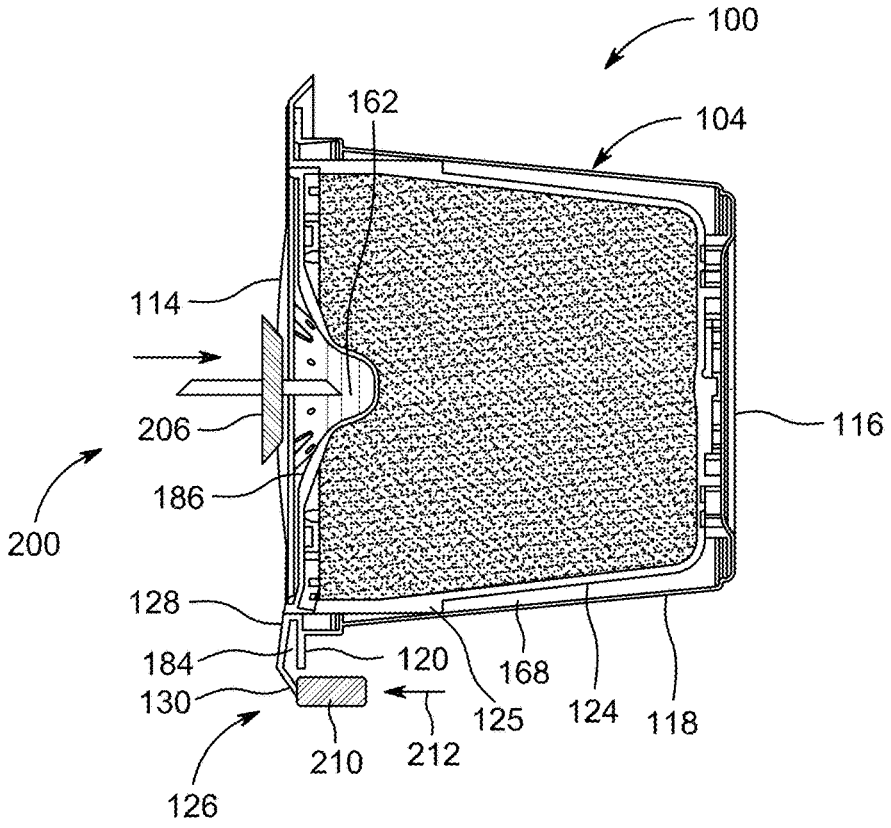
FIG. 2B shows a cross-sectional view of the pod with the inlet member piercing through the lid and the detaching member separating the extension of the filter from the rim of the container to form a gap therebetween.

FIG. 2B shows that to begin the brewing process, the inlet member 200 may pierce, puncture, or cut through the lid 114, or use any other apparatus or method known to one skilled in the art, and the tip 204 may rest within the cavity 162, and the gasket 206 may engage with the lid 114 surrounding the member 200 to substantially prevent the water from leaking out of the opening between the member 200 the lid 114 formed by the punctured hole within the lid. The detaching mechanism 210 may move towards an extended position as indicated by the direction arrow 212 to engage with the second extension 130 to separate the first extension 128 from the rim 120 near the six O'clock position 182 thereby forming a gap 184 between the extension 126 and the rim 120 that may extend from about four O'clock to about eight O'clock positions; and in particular from about five O'clock to about seven O'clock positions. The second section 130 may taper towards the base 116 of the container 104 such that the underside of the second section 130 may form a concave shape or hook to allow the detaching member 210 to engage with the underside of the second section 130 to separate the first extension 128 from the rim 120 more consistently.

FIG. 2B also shows that the diameter of the gasket 206 may be smaller than the diameter of the opening 186 forming the cavity 162 such that the force applied by the gasket 206 onto the lid 114 may not directly transfer to the distributor 112 to minimize the resistance upon the extension 126 to allow the detaching mechanism 210 to separate the first extension 128 from the rim 120 and to substantially maintain the gap 184 opening. The newly formed gap 184 may form a part of the second pathway 168 between the two sidewalls 118 and 124 and also between the adjacent extending ribs 125 to allow the beverage formed within the pod 100 to flow along the second pathway 168 and drain through the gap 184, as discussed in more detail below.

Figure 2C:
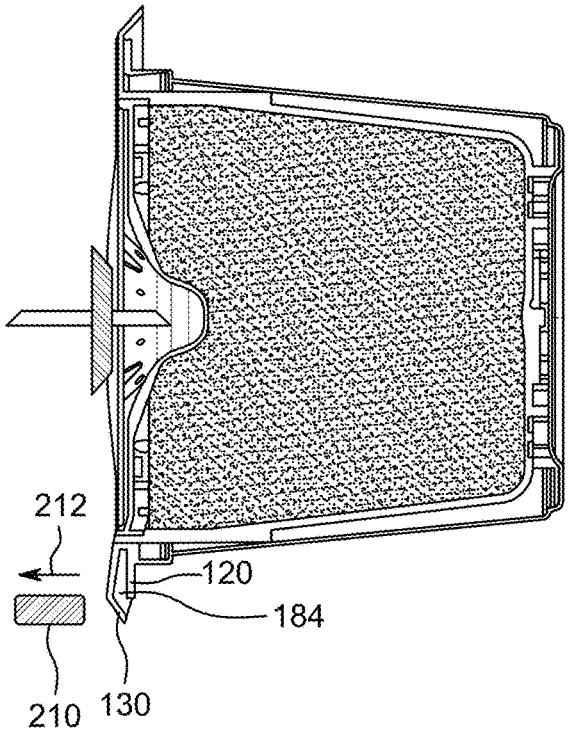
FIG. 2C shows the detaching member being on the opposite side of the lid to not interfere with the path of the beverage draining from the gap between the extension and the rim.

FIG. 2C illustrates that as the detaching member 210 moves further towards the inlet member 200 as indicated by the direction arrow 212, the second extension 130 may flex to allow the detaching member 210 to pass and rest on the opposite side of the extension such that the detaching member 210 may not interfere with the beverage draining out of the gap 184. Once the gap 184 is formed, a combination of the rim 120 and the concave shape of second extension 130 that extends downwardly may act as a spout to allow the beverage to pour from the gap 184 in a smooth manner to minimize spattering of the beverage. This may provide a clear path for the beverage to drain from the pod 100 without coming in to contact with the brewing mechanism to avoid contaminating the beverage, as discussed in more detail below.

Figure 2D:
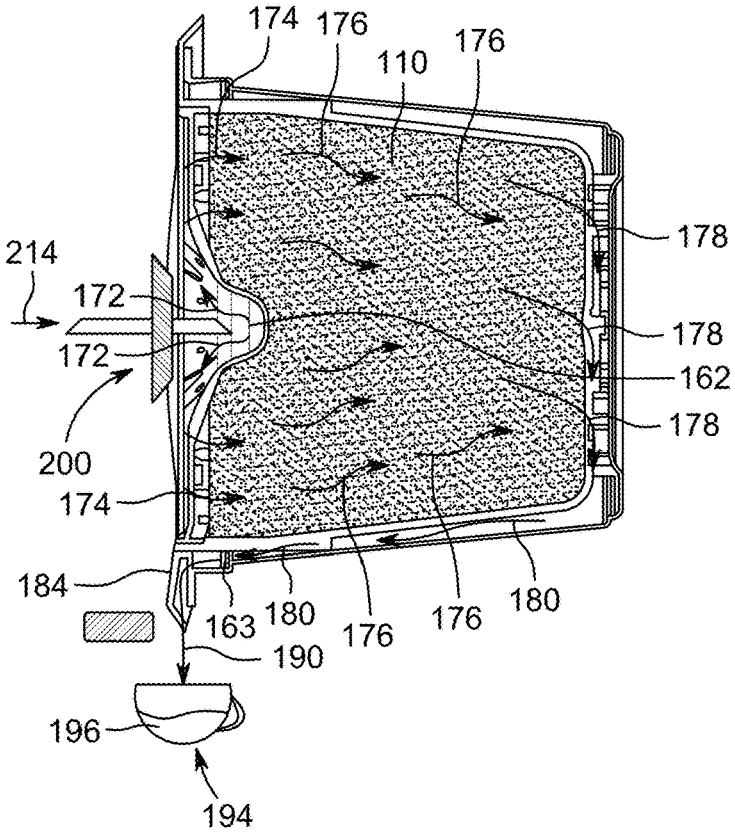
FIG. 2D shows the pod brewing in a substantially horizontal position and draining the beverage unobstructed by the brewing mechanism.

FIG. 2D shows the inlet member 200 injecting heated water 214 into the cavity 162. Depending on the application, the heated water 214 may be provided at a low-pressure from about 1 to about 4 bars and/or at a high-pressure from about 6 to 15 bars. In reference to FIG. 1D, the heated water 214 may flow along the path as indicated by the direction arrows 172 and 174, and the beverage 196 extracted from the beverage ingredient 110 may flow along the path as indicated by the direction arrows 176, 178, and 180, and drain out of the gap 184 as indicted by the direction arrow 190 and pour the beverage 196 into a mug 194. In particular, the flow of the beverage 196 may be controlled to drain smoothly from the pod 100 based on the following: (1) the beverage 196 flowing along the first pathway 155 may be controlled based on the ratio of the slits 134 in the retainer walls 132 being aligned compared to slits 134 being staggered; (2) during the brewing process, the extending ribs 125 may substantially maintain the second pathway 168 uniformly open from the distal end to the proximal end, as discussed in reference to FIG. 1C; (3) the gap 163 in the proximal end of the pod 100 between the rim 120 and the sidewall 124 may be enlarged where the greater opening may slow down the beverage 196 to flow more smoothly near the proximal end along the second pathway 168; and (4) once the gap 184 is formed, the combination of the rim 120 and the concave shape of second extension 130 that extends downwardly may act as a spout to allow the beverage to pour from the gap 184 in a smooth manner to minimize spattering of the beverage. Accordingly, once the beverage 196 passes through the holes 136, the beverage 196 may flow along the first and second pathways 155 and 168, respectively, in a controlled and smooth manner, and also drain smoothly via the gaps 163 and 184 indicated by the direction arrows 178, 180, and 190; and pour into the mug 194 unobstructed by the brewing mechanism to substantially avoid contaminating the beverage and the brewing mechanism. In addition, the slits 134 in the retainer walls 132 may form a second stage or multiple stages of filtering as the beverage 196 flows along the first pathway 155, as discussed above, to brew a more cleaner tasting beverage with less sediment. Accordingly, the pod 100 may be brewed in a substantially horizontal position to brew and drain the beverage from the pod unobstructed by the brewing mechanism.

In reference to FIGS. 1A and 1C, the pod 100 may be assembled in a variety of ways. For example, the opening 160 of the container 104 may be sized to receive the filter 106 such that the first section 128 may rest upon the rim 120 of the container 104. The first section 128 of the filter 106 may be releasably sealed to the rim 120 of the container 104. This may be done with the container 104 in the upright position, the proximal end facing upwards, utilizing a variety of sealing and ultrasonic welding methods such as torsional ultrasonic, spin, heat seal or ultrasonic welding method. The opening 154 of the filter 106 as defined by the first section 128 may receive the beverage ingredient 110 and may be tampered to minimize air pockets within the ingredient 110. The distributor 112 may be placed over the ingredient 110 and substantially enclose the opening 154 of the filter 106. The distributor 112 may have a cavity 162 as defined by the protrusion 144 adapted to receive an inlet member to inject liquid therein. Note that it is within the scope of the invention to have the skirt 146 extending upwardly from the base 142 such that there is a sufficient distance between the lid 114 and the base 142 such that protrusion 144 and cavity 162 may not be needed. The lid 114 may be placed over the first section 128 and a circumference near the outer edge 150 of the lid 114 may be sealed to the first section 128 to hermetically seal the ingredient 110 within the pod 100. The lid 114 may be sealed to the filter 106 through a variety of methods using heat, adhesive, glue, and ultrasonic welding to hermetically seal the beverage ingredient 110 within the pod 100. The distributor 112 may have a plurality of ribs protruding toward the lid 114 to maintain a gap between the lid 114 and the distributor 112 such that the liquid injected into the cavity 162 may flow along the gap and drain through the holes 148 and mix with the beverage ingredient 110 there-underneath.

Figure 3B:
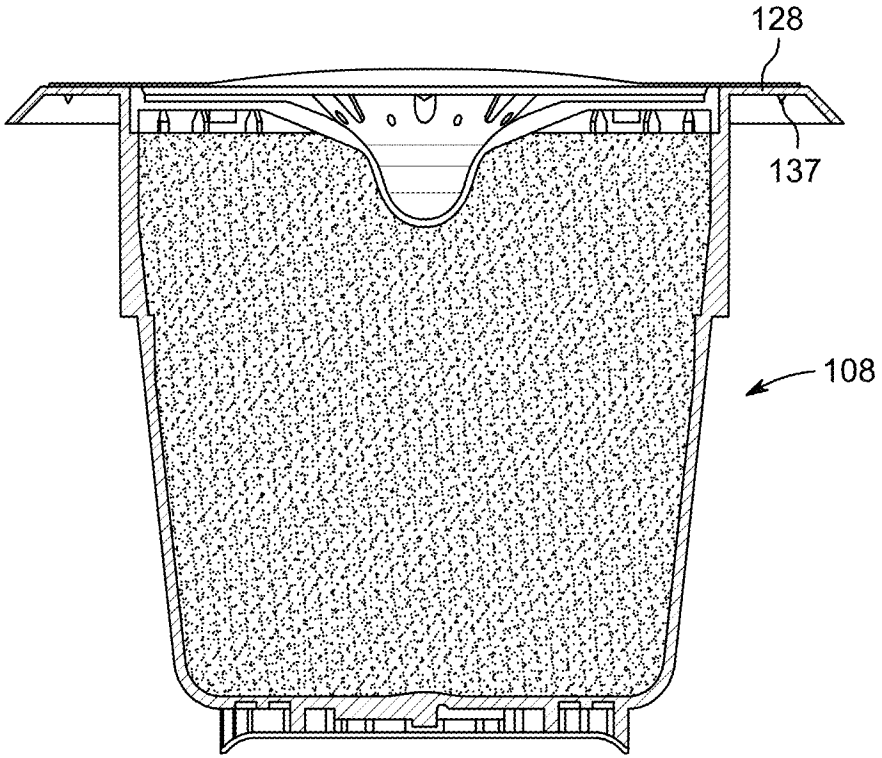
FIG. 3B shows the assembled filter.
Figure 3A:
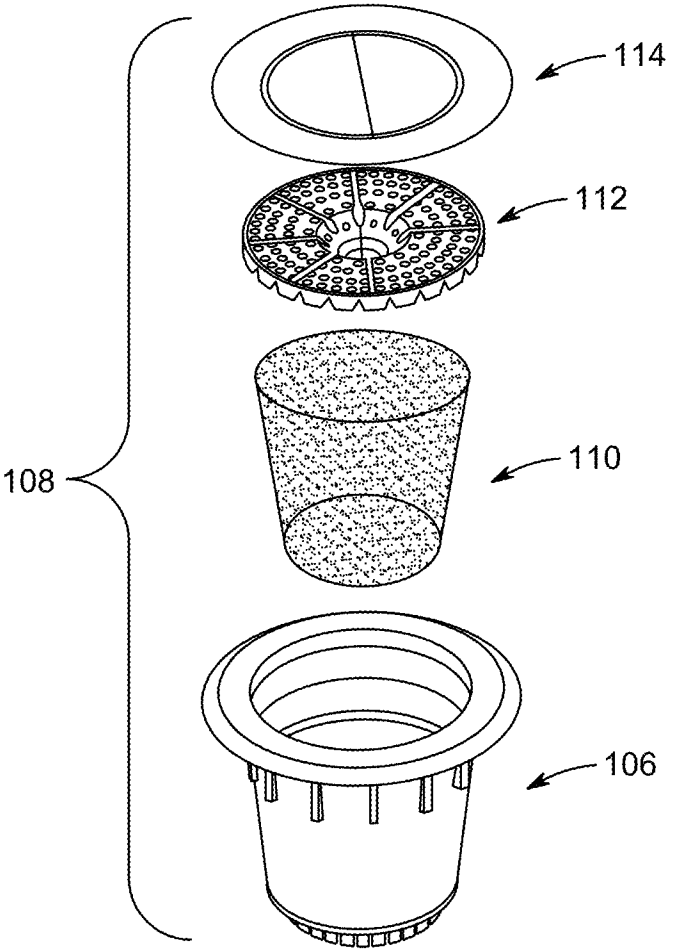
FIG. 3A shows an expanded view of an assembled filter.
Figure 3D:
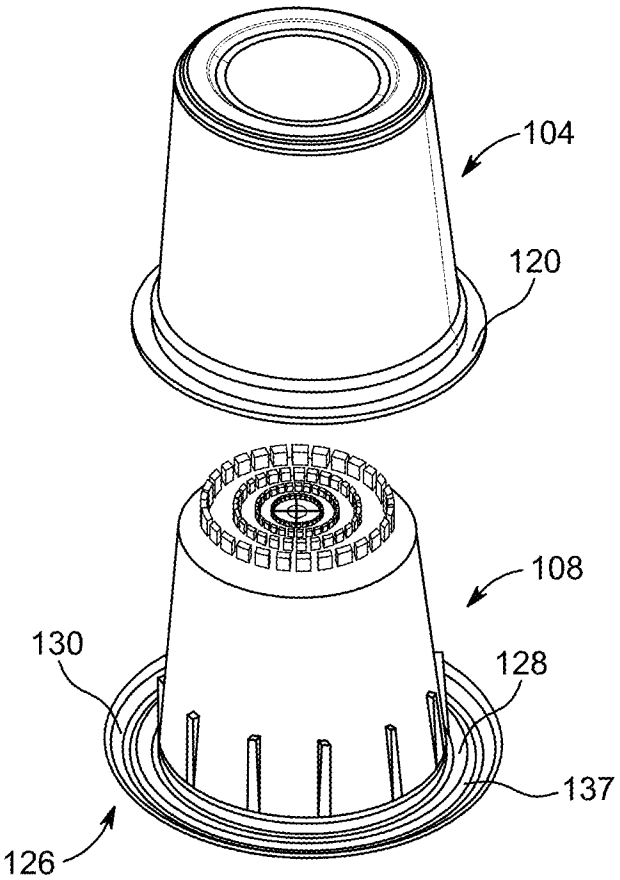
FIG. 3D shows an expanded view of a container and the assembled filter.
Figure 3C:
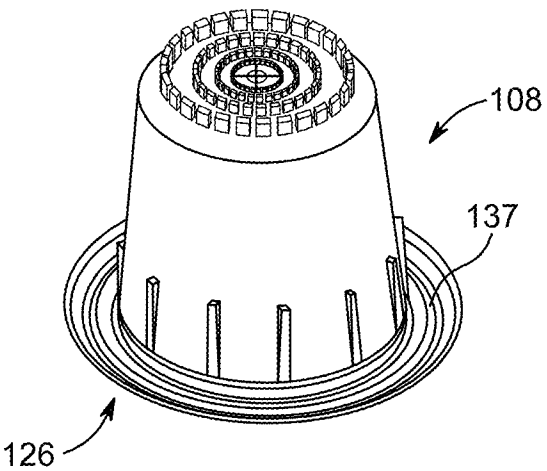
FIG. 3C shows the assembled filter in an inverted position.

FIG. 3A through 3D illustrates an alternative method of assembling the pod 100. FIGS. 3A and 3B show that the filter 106, beverage ingredient 110, distributor 112, and the lid 114 may be assembled first as discussed above in reference to FIG. 1A to form an assembled filter 108. FIG. 3B shows a cross-sectional view of the assembled filter 108 where the underside of the first section 128 may have an energy director 137 adapted to absorb the energy from the torsional ultrasonic welding method to melt and infuse with the rim 120 as discussed in more detail below. FIG. 3C shows that the assembled filter 108 may be flipped or inverted to have the extension 126 or the proximal end facing downwards showing the energy director 137. FIG. 3D shows that the container 104 may be inverted as well and placed over the assembled filter 108 such that the rim 120 of the container may be placed on top of the energy director 137. To releasably seal the extension 126 to the rim 120, a torsional welding system, may be utilized for example. In this process, a high-frequency vibrational energy may be transferred tangentially where the sonotrode activates the upper part and moves it horizontally in relative to the lower part. For example, the upper part may the container and the lower part may be filter or vice versa. The high vibration frequency may be from about 15 kHz to about 80 kHz, and in particular from about 15 kHz to about 25 kHz, and further about 20 kHz; and the vibration frequency may be applied from about 1 ms to about 1200 ms, in particular from about 1 ms to about 800 ms, and further for about 800 ms, where the vibration energy may be substantially transferred to the energy director 137 such that amplitude and the welding pressure may substantially melt the energy director 137 to releasably join and/or hermetically seal the first section 128 of the extension 126 to the rim 120 so that the extension 126 may separate from the rim 120 upon an application of sufficient force underneath the second section 130.

Figure 4B:
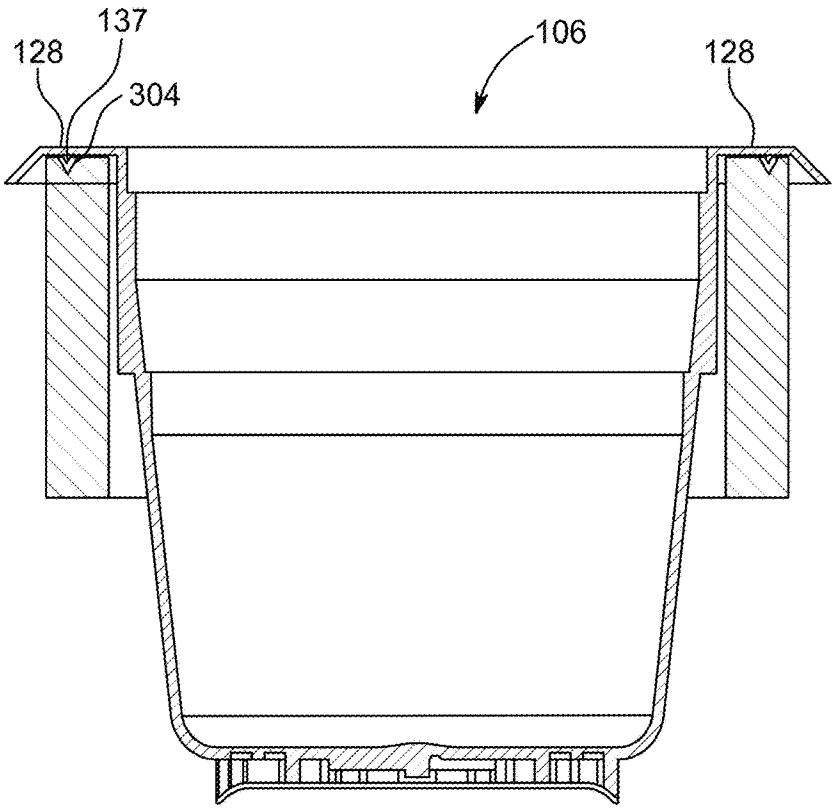
FIG. 4B shows the filter fully inserted into the lower well.
Figure 4A:
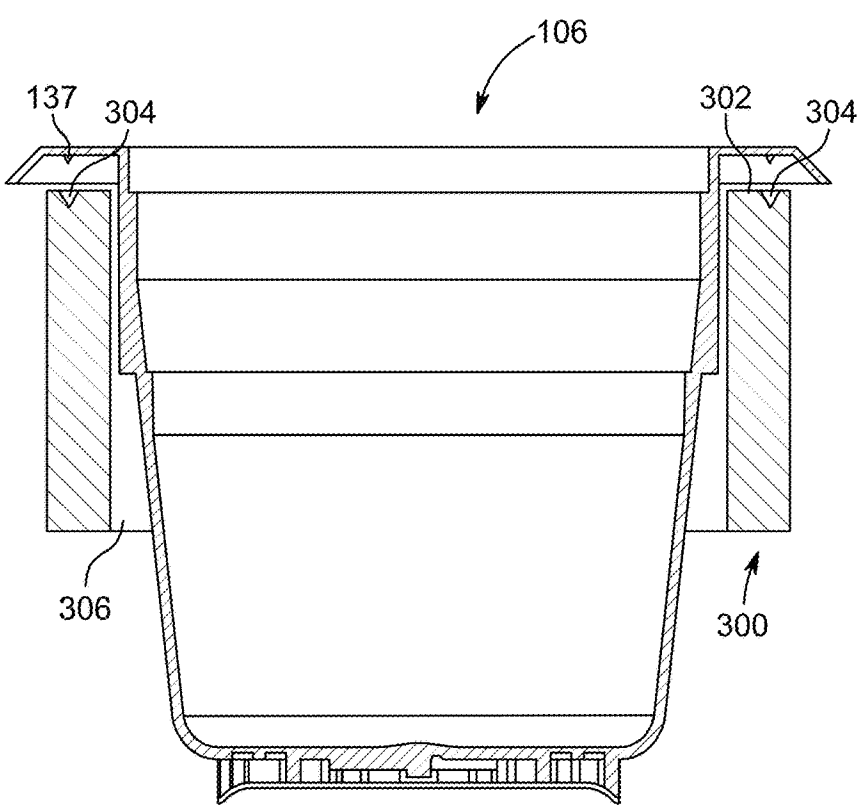
FIG. 4A shows a filter partially inserted into a lower well.
Figure 4D:
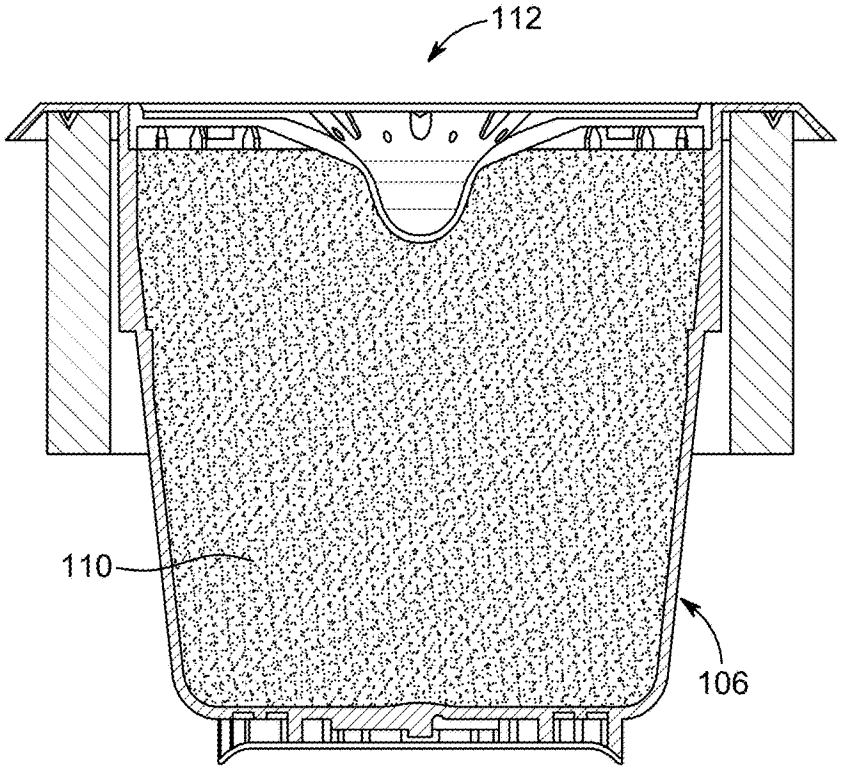
FIG. 4D shows a distributor placed juxtaposed to the beverage ingredient.
Figure 4C:
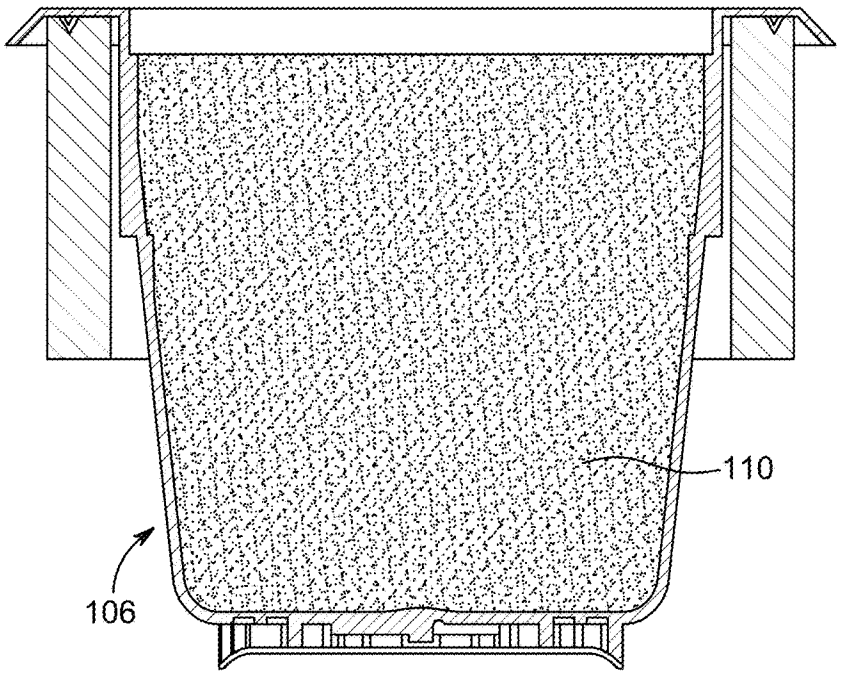
FIG. 4C shows the filter filled with beverage ingredient.
Figure 4F:
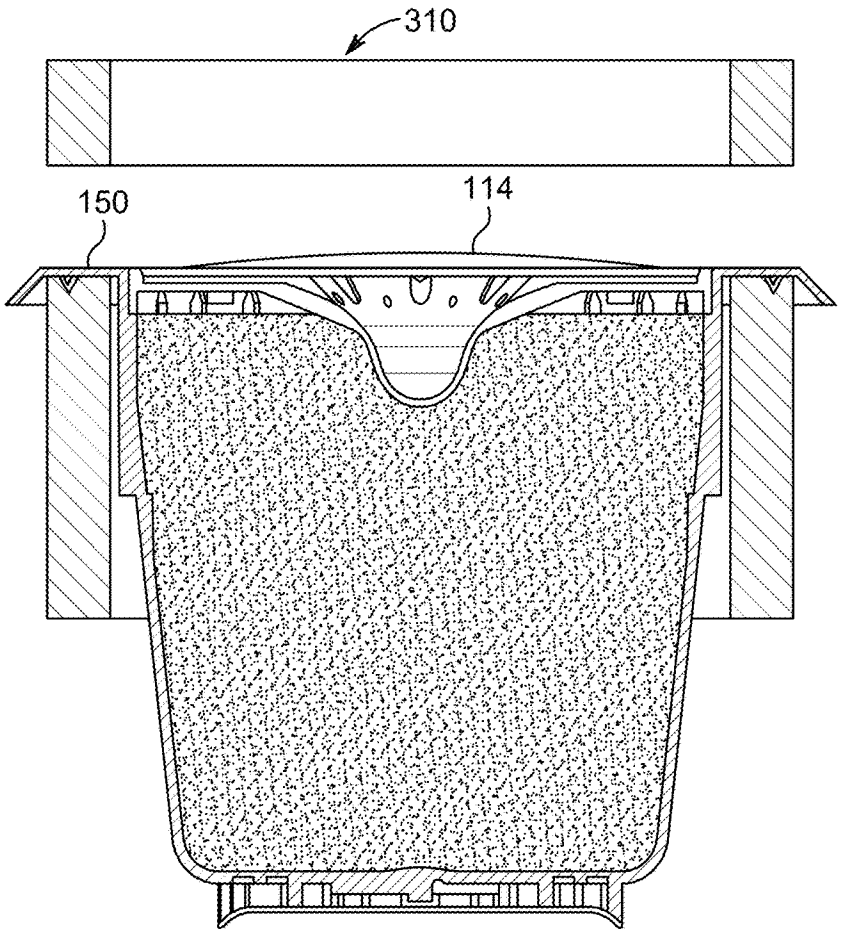
FIG. 4F shows an upper welding drum over the lid.
Figure 4E:
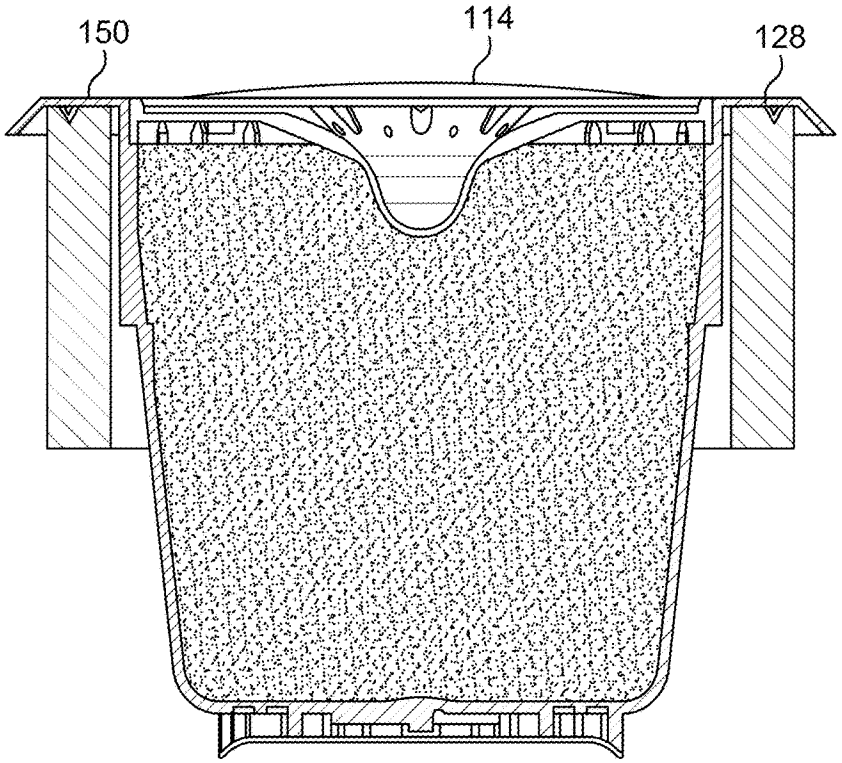
FIG. 4E shows a lid placed over the extension of the filter.
Figure 4H:
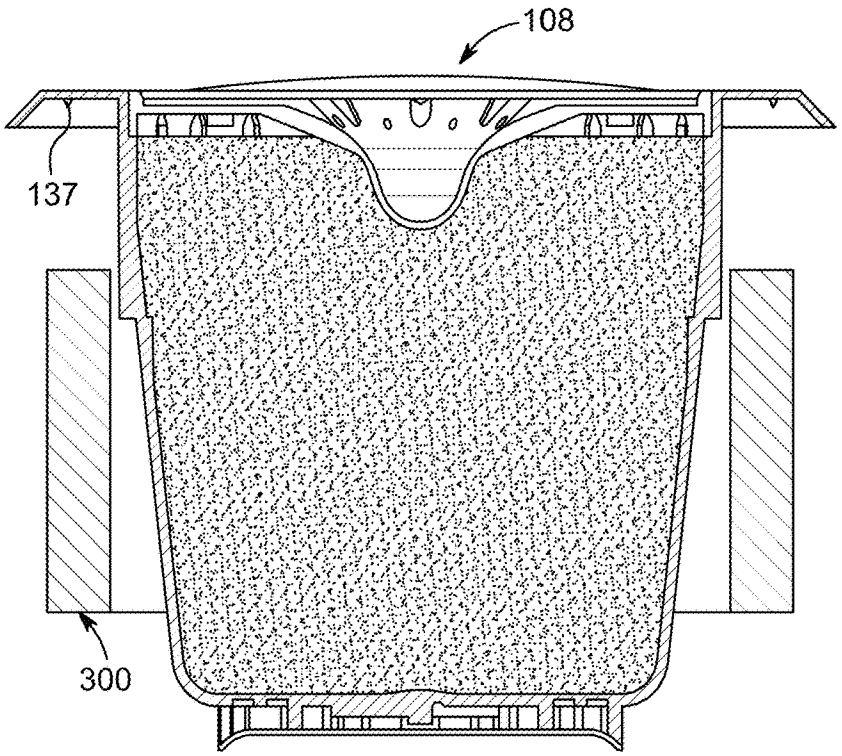
FIG. 4H shows the assembled filter removed from the lower well.
Figure 4G:
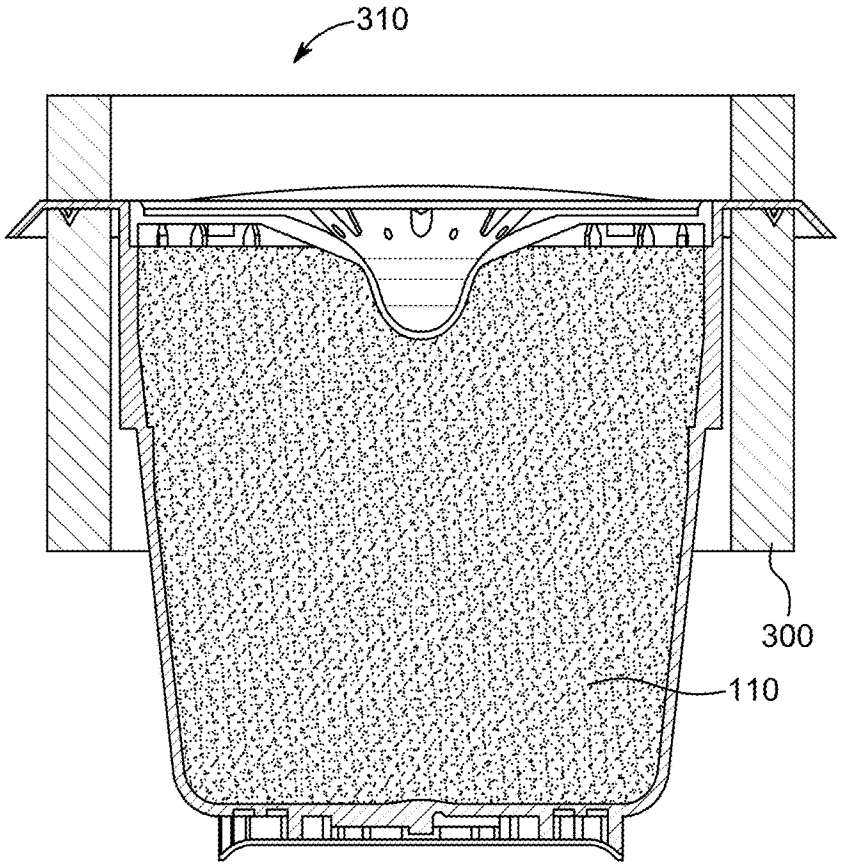
FIG. 4G shows the welding drum sealing the lid onto the extension of the filter.

FIGS. 4A through 4K illustrates by way of example a number of stages to assemble the pod 100. FIGS. 4A and 4B illustrate a first stage where a lower well 300 may be adapted to receive the filter 106 in the upright position. The lower well 300 may have an upper lip 302 defining an opening 304 adapted to receive the distal end of the filter 106, and the upper lip 302 may have a cavity 306 adapted to receive the energy director 137. FIG. 4B illustrates that once the filter 106 is fully inserted into the lower well 300, the upper lip 302 may support the first section 128 and the energy director 137 may be within the cavity 306. The cavity 306 may substantially align the filter 106 in a proper position within the lower well 300. FIG. 4C illustrates a second stage where the beverage ingredient 110 may be placed within the filter 106. FIG. 4D illustrates a third stage where the distributor 112 may be placed into the filter 106 to enclose the opening 154 such that the distributor 112 may be juxtaposed to the beverage ingredient 110. FIG. 4E illustrates a fourth stage where the outer edge 150 of the lid 114 may be placed over the first section 128. FIGS. 4F and 4G illustrate a fifth stage where the upper welding drum 310 may be utilized to seal the outer edge 150 onto to the upper first section 128 of the filter 106. Note that a variety of methods know to one skilled in the art may be utilized to seal the lid 114 to the filter 106 such as adhesive, glue, heat, and ultrasonic weld to hermetically seal the beverage ingredient 110 from atmospheric gases such as oxygen. Note that the cavity 306 may substantially protect the energy director 137 from deforming due to the lid sealing process. FIG. 4H illustrates a sixth stage where the assembled filter 108 may be removed from the lower well 300 with the energy director 137 substantially in its original form.

Figure 4J:
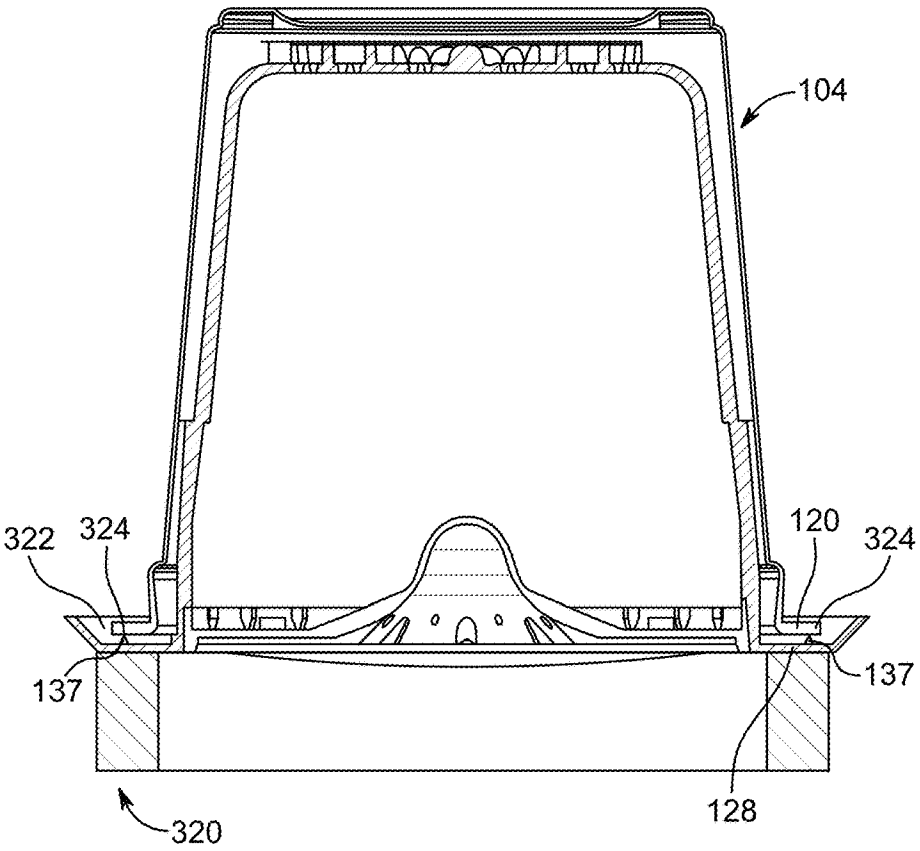
FIG. 4J shows a container placed over the filter.
Figure 4I:
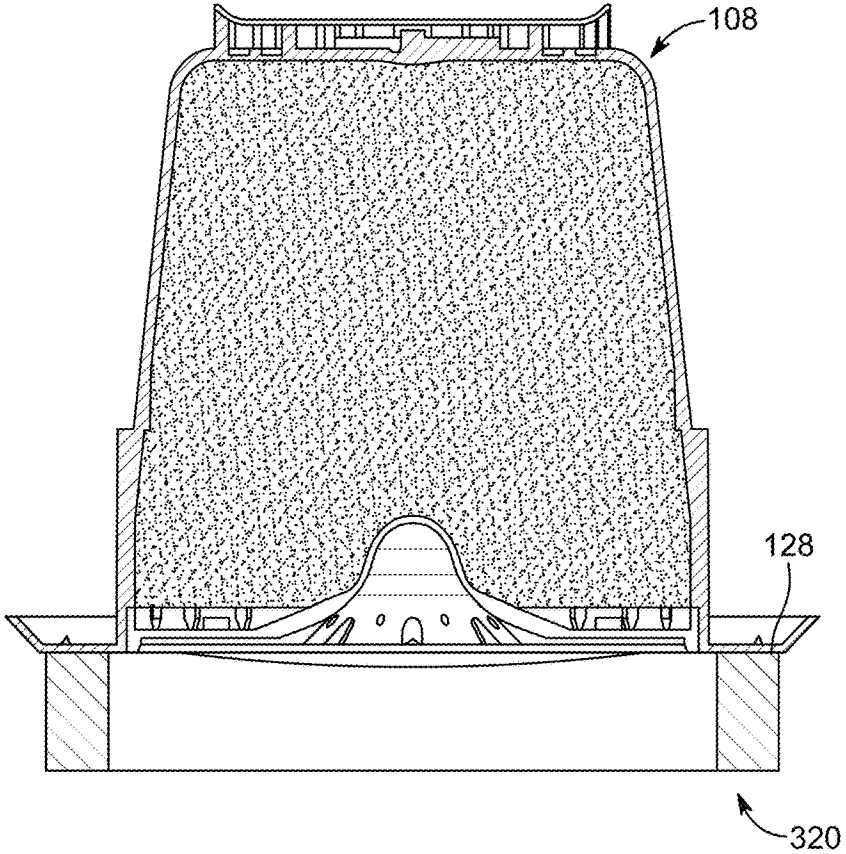
FIG. 4I shows the assembled filter in an inverted position placed over the lower well.
Figure 4L:
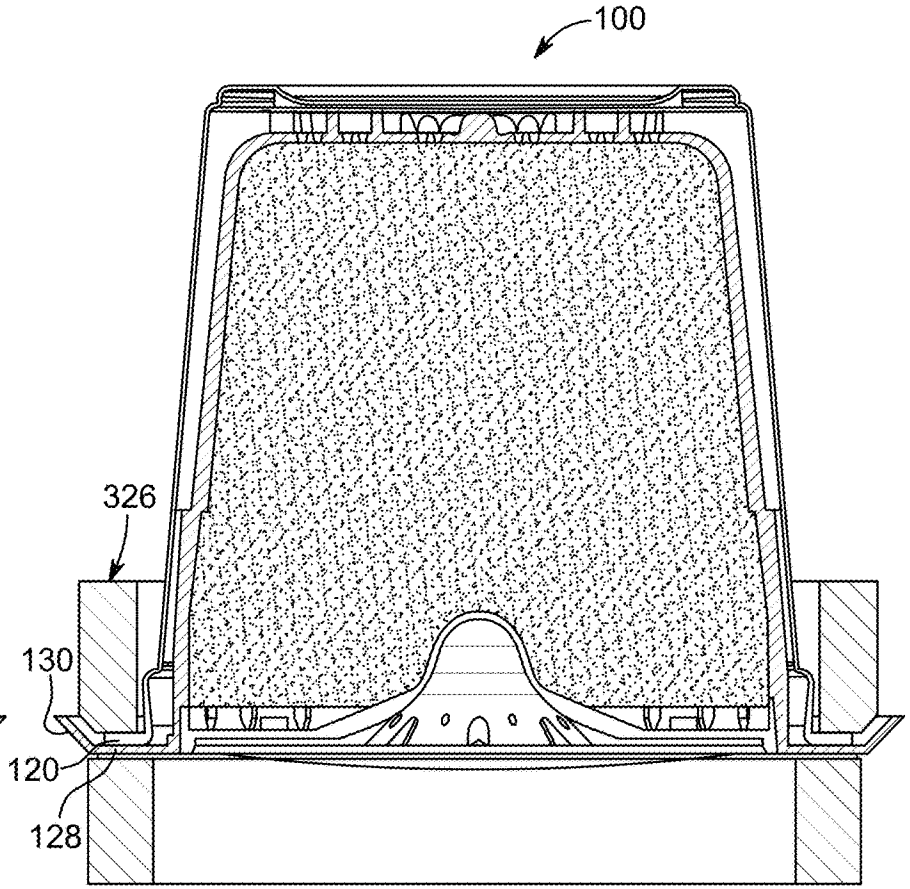
FIG. 4L shows the welding drum reliably sealing the rim to the extension of the filter.
Figure 4K:
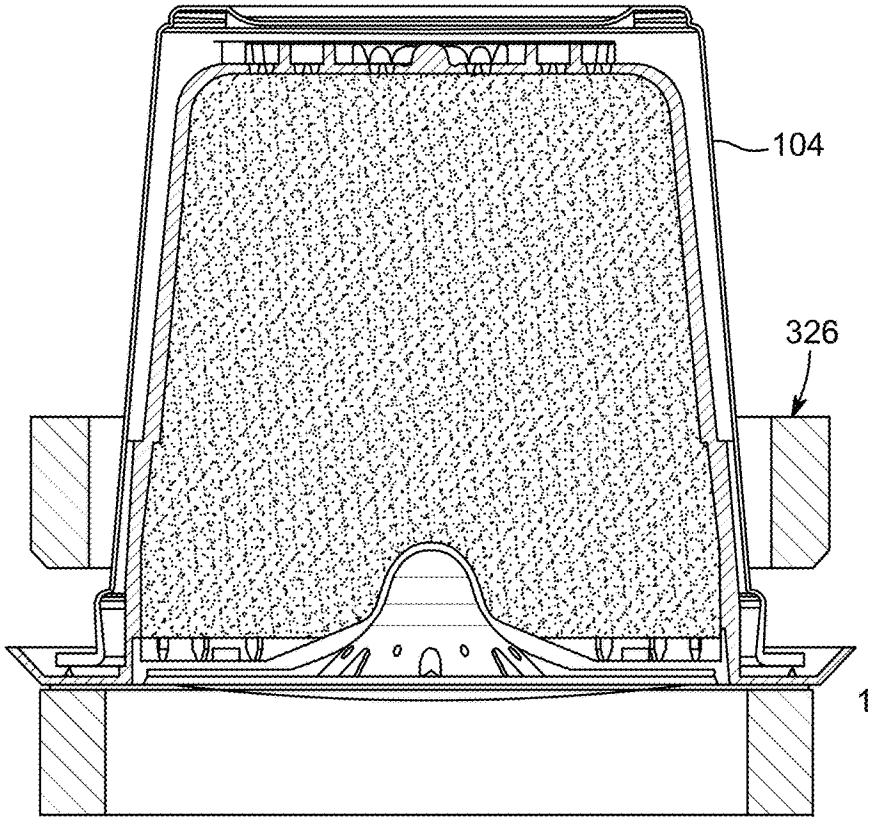
FIG. 4*k* shows a welding drum placed over the container.

FIG. 4I through 4L illustrate the process of releasably sealing the first section 128 to the rim 120. FIG. 4I illustrates a seventh stage where the assembled filter 108 may be inverted to have the extension 128 facing down and placed on a second lower well 320 to support the first section 128. FIG. 4J illustrates an eighth stage where the container 104 may be inverted and placed over the assembled filter 108 such that the rim 120 may rest upon the energy director 137 thereby forming a gap 322 between the rim 120 and the first section 128. Note that the rim 120 may have a cavity 324 adapted to receive the energy director 137, as discussed in more detail below, to align the rim 120 with respect to the energy director and to provide a more consistent seal between the rim 120 and the first section 128. FIGS. 4K and 4L illustrate a ninth stage where an ultrasonic weld such as the torsional ultrasonic welding drum 326 may be placed over the underside of the rim 120 and the vibrational energy may be directed to the energy director 137 to melt it in order to releasably join the first section 128 to the rim 120 thereby completing the assembly of the pod 100. Note that any combination of the frequency energy and the duration of the energy, as discussed above, may be applied to the energy director 137. The releasable joint may hermetically seal the first section 128 to the rim 120 around the circumference of the first section 128 yet the first section 128 may separate from rim 120 upon an application of a predetermined force underneath the second section 130. In particular, the first section 128 may separate in a substantially consistent manner around the circumference of the first section 128 to allow the pod 100 to be inserted into the brewing chamber in any orientation with respect to the lid 114.

FIGS. 4M through 4R illustrate alternative embodiments of providing an energy director 137 between the first section 128 and the rim 120. FIG. 4M shows an enlarged view of the energy director 137 protruding downwardly from the underside of the first section 128 of the filter 106 in reference to FIG. 3B discussed above. The energy director 137 may be located at about distance X from the outer circumference of the first section 128 as indicated by the reference numeral 131 such that once the filter 106 is assembled to the container 104, the energy director 137 may infuse to the rim 120 closer to the outer edge 121 than the sidewall 124 of the container 104. This may provide more leverage upon the first section 128 as force is applied to the underside of the second section 130 to allow the first section 128 to more readily separate from the rim 120. FIG. 4S illustrates that the energy director 137 may have a triangular shape with an apex angle in the bottom corner with a height H. The apex angle θ may be from about 30° to about 90°; and in particular about 50° to about 70°, and further about 60°. The height H may be from about to about 0.8 mm; and in particular about 0.5 mm. Note that the energy director 137 may have a variety of other configurations to focus the energy from the ultrasonic welding system onto to the base layer. For example, the energy director 137 may have semi-circular, circular, trapezoidal, square, rectangular, irregular, pentagon, and the like configurations. In addition, the energy director 137 may be a separate element that may be placed between the extension 128 and the rim 120 for the purpose of releasably joining the extension 128 to the rim 120.

FIG. 4N illustrates that the energy director 137 may be provided on the rim 120 located at about the midpoint between the outer edge 121 and sidewall 124 of the container. Note that it is within the scope of the invention to provide the energy director to infuse the first section 128 to the rim anywhere along the rim. FIG. 4O illustrate that a cavity 324 may be provided on either the first section 128 and/or the rim 120 where the cavity 324 is positioned to receive the energy director 137 to concentrate the infused area and/or to align the first section 128 relative to the rim 120 in a consistent manner. FIG. 4P illustrates that the upper side of the first section 128 may be stamped thereby causing a cavity 326 to form which in turn protrudes out the underside to form the energy director 137. FIG. 4Q illustrates a combination of stamping the first section 128 to form the energy director 137 and having the cavity 324 on the rim 120. FIG. 4R illustrates a combination of having the stamping on the rim 120 to form the energy director 137 and the cavity 324 in the first section 128. Accordingly, it is within the scope of the invention to utilize a variety of a combination of the energy director 137 and/or the cavity 324 as disclosed herein along with methods known to one skilled in the art.

Figure 5A:
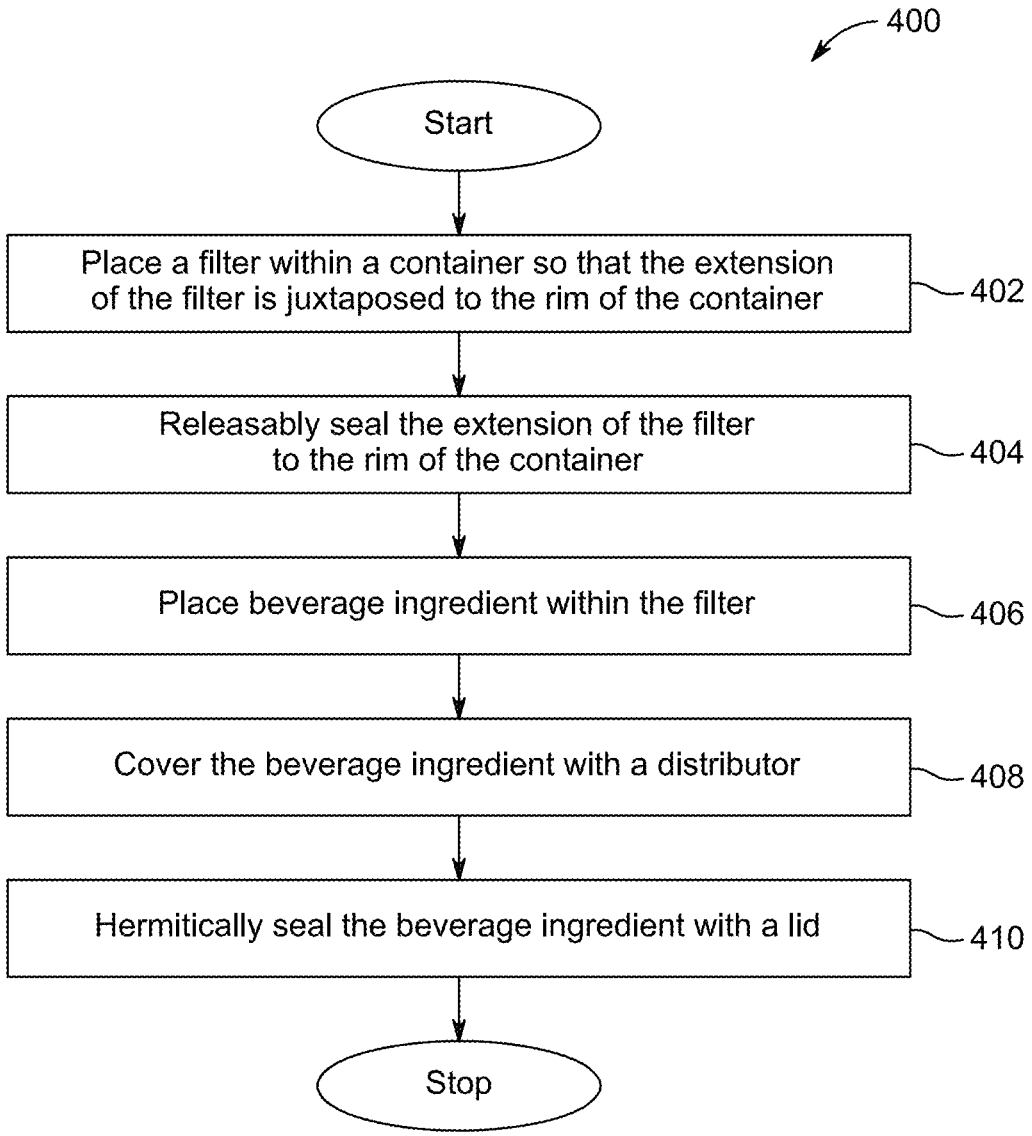
FIG. 5A shows a flow chart for releasably sealing a beverage pod.

FIG. 5A illustrates a flow chart 400 which may include one or more of the following steps to assemble the pod 100 as discussed above in reference to FIGS. 1A and 1B. In step 402, the filter 106 may be placed within the container 104 such that the extension 126 may be juxtaposed to the rim 120 of the container. This may be done with the container 104 and the filer 106 in an upright or inverted position. In step 404, the extension 126 and the rim 120 may be releasably sealed together. This may be done in a variety of methods known to one skilled in the art such as via adhesive liner, glue, heat, vertical ultrasonic welding, torsional ultrasonic welding, and etc. In step 406, the beverage ingredient 110 such as coffee ground, espresso ground, and tea leaf may be poured into the filter 106 through a variety of method known to one skilled in the art. In step 408, the distributor 112 may be optionally placed into the filter 106 to substantially enclose the opening 154 so that the distributor 112 may be juxtaposed to the beverage ingredient 110. Note that the distributor 112 may or may not be part of the assembled pod 100; and a variety of methods known to one skilled in the art may be optionally utilized to shower beverage ingredient 110 to more evenly wash and extract the beverage from the beverage ingredient 110. And in step 410, the lid 114 may be sealed to the extension 126 such as on the first section 128 and/or the second section 130. This may be done in a variety of methods known to one skilled in the art such that the seal may hermetically seal the lid 114 onto the filter 106 via adhesive liner, glue, heat, ultrasonic welding, torsional ultrasonic welding, and etc.

Figure 5B:
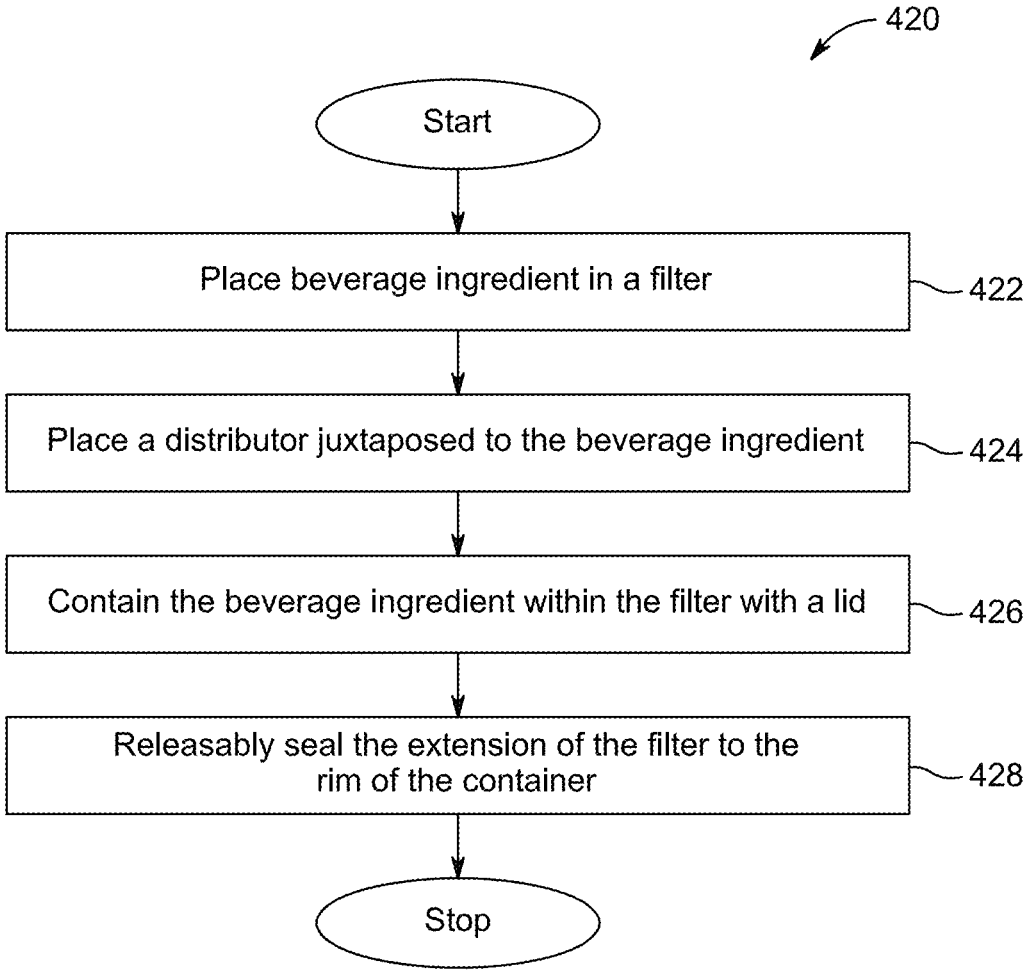
FIG. 5B shows another flow chart for releasably sealing a beverage pod.

FIG. 5B illustrates a flow chart 420 which may include one or more of the following steps to assemble the pod 100 as discussed above in reference to FIGS. 3A through 3D. In step 422, the beverage ingredient 110 such as coffee ground, espresso ground, and tea leaf may be poured into the filter 106. The filter 106 may have an energy director 137 and/or a cavity 324 underneath the first section 128 as discussed above in reference to FIG. 4M through 4R. In step 424, the distributor 112 may be optionally placed juxtaposed to the beverage ingredient 110. In step 426, the beverage ingredient 110 may be contained within the filter 106 by placing a lid 114 over the beverage ingredient 110. The lid 114 may be sealed to the extension 126 such as on the first section 128 and/or the second section 130. The lid 114 may be sealed to the extension 126 without altering and/or damaging the energy director 137. In step 428, the extension 126 and the rim 120 of the container 104 may be releasably sealed together. This may be done in a variety of methods known to one skilled in the art such as via adhesive liner, glue, heat, ultrasonic welding, torsional ultrasonic welding, and etc. With the ultrasonic methods such as with vertical ultrasonic and/or torsional ultrasonic welding, the rim 120 of the container may have an energy director 137 and/or a cavity 324, as discussed above in reference to FIG. 4M through 4R, to align the energy director 137 to the corresponding cavity 324.

Figure 5C:
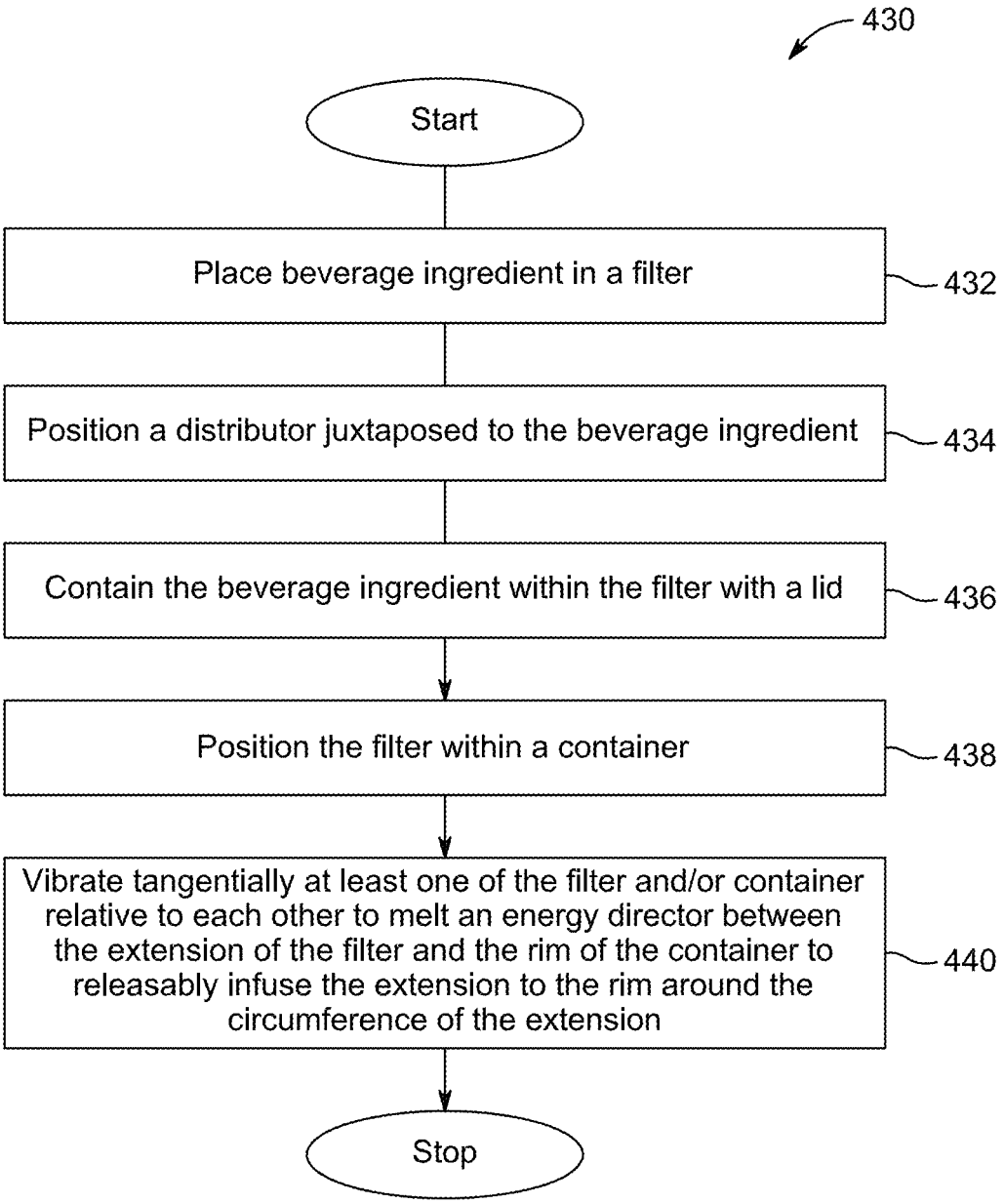
FIG. 5C shows an alternative flow chart for releasably sealing a beverage pod.

FIG. 5C illustrates a flow chart 430 which may include one or more of the following steps to assemble the pod 100 as discussed above in reference to FIGS. 3A through 3D. In step 432, the beverage ingredient 110 may be placed into the filter 106. The filter 106 may have an energy director 137 and/or a cavity 324 underneath the first section 128 as discussed above in reference to FIG. 4M through 4R. In step 434, the distributor 112 may be optionally placed juxtaposed to the beverage ingredient 110. In step 436, the beverage ingredient 110 may be contained within the filter 106 by placing a lid 114 over the beverage ingredient 110. The lid 114 may be sealed to the extension 126 such as on the first section 128 and/or the second section 130. The lid 114 may be sealed to the extension 126 without altering and/or damaging the energy director 137. In step 438, the filter 106 may be positioned within the container 104 by either inserting the filter 106 into the container 104 or by placing the container over the filter 106. In step 440, the torsional ultrasonic welding method may be utilized to releasably seal the extension 126 to the rim 120. This may be accomplished by vibrating tangentially at least one of the filter 106 and/or container 104 relative to each other to melt an energy director 137 between the extension 128 and the rim 120 to releasably infuse the extension 128 to the rim 120 without damaging extension 128 and the rim 120 around the circumference of the extension. Note that the rim 120 of the container may have an energy director 137 and/or a cavity 324, as discussed above in reference to FIG. 4M through 4R, to align the energy director 137 to the corresponding cavity 324.

Figure 5D:
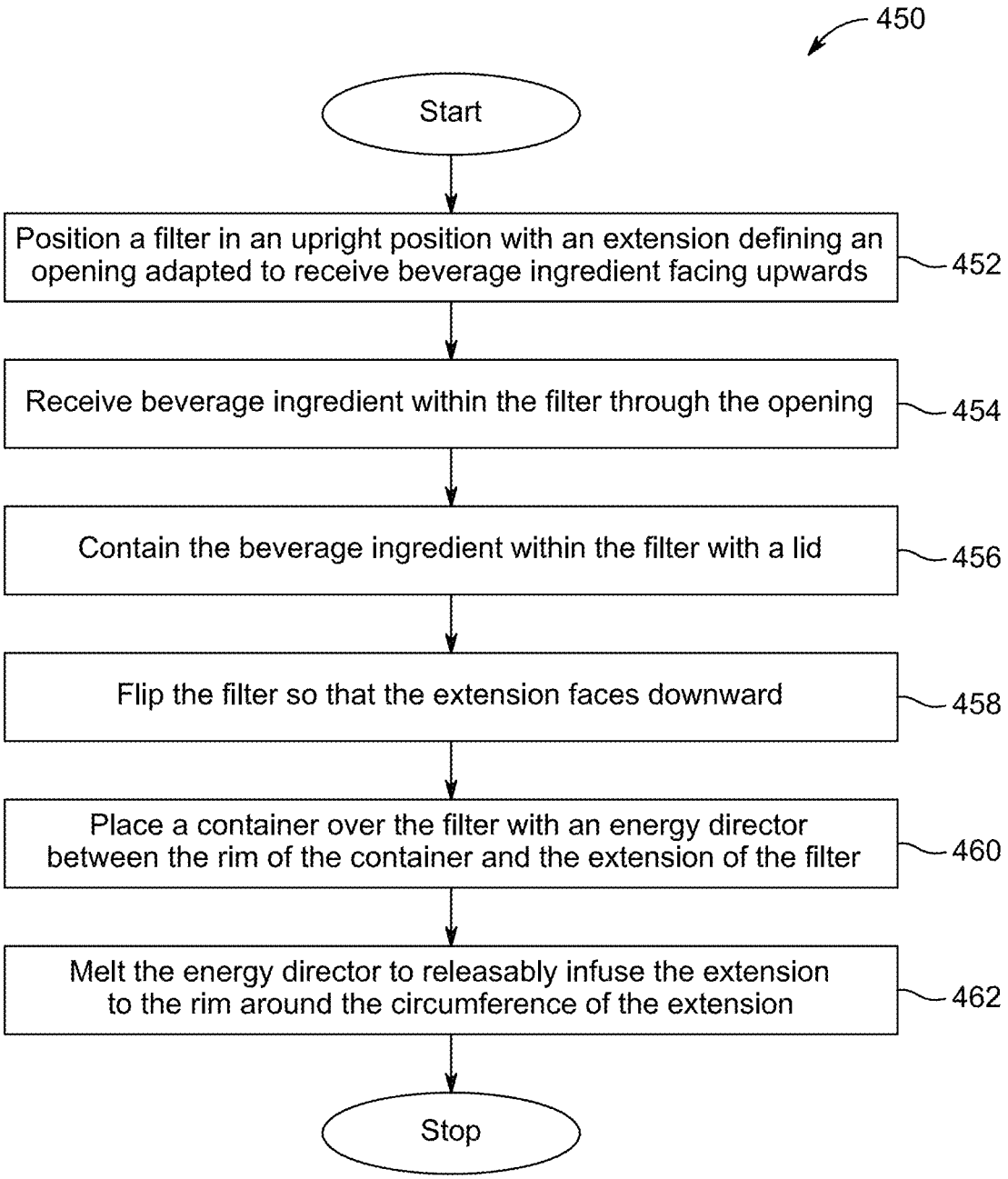
FIG. 5D shows still another flow chart for releasably sealing a beverage pod.

FIG. 5D illustrates a flow chart 450 which may include one or more of the following steps to assemble the pod 100 as discussed above in reference to FIGS. 4A through 4L. In step 452, the filter 106 may be positioned in an upright position with the extension 128 defining an opening 154 adapted to receive the beverage ingredient 110. In step 456, the beverage ingredient 110 may be placed into the filter 106. The filter 106 may have an energy director 137 and/or a cavity 324 underneath the first section 128 as discussed above in reference to FIG. 4M through 4R. In step 456, the distributor 112 may be optionally placed juxtaposed to the beverage ingredient 110 to substantially contain beverage ingredient 110 within the filter 106. The lid 114 may be sealed to the extension 126 such as on the first section 128 and/or the second section 130. The lid 114 may be sealed to the extension 126 without altering and/or damaging the energy director 137. In step 458, the assembled filter 108 may be inverted or flipped so that the extension faces downward. In step 460, the filter 106 may be positioned within the container 104 by either inserting the filter 106 into the container 104 or by placing the container over the filter 106 such that the energy director 137 may be between the rim 120 and the extension 128. Note that it is within the scope of the invention to provide the energy director 137 as a separate element such as a ring placed onto the rim 120 or the first section 120 where the ring may be located between the rim 120 and the first section 128 prior to the torsional ultrasonic welding step. In step 462, the energy director 127 may be melted to releasably infuse the extension 128 onto the rim 120. This may be accomplished by vibrating tangentially at least one of the filter 106 and/or container 104 relative to each other to melt an energy director 137 between the extension 128 and the rim 120 to releasably infuse the extension 128 to the rim 120 without damaging extension 128 and the rim 120 around the circumference of the extension. For example, the energy director 127 may be melted via the torsional ultrasonic welding method to releasably seal the extension 126 to the rim 120. Note that the rim 120 of the container may have an energy director 137 and/or a cavity 324, as discussed above in reference to FIG. 4M through 4R, to align the energy director 137 to the corresponding cavity 324.

Figure 6C:
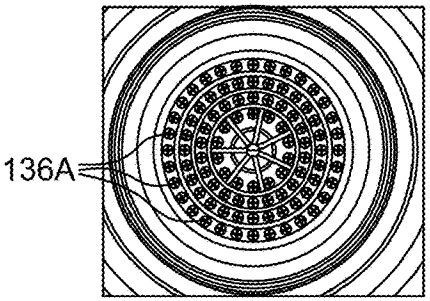
FIG. 6C shows holes in the base of the filter.
Figure 6B:
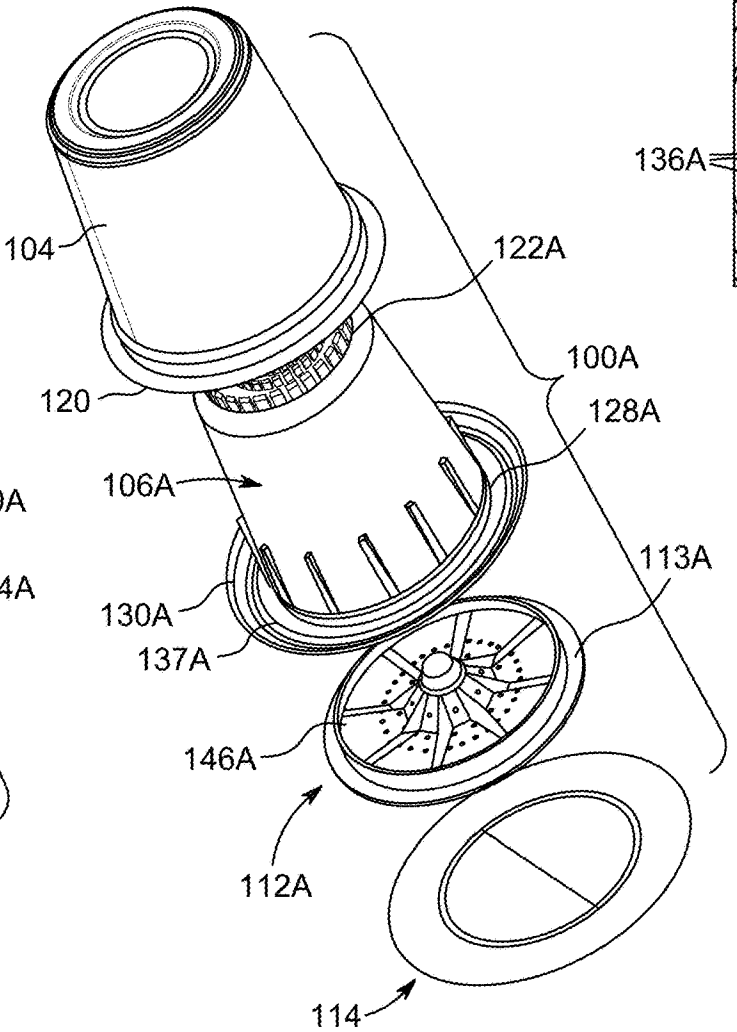
Figure 6A:
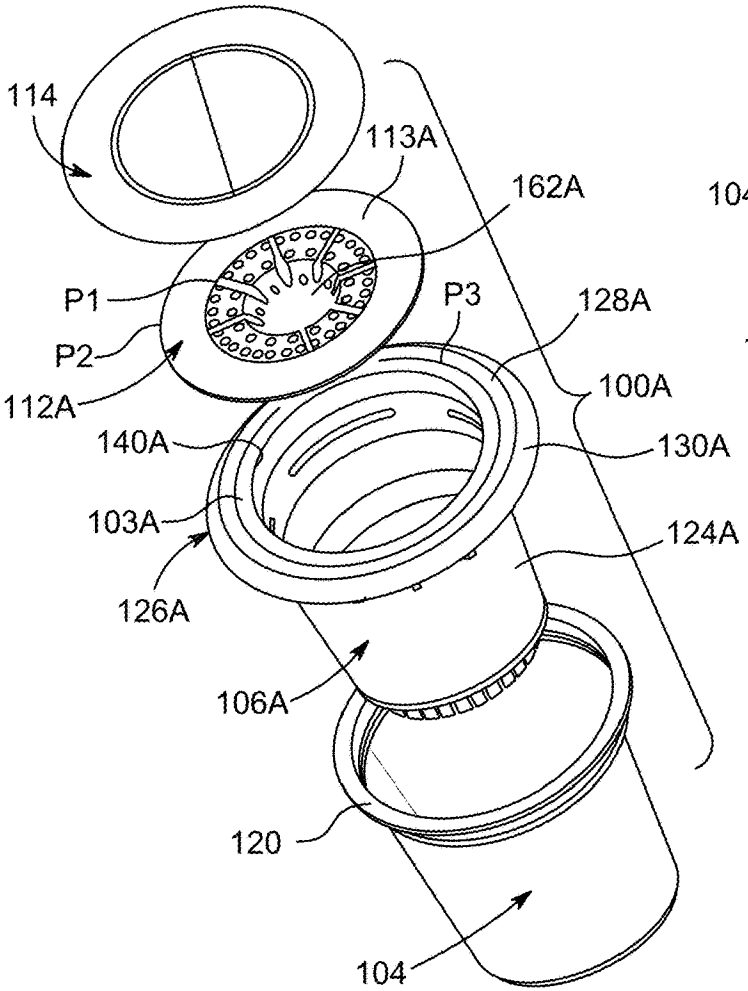
FIG. 6A shows an expanded perspective view of a first type of pod with a low-pressure filter along its longitudinal axis.

FIG. 6A shows an expanded perspective view of an alternative pod 100A along its longitudinal axis configured to brew low-pressure beverages such as coffee; and FIG. 6B shows an inverted expanded perspective view of the pod 100A to show the top and bottom views, respectively, of the various components of the pod 100A. The pod 100A may include a container 104 with a rim 120, a first filter 106A adapted to receive beverage ingredient (not shown), a distributor 112A, and a lid 114. The pod 100A may be similar to the pod 100 disclosed above in reference to FIGS. 1A and 1B with the following differences in the first filter 106A and the distributor 112A. The first filter 106A may have an extension 126A which may have a first extension 128A and a second extension 130A. The first extension 128A may have a step 103A formed in the inner side of the first extension 128A. The distributor 112A may have a flange 113A that extends outwardly to rest within the step 103A of the filter 106A. The flange 113A may have an enlarged surface area defined by an inner perimeter P1 and an outer perimeter P2, where the P1 and P2 may be round for example. The inner perimeter P1 may define a cavity 162A adapted to receive an inlet piercing member 200 adapted to inject heated water therein. The step 103A may have a recess with a perimeter P3 sized to receive a portion of the flange 113A as defined by the outer perimeter P2 such that the top surfaces of the flange 113A and the first extension 128A may be substantially flush.

FIG. 6B shows the first filter 106A having an energy director 137A protruding from the underside of the first section 128A to absorb the energy from the torsional ultrasonic welding method to melt and infuse with the rim 120 as discussed above in reference to FIGS. 4J through 4L. The distributor 112A may have a skirt 146A adapted to engage with the inner side 140A of the sidewall 124A juxtaposed to the first extension 128A such that a portion of the flange 113A that extends out from the skirt 146A may rest within the step 103A and flush with the first section 128A of the extension 126A. FIG. 6C shows a plurality of holes 136A in the base 122A of the filter 106A where the size and number of the holes 136A may be predetermined to control the flow of the beverage through the holes 136A to provide a desired low-pressure within the filter 106A to brew coffee for example.

Figure 7C:
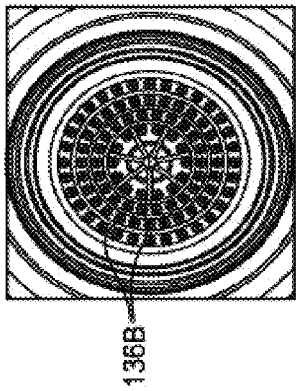
FIG. 7C shows holes in the base of the filter.
Figure 7B:
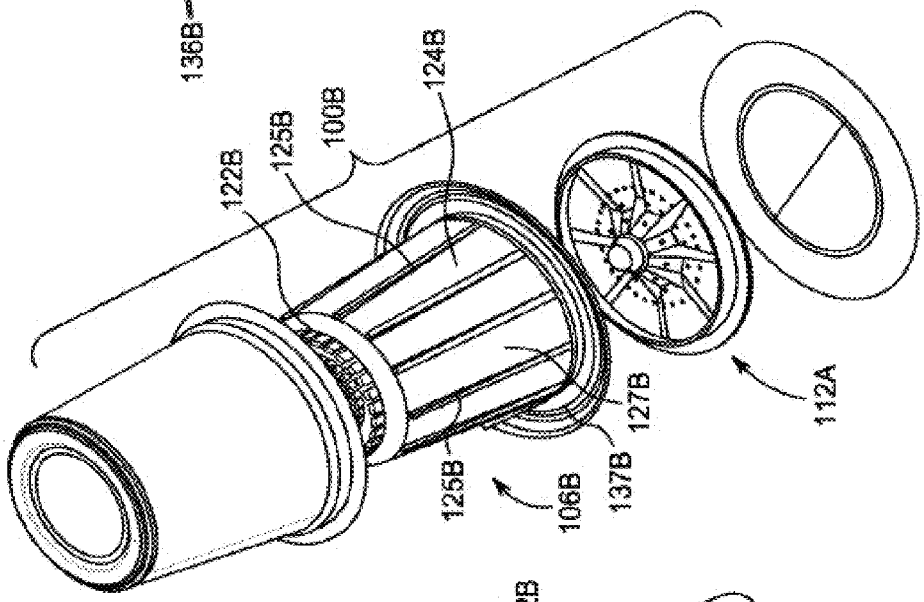
Figure 7A:
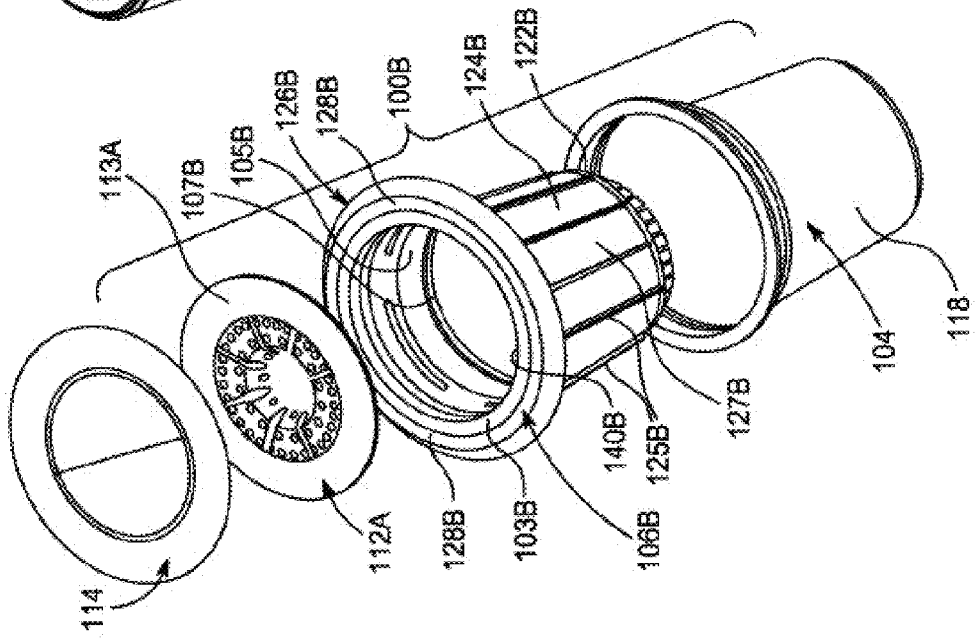
FIG. 7A shows an expanded perspective view of a second type of pod with a high-pressure filter along its longitudinal axis.

FIG. 7A shows an expanded perspective view of an alternative pod 100B along its longitudinal axis configured to brew high-pressure beverages such as espresso; and FIG. 7B shows an inverted expanded perspective view of the pod 100B to show the top and bottom views, respectively, of the various components of the pod 100B. The pod 100B may include a container 104, a second filter 106B adapted to receive beverage ingredient (not shown), a distributor 112A, and a lid 114. The pod 100B may be similar to the pod 100A disclosed above in reference to FIGS. 6A through 6C except that the filter 106B may have ribs 125B formed on the exterior side 127B of the sidewall 124B, and the ribs 125B may extend from the extension 126B to the base 122B or some portion thereof. The ribs 125B may provide structural support to the sidewall 124B of the filter 106B to substantially prevent the sidewall 124B from expanding, and maintaining a pathway 168 open between the sidewalls 124B and 118 during a high-pressure brewing process. The filter 106B may have a step 103B in the first extension 128B adapted to receive the same distributor 112A in a manner discussed above in reference to FIG. 6A. The inner side 105B of the filter 106B may also have a step 107B adapted to engage with a barrier, as discussed in more detail below. FIG. 7C shows a plurality of holes 136B in the base 122B of the filter 106B where the size and number of the holes 136B may be predetermined to control the flow of the beverage through the holes 136B to provide a desired high-pressure within the filter 106B to brew espresso for example. In this regard, the size of the holes 136B for the high-pressure brewing applications may be smaller than the holes 136A for the low-pressure brewing applications; and the number of holes 136B provided in the base 122B may be fewer than the holes 136A provided in the base 122A.

Figure 8:
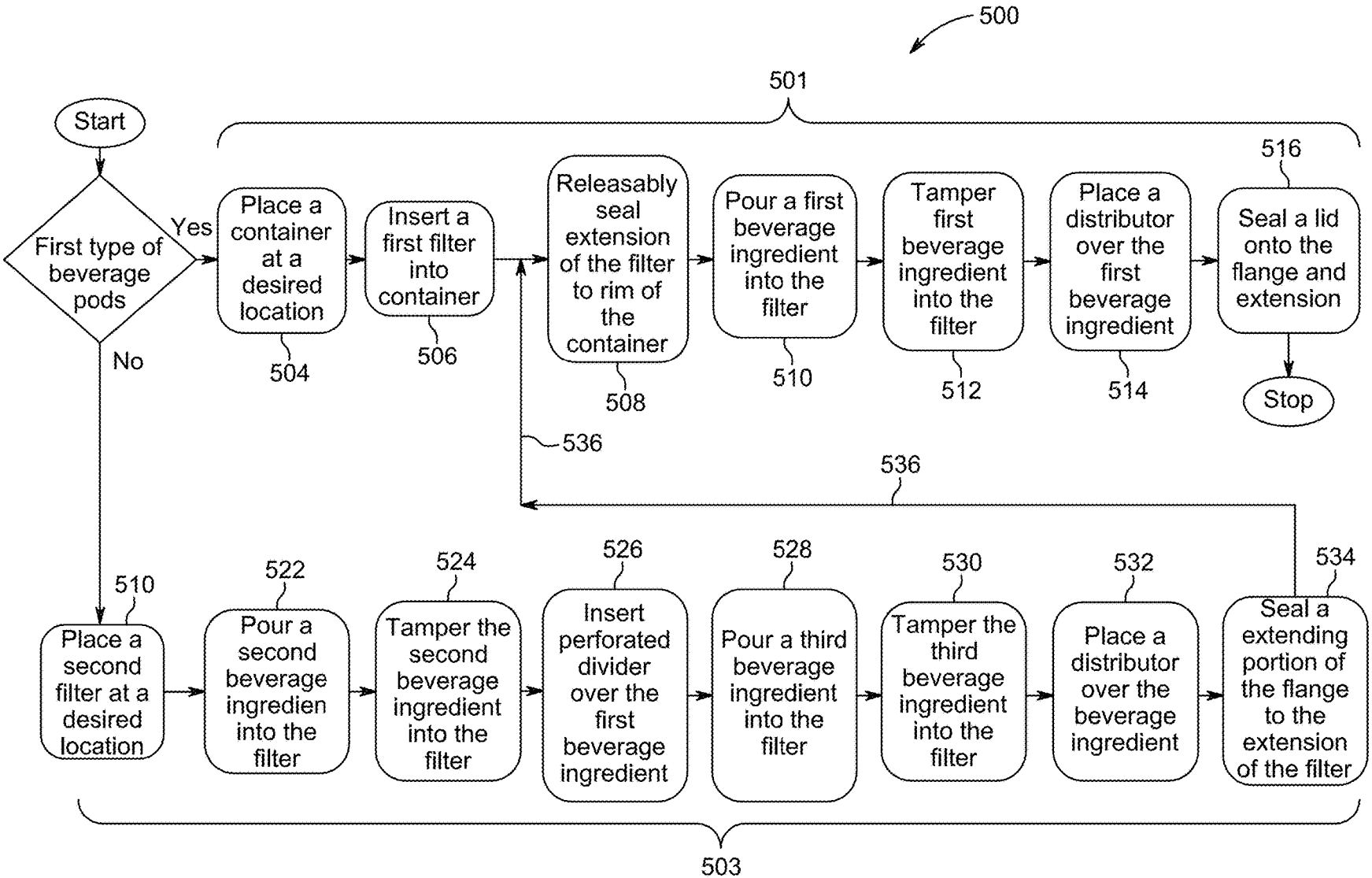
FIG. 8 shows a flow chart to pack a variety of different types of pods such as first and second types of pods.

FIG. 8 shows a flow chart 500 for packing a variety of different types of pods such as a first type of pods and a second type of pods. In this example, first type of pods may be generally descried as low-pressure pods such as the pod 100A, discussed above in reference to FIGS. 6A-6C, adapted to brew coffee; and a second type of pods may be generally described as high-pressure pods such as the pod 100B adapted to brew espresso and/or pods adapted to pack more than one type of beverage ingredients such coffee and cream. The flow chart 500 may include a first assembly process 501 for packing first type of pods and a second assembly process 503 for packing second type of pods. The flow chart 500 may begin in the decision block 502 to determine if a first or second type of beverage pods are being assembled. If the first type of pods are being assembled, then in reference to FIG. 6A, in step 504, a container 104 may be placed in a desired location. In step 506, a first filter 106A may be placed into the container 104 such that the energy director 137A underneath the extension 128A may rest upon the rim 120. In step 508, the extension 128A may be releasably sealed to the rim 120 such as via a torsional welding method as discussed above in reference to FIGS. 4I through 4J. Note that the torsional welding method may be accomplished with the container in a variety of orientations such as upright, inverted position, or in an angular position. In step 510, a desired amount of the first beverage ingredient (not shown) may be poured into the filter. The first beverage ingredient may be coffee ground where the average grind size may be from about 450 to about 1,000 microns; and in particular from 500 to about 700 microns to allow coffee to be brewed under 5 bars of pressure within the first filter 106A. Note that some water-soluble beverage ingredient may have an average ground size that is less than 450 microns or above 1,000 microns depending on the application. For example, the amount of beverage ingredient poured into the filter may be from 10 to 18 grams of coffee ground depending on the application. In step 512, the first beverage ingredient may be tampered into the filter to minimize air pockets with the first beverage ingredient. In step 514, a distributor 112A may be placed above the first beverage ingredient such that the outwardly extending portion of the flange 113A may rest upon the step 103A. And in step 516, a lid 114 may be sealed to the flange 113A of the distributor 112A and first extension 128A of the filter 106A. Sealing the lid 114 around the flange 113A between the perimeters P1 and P2 may substantially prevent the beverage from passing through the gap between skirt 146A and the inner sidewall of the filter, and the lid 114 and the flange 113A, and entering the cavity 162A during the brewing process. That is, as the inlet piercing member 200 injects heated water during the brewing process, the pressure within the cavity 162A may be greater than in the chamber within the filter packing the beverage ingredient such that the heated water may substantially flow from the cavity 162A and towards the beverage ingredient rather than towards the cavity 162A; and the pressure within the filter 106A may cause the beverage to flow through the gap between the skirt 146A and the inner sidewall 140A of the filter 106A, however, with the lid 114 sealed to the flange 113A, the beverage may be substantially prevented from entering the cavity 162A via the gap between the skirt 146A and the sidewall 140A, thereby substantially isolating the inlet piercing member 200 from being contaminated by the beverage formed within the filter 106A. Moreover, with the flange 113A sealed to the lid 114, the flange 113A may support the lid 114 to resist the pressure within the filter 106A. That is, with the lid 114 sealed to the flange 113A and the extension 128A, these elements 114, 113A, and 128A may act as a unitary members to substantially resist the pressure within the filter 106A such that the beverage may flow along the pathway 168 as discussed above in reference to FIGS. 2A through 2D. Note that a number of steps discussed above in reference to the first assembly process 501 may be optional such as steps 512 and 514.

In the decision block 502, if a second type of pods are being assembled rather the first type of pods, the flow chart 500 may proceed to the second assembly process 503. Note that the second type of pods may be generally described as high-pressure pods such as pods adapted to brew espresso, or pods adapted to pack more than one type of beverage ingredients such as coffee and cream, or filters filled partially with the beverage ingredient, or pods that may be different than the first types of pods, as discussed in more detail below. The second assembly process 503 may begin in step 520, where a second filter 106B may be placed in a desired location. Note that it is within the scope of the invention to utilize low-pressure filter 106A or a high-pressure filter 106B depending on the application. In step 522, a second beverage ingredient may be poured into the second filter 106B. The second beverage ingredient may be low-pressure or high-pressure ground such as coffee or espresso ground, respectively. The amount of beverage ingredient poured into the second filter may vary from 10 to 18 grams of coffee, espresso, tea, or other ingredient depending on the application. In step 524, the second beverage ingredient may be tampered to minimize air pockets therein. In step 526, if the second filter is partially filled with the second beverage ingredient, then a perforated barrier may be sealed over the second beverage ingredient to retain the second beverage ingredient within the second filter to minimize air pockets being formed within the second filter. For example, for a single shot of espresso, about 8 to 12 grams of espresso ground may be poured into the second filter, which may partially fill the second filter. In order to avoid air pocks from being formed when the second type of pod is orientated in a substantially horizontal position during the brewing process, the perforated film or barrier may be placed over the second beverage ingredient and sealed to the inner wall of the second filter. Alternatively, if two different beverage ingredients are packed within the second filter, then a perforated barrier may be utilized to substantially isolate the two ingredients to minimize the flavor and aroma of the two ingredients from cross-contaminating each other which may alter the taste and aroma profile of the beverage over time. Note that the perforated barrier may be formed from a film with a plurality of holes sized to allow the dissolved beverage to pass therethrough while substantially isolating the two beverage ingredients. Also, in some applications where the beverage ingredient expands after coming into contact with liquid, such as ground tea, the perforated barrier may not be needed.

In step 528, a third beverage ingredient or a different beverage ingredient from the second beverage ingredient may be poured into the second filter, if desired. For instance, a water-soluble creamer or sweetener may be poured into the second filter and isolated from the coffee ground by the perforated barrier. In step 530, the third beverage ingredient may be tampered into the second filter, if desired. In step 532, a distributor 112A may be placed into the second filter such that the outwardly extending portion of the flange 113A may rest upon the step 103A. In step 534, the outwardly extending portion of the flange 113A may be sealed to the step 103A of the second filter 106B. In particular, the flange 113A may be sealed or infused to the step 103A without altering or damaging the energy director 137B as discussed in more detail below. A variety of methods known to one skilled in the art may be utilized to seal the distributor 112A to the second filter. For instance, an ultrasonic weld may be used to infuse the extending portion of the flange 113A to the step 103A of the second filter. Still further, adhesive may be used to adhere the extending portion of the flange 113A to the step 103A.

Once the second assembly process 503 has assembled the second filter 106B in step 534 by packing a second and/or third beverage ingredient(s) within the second filter 106B with the distributor 112A sealed to the filter 106B in a manner discussed above, in step 536, the assembled second filter 106B may be passed on to the first assembly process 501 between the steps 506 and 508. For the purpose of assembling the second type of pods, not all of the steps in first assembly process 501 may be activated. For example, steps 504, 508, and 516 may be activated, and the steps 506, 510, 512, and 514 may be inactive. For instance, in step 504, a container 104 may be placed in a desired location. The step 506 may be inactive and replaced by the step 536 to insert the assembled second filter 106B into the container 104 such that the energy director 137B underneath the extension 128B may rest upon the rim 120 of the container 104. In step 508, the extension 128B may be releasably sealed to the rim 120 such as via a torsional welding method as discussed above. The steps 508, 510, 512, and 514 may be inactive since these steps may have been performed by the corresponding steps 522, 524, and 532 during the second assembly process 503. In step 516, a lid 114 may be sealed to the flange 113A of the distributor 112A and the first extension 128A of the filter 106A in a manner discussed above to complete the second assembly process of the pod 100B to hermetically seal the beverage ingredient(s) therein. During the brewing process of the pod 100B with the flange 113A sealed or infused to the step 103B, the extracted beverage under high-pressure within the filter 106B may be substantially prevented from passing through the gap between the flange 113A and the step 103B thereby substantially preventing the lid 114 from breaking open or peeling away from the flange 113A and the extension 128B. That is, with the lid 114 sealed to the flange 113A and the extension 128B, the extracted beverage under pressure may be substantially prevented from separating the elements 114, 113A, and 128B such that they may act as unitary members to substantially resist the high-pressure within the filter 106B to allow the beverage to flow along the pathway 168 as discussed above in reference to FIGS. 2A through 2D. Note for the first type of pod 100A which may be brewed under low-pressure conditions, the flange 113A may or may not be sealed or infused to the step 103B depending on the application since the lid 114 sealed to the flange 113A and the extension 128B may be able to withstand the beverage flowing under low-pressure through the gap between the flange 113A and the step 103B.

Figure 9A:
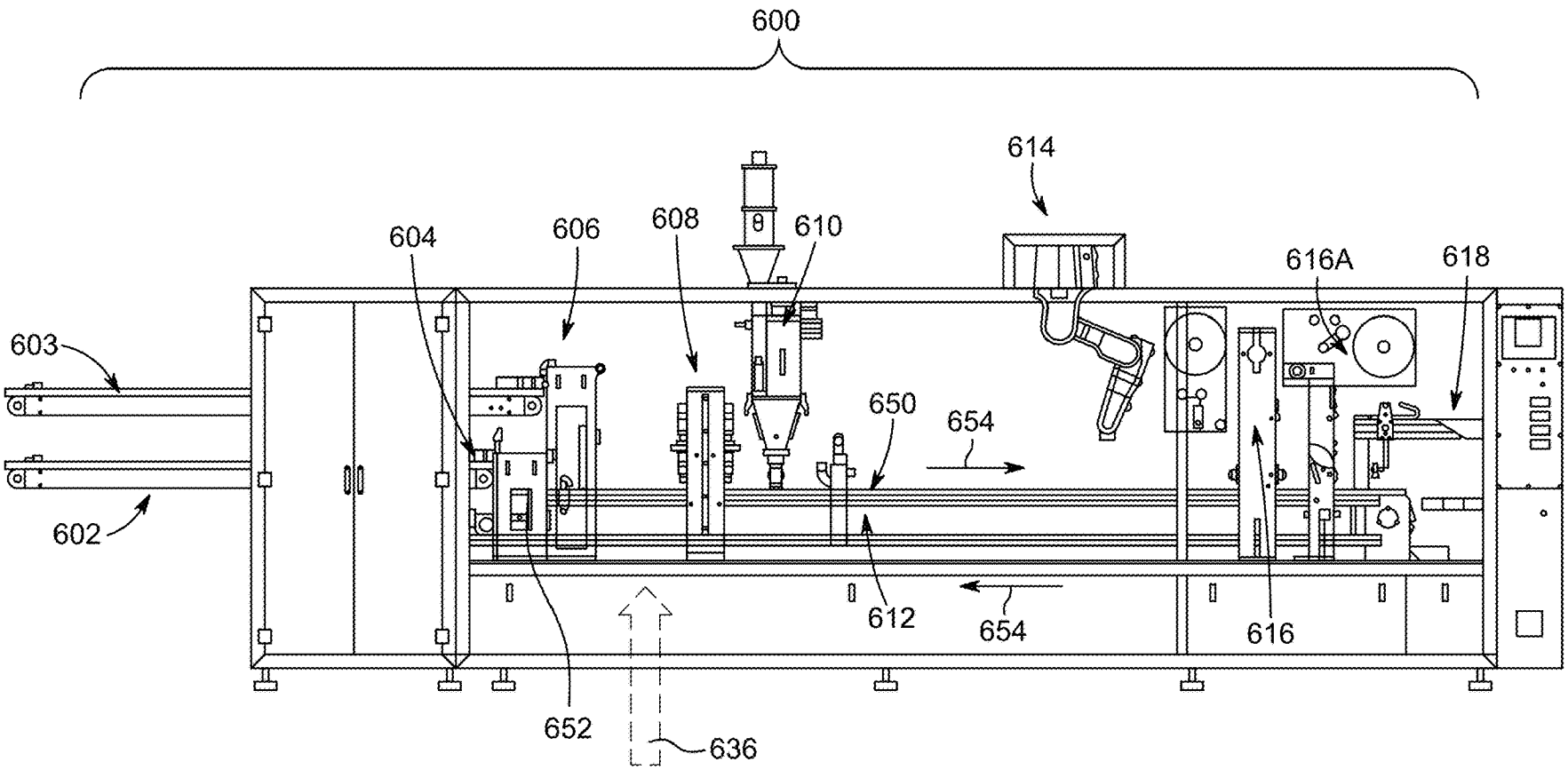
FIG. 9A illustrates a first assembly apparatus configured to assemble pods such as the first type of pods.

FIG. 9A illustrates a first assembly apparatus 600 configured to assemble the first type of pods 100A in a manner discussed above in reference to the first assembly process 501. The first assembly apparatus 600 may include a first tray 602 and a second tray 603 adapted to receive a plurality of containers 104 and filters 106A, respectively, where the container and filters may be orientated in a substantially horizontal manner on their respective trays. The first apparatus 600 may have a conveyor belt 650 with a plurality of drums 652 arranged in one or more lanes, such as four lanes in this example, that move in a clockwise direction as indicated by the direction arrows 654. Each drum 652 may have an opening slot adapted to receive a container 104. In reference to the step 504, a first picker 604 may remove the containers 104 from the first tray 602 one at a time and place the container 104 into the corresponding slot, as discussed in more detail below, as the drums 650 move from left to right, in this example. Note that the container 104 may be placed into the slot in an upright orientation such that the rim 120 may face upwards. Alternatively, the container 104 may be placed into the slot in an inverted position such that the rim 120 may face downwards. In this application, the container 104 may be orientated in the upwards position. In reference to the step 506, a second picker 606 may remove the filter 106A from the second tray 603 one at a time and place the filter 106A into the container 104 as the drum 652 moves the container 104 in the clockwise direction to be juxtaposed to the second picker 606. With the container in the upward orientation, the energy director 137A underneath the extension 128A of the filter 106A may rest upon the rim 120 of the container 104. In reference to step 508, a sealing mechanism 608 such as a torsional ultrasonic welding machine may peelably weld the energy director 137A to the rim 120 of the container 104. For instance, the weld may need to be sufficiently strong enough to resist the internal pressure within the pod 100A that may develop as the beverage ingredient in small particles packed into the pod 100A may release gases, such as $CO_2$, for several days after the pod 100A has been packed. Moreover, the internal pressure within the pod 100A may further rise during summer months as the temperature surrounding the pod 100A increases. Conversely, the strength of the weld may not be too strong such that the brewing mechanism may not be able to separate the first extension 128A from the rim 120 in a consistent manner by the detaching member 210 as discussed above in reference to FIGS. 2A through 2B. Moreover, the force needed to separate the first extension 128A from the rim 120 may be substantially consistent or within a certain tolerance around the rim 120 so that the first extension 128A may separate from the rim 120 irrespective of the orientation of the rim 120 in which the pod 100A may be inserted into the brewing chamber. In this regard, the strength of the infusion between the extension and the rim may be in Newton force, or the force required to separate the first extension 128A from the rim 120 may be measured in Newton force such as from about 5N to about 45N; and, from about 10N to about 35N; and, in particular, from about 15N to about 30N. That is, the filter 106A may be peelably sealed to the container 104 around the circumference of the rim 120 such that the first extension 128A may separate from the rim 120 by the application of a predetermined N-force, as generally defined above, irrespective of the location around the rim 120 in which the force may be applied to the second extension 130A by the detaching member 210.

In reference to step 510, a filler 610 may pour a predetermined amount of the first beverage ingredient into the filter 106A. In reference to step 512, a tamper 612 may press the first beverage ingredient into the filter to minimize air pockets with the first beverage ingredient. In reference to step 514, a third picker 614 such as a robotic arm may place a distributor 112A above the first beverage ingredient such that the outwardly extending portion of the flange 113A may rest upon the step 103A. In reference to step 516, a sealer 616 may cut a round lid 114 and seal the lid 114 to the flange 113A of the distributor 112A and first extension 128A of the filter 106A. The first assembly apparatus 600 may also include a second sealer 616A to ensure that the lid 114 is properly sealed to the filter 106A. The assembled pod 100A may then be place onto a conveyer belt 618 to dispense the assembled pod 100A from the first assembly apparatus 600.

Figure 9B:
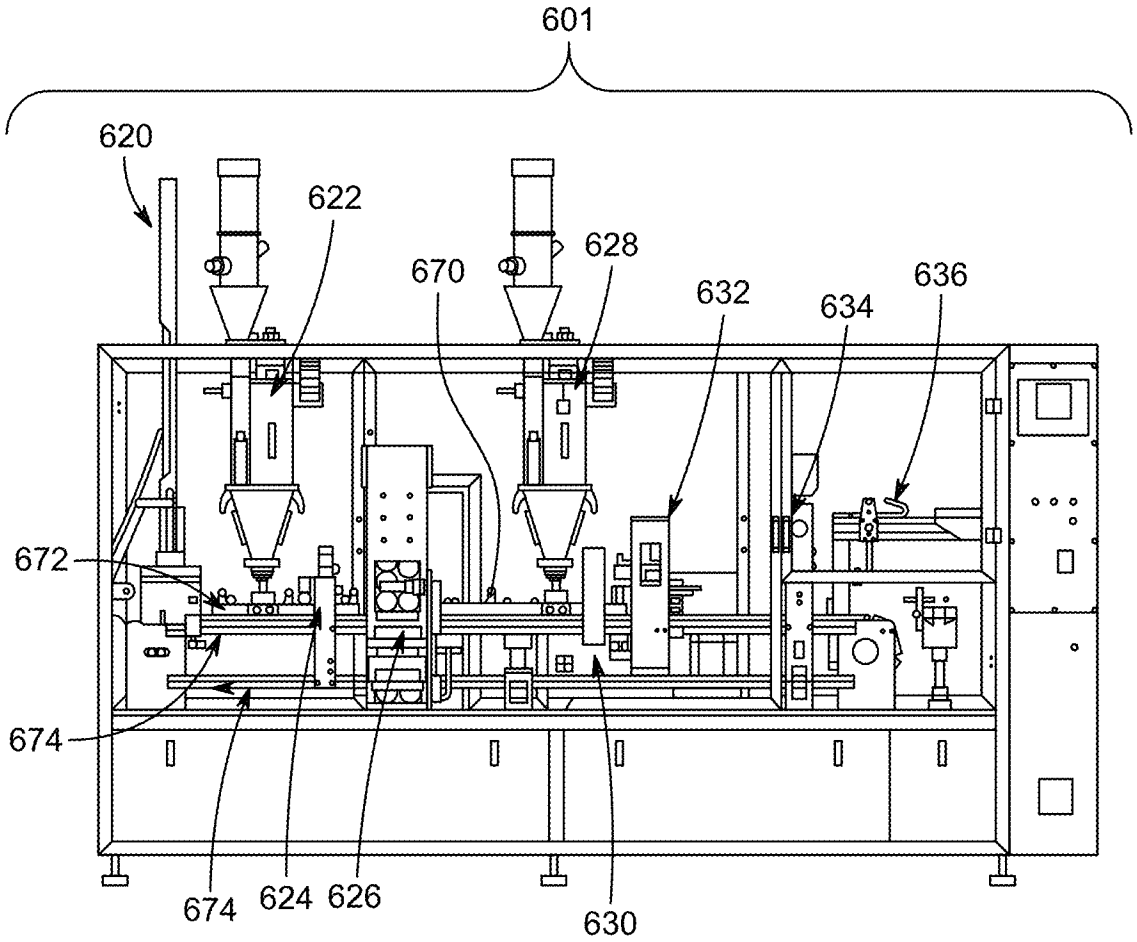
FIG. 9B illustrates a second assembly apparatus configured to assemble pods such as the second type pods.

FIG. 9B illustrates a second assembly apparatus 601 configured to assemble the high-pressure or second type of pods 100B in a manner discussed above in reference to the second assembly process 503. The second apparatus 601 may have a conveyor belt 670 with a plurality of drums 672 arranged in one or more lanes, such as two lanes in this example, that move in a clockwise direction as indicated by the direction arrows 674. Each drum 672 may have an opening slot adapted to receive a first or second type of filter 106A or 106B. In this example and in reference to step 520 as discussed above, the second assembly apparatus 601 may include a fourth picker 620 to remove the second filter 106B from a vertical shoot, for example, one at a time and place the filter 106B into a corresponding drum 672 as the drum moves in place juxtaposed to the fourth picker 620. Note that the filter 106B may be placed into the slot in an upright orientation such that the extension 128B may face upwards or in an inverted position such that the extension 128B may face downwards. In this application, the filter 106B may be orientated in the upwards position. In reference to the step 522, a filler 622 may pour a predetermined amount of the second beverage ingredient into the second type of filter 106B. In reference to step 524, a tamper 624 may press the second beverage ingredient into the filter 106B to minimize air pockets with the first beverage ingredient. In reference to step 526, optionally, a divider apparatus 626 may apply a perforated barrier over the second beverage ingredient such as a plastic divider with a plurality of holes or a perforated film over the second beverage ingredient where the film may be sealed to the inner sidewall of the filter 106B. In reference to step 528, optionally, a third filler 628 may pour a third beverage ingredient or a different beverage ingredient from the second beverage ingredient into the second filter 106B. For instance, a water-soluble creamer or sweetener may be poured into the second filter 106B and isolated from the coffee ground sealed below by the perforated barrier. Optionally, in reference to step 530, a second tamper 630 may be provided to tamper the third beverage ingredient into the second filter 106B. In reference to step 533, optionally, a fifth picker 632 may place a distributor 112A into the filter 106B such that the outwardly extending portion of the flange 113A may rest upon the step 103B. In reference to step 534, a sealing machine 634 may substantially seal the outwardly extending portion of the flange 113A to the step 103B of the second filter 106B. In particular, the flange 113A may be sealed or infused to the step 103B without altering or damaging the energy director 137B as discussed in more detail below. In reference to step 536, the conveyor belt 636 may pass the assembled filter 109 to the first assembly apparatus 600 between the second picker 606 and the sealer 608 as indicated by the dotted direction arrow 636. For the purpose of assembling the second type of pods 106B, the first assembly apparatus 600 may be activated, for example, the elements 604, 608, and 616 may be active but the elements 606, 610, 612, and 614 may be inactive.

Figure 9C:
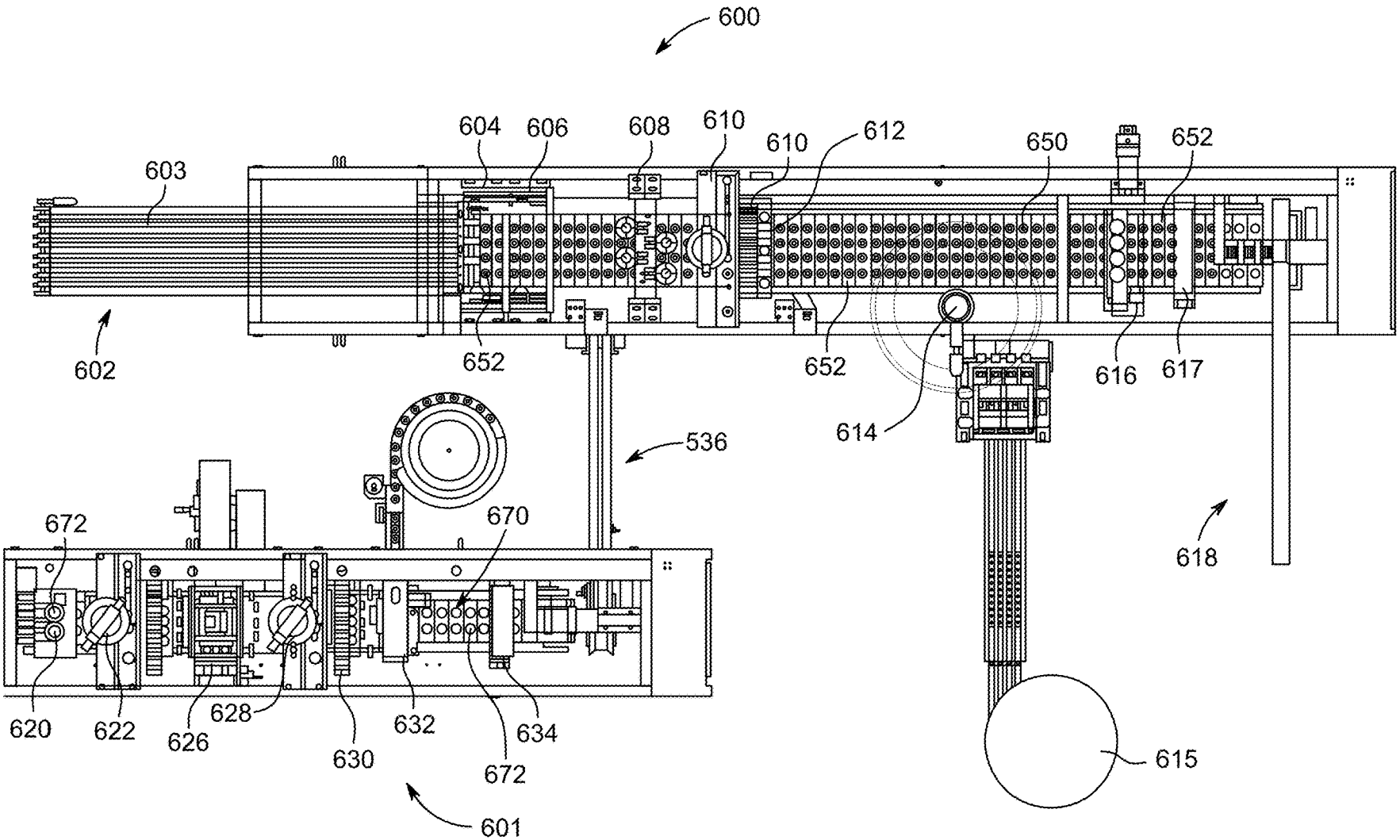
FIG. 9C shows a top view of the first and second assembly apparatus configured to assemble a variety of different types of pods such as the first and second types of pods.

FIG. 9C shows a top view of the first and second assembly apparatus 600 and 601 configured to assemble the first and second types of pods 100A and 100B in a manner discussed above in reference to the first and second assembly processes 501 and 503. FIG. 9C shows the first assembly apparatus 600 having the second tray 603 above the first tray 602. The first picker 604 may remove a container 104 from the first tray 602 place the container 104 into a corresponding opening slot within the drum 652 moving from left to right. The second picker 606 may remove a filter 106A from the second tray 603 and place the filter 106A into the container 104 as the corresponding drum 652 moves the container 104 just below the second picker 606. In this example, the filter 106A and the container 104 may be in an upright orientation such that the energy director 137A underneath the extension 128A of the filter 106A may rest upon the rim 120 of the container 104. The sealing mechanism 608 such as a torsional ultrasonic welding machine may peelably weld the energy director 137A to the rim 120 of the container 104. The first filler 610 may pour a predetermined amount of the first beverage ingredient into the filter 106A. The first tamper 612 may press the first beverage ingredient into the filter 106A to minimize air pockets with the first beverage ingredient. The third picker 614 such as a robotic arm may pick the distributors 112A from a dispenser 615 and place the distributors 112A over the first beverage ingredient such that the outwardly extending portion of the flange 113A may rest upon the step 103A. The sealer 616 may cut a round lid 114 and seal the lid 114 to the flange 113A of the distributor 112A and first extension 128A of the filter 106A. The first assembly apparatus 600 may also include a second sealer 616A to ensure that the lid 114 is properly sealed to the filter 106A. The assembled pod 100A may then be placed onto a conveyer belt 618 to dispense the assembled pod 100A from the first assembly apparatus 600.

FIG. 9C also shows a top view of the second assembly apparatus 601 configured to assemble the second type of pods 100B or the high-pressure pods in a manner discussed above in reference to FIG. 9B. The fourth picker 620 may remove the second filter 106B from a vertical shoot and place the filter 106B into a corresponding opening slot in the drum 672 adapted to move from left to right. In this example, the filter 106B may be placed into the slot in an upright orientation. The filler 622 may pour a predetermined amount of the second beverage ingredient into the filter 106B. The tamper 624 may press the second beverage ingredient into the filter 106B to minimize air pockets with the first beverage ingredient. Optionally, the divider apparatus 626 may apply a perforated barrier over the second beverage ingredient. Optionally, the third filler 628 may pour a third beverage ingredient or a different beverage ingredient from the second beverage ingredient into the second filter 106B. Optionally, the second tamper 630 may be provided to tamper the third beverage ingredient into the second filter 106B. Optionally, the fifth picker 632 may place a distributor 112A into the filter 106B such that the outwardly extending portion of the flange 113A may rest upon the step 103B. Optionally, the sealing machine 634 may substantially seal or infuse the outwardly extending portion of the flange 113A to the step 103B of the second filter 106B. Once the second assembly apparatus 601 has assembled the second filter 106B, the second filter 106B may be placed on the conveyor belt 636 and passed to the first assembly apparatus 600 between the second picker 606 and the sealer 608. For the purpose of assembling the second type of pods 106B, the first assembly apparatus 600 may activated, for example, elements 604, 608, and 616 but the elements 606, 610, 612, and 614 may be inactive. Note that the first assembly apparatus 600 may be utilized to pack to high volume pods so that the apparatus 600 may be kept running to improve efficiency; whereas the second assembly apparatus 601 may be utilized to pack a variety of low volume pods where the apparatus 601 may be stopped to clean when switching to pack different types of ingredients such as espresso, coffee, and tea to avoid cross-contamination of the flavors.

Figure 10B:
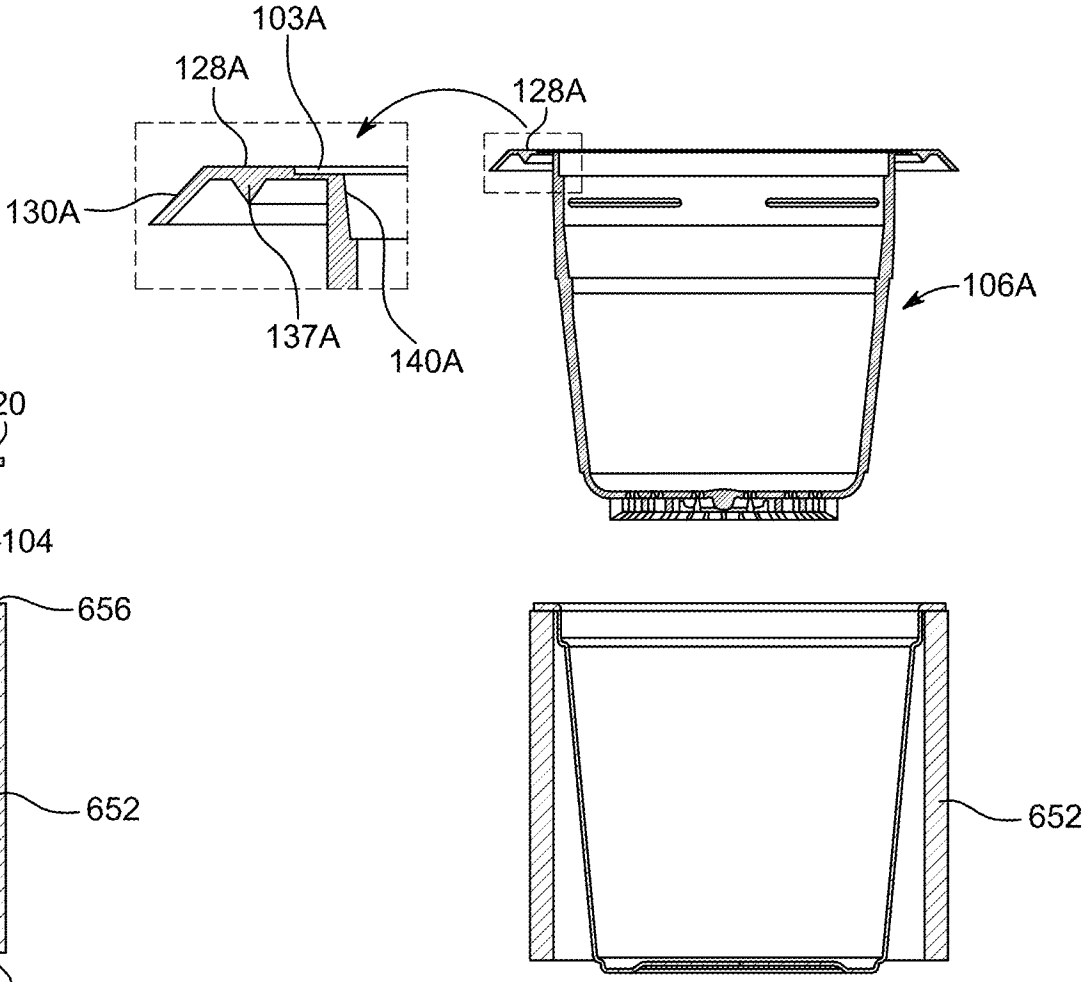
FIG. 10B illustrates the container receiving a filter.
Figure 10A:
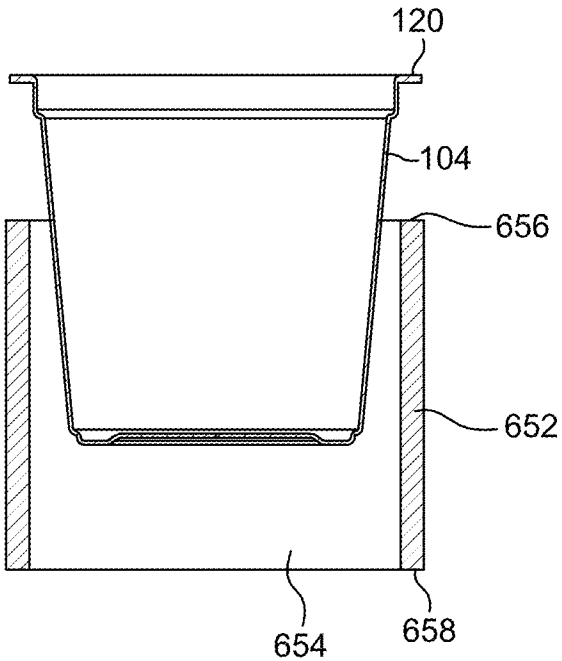
FIG. 10A illustrates one of the drums in the first assembly apparatus adapted to receive a container.
Figure 10D:
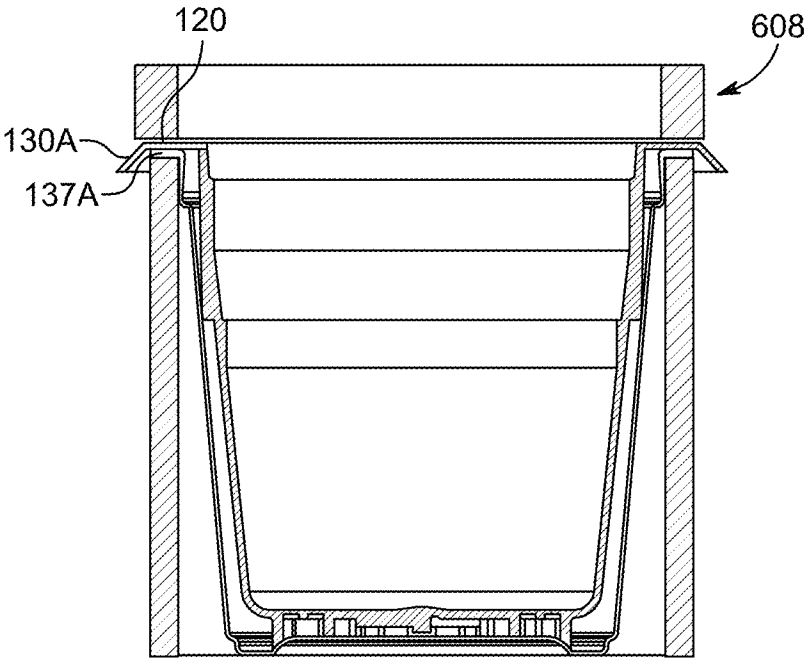
FIG. 10D illustrates a sealing mechanism peelably infusing the energy director around the rim of the container.
Figure 10C:
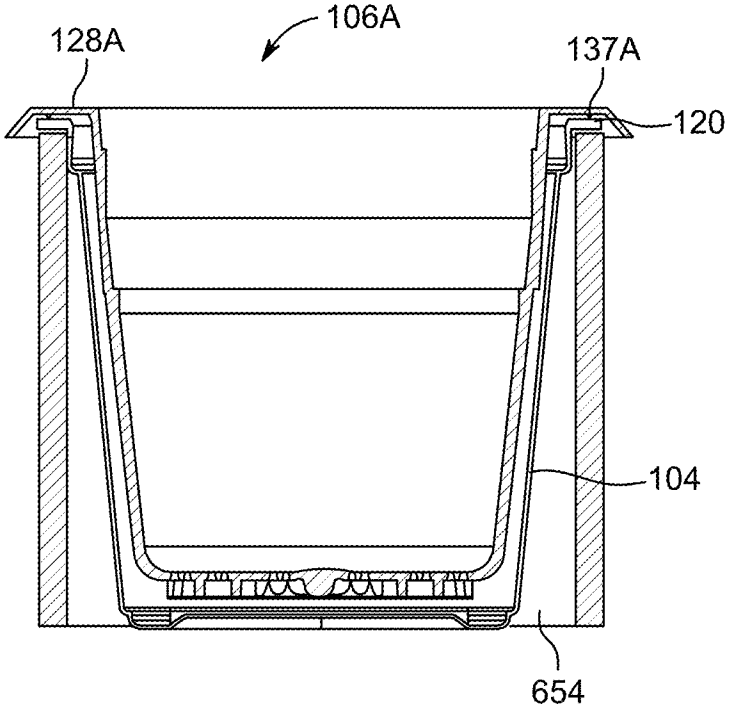
FIG. 10C illustrates an energy director underneath the filter extension resting upon the rim of the container.

FIGS. 10A through 10H illustrate, by way of example, some of the elements of the first assembly apparatus 600 configured to assemble the first type of pods 100A, and in accordance with the steps discussed above in reference to the first assembly process 501. FIG. 10A illustrates in reference to the step 504, the drum 652 having an opening slot 654 adapted to receive a container 104. The drum 652 may have a first end 656 and a second end 658 where the rim 120 of the container 104 may rest upon the first end 656. The fourth picker 604 may remove a container 104 from the first tray 602 and place the container 104 into the drum 652 as the conveyor belt 650 moves the corresponding drum 652 from the left to the right and juxtaposed to the fourth picker 604. Note that the container 104 may be placed into the slot 654 in an upright orientation such that the rim 120 may face upwards. FIG. 10B illustrates in reference to the step 506, placing the filter 106A from the second tray 603 into the container 104 as the drum 652 moves the container 104 in the clockwise direction to be juxtaposed to the second picker 606. In particular, FIG. 10B shows the expanded view of the first extension 128A with the step 103A formed in the inner side 140A of the first extension 128A, and the energy director 137A formed underneath the first extension 128A. FIG. 10C illustrates that with the container 104 in the upward orientation, the energy director 137A underneath the extension 128A may rest upon the rim 120 of the container 104. FIG. 10D illustrates in reference to step 508, the sealing mechanism 608 such as a torsional ultrasonic welding machine may melt and infuse the energy director 137A around the circumference of the rim 120 such that the first extension 128A may separate from the rim 120 by the application of a predetermined N-force, as discussed above, irrespective of the location around the rim 120 in which the force may be applied to the second extension 130A by the detaching member 210.

Figure 10F:
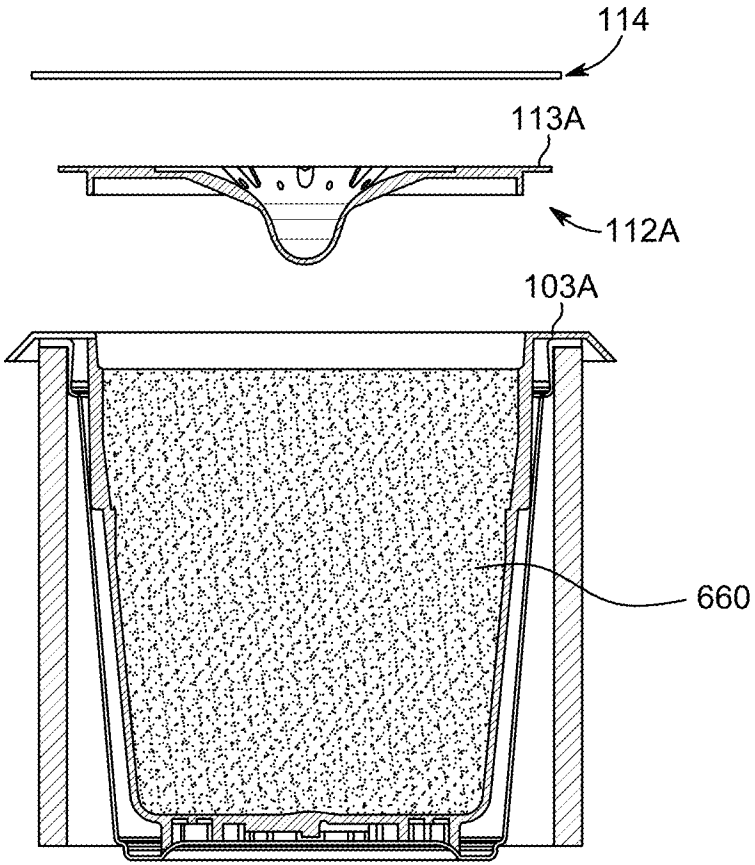
FIG. 10F illustrates placing a distributor above the first beverage ingredient.
Figure 10E:
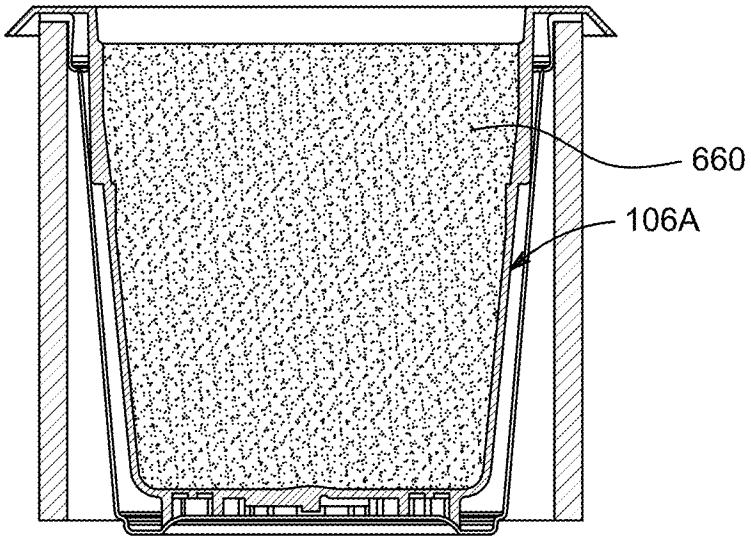
FIG. 10E illustrates pouring a predetermined amount of the first beverage ingredient into the filter.
Figure 10H:
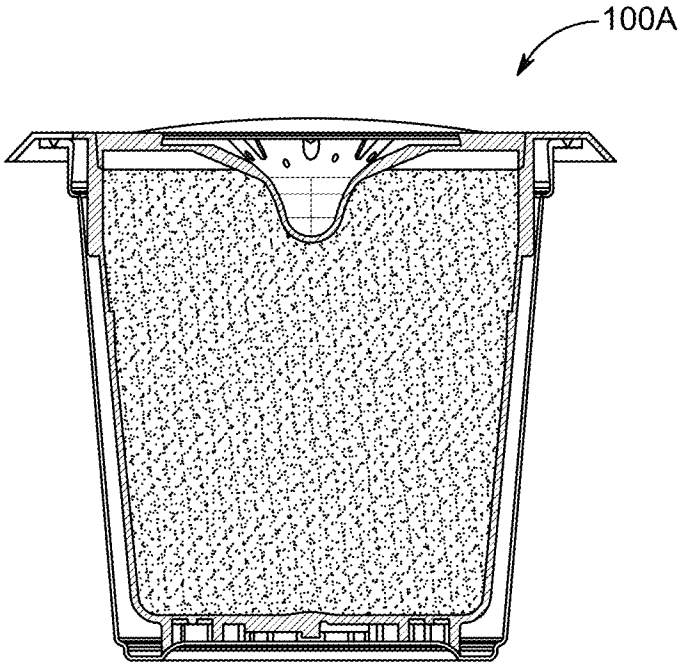
FIG. 10H shows an example of a pod assembled by the first assembly apparatus.
Figure 10G:
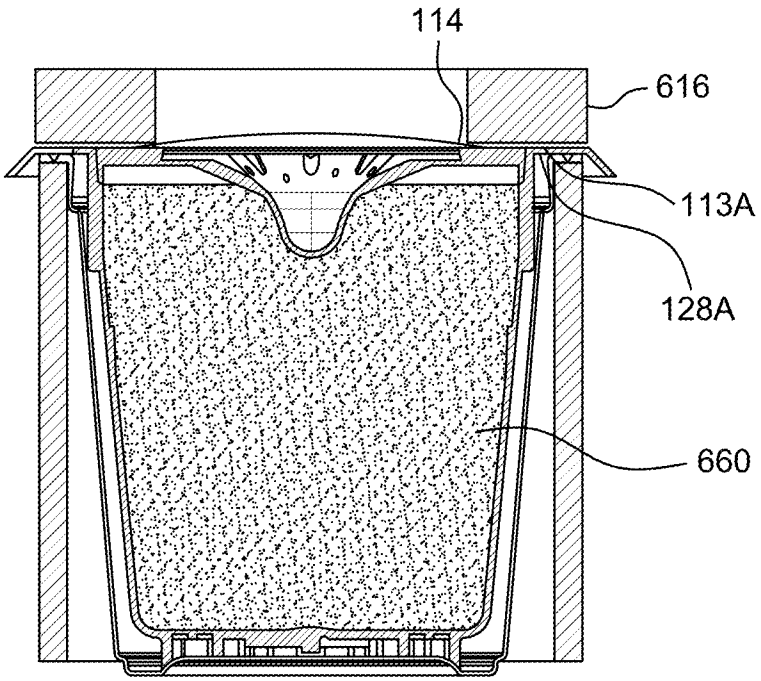
FIG. 10G illustrates a sealer cutting and sealing a lid onto the flange and first extension of the filter.

FIG. 10E illustrates in reference to the step 510, pouring a predetermined amount of the first beverage ingredient 660 into the filter 106A. Optionally, in reference to step 512, a tamper 612 may press the first beverage ingredient 660 into the filter to minimize air pockets with the first beverage ingredient. FIG. 10F illustrates in reference to step 514, placing a distributor 112A above the first beverage ingredient 660 such that the outwardly extending portion of the flange 113A may rest upon the step 103A by the picker 614 such as a robotic arm. FIG. 10G illustrates in reference to step 516, the sealer 616 may cut and seal a round lid 114 onto the flange 113A and first extension 128A. Note a variety of different types of sealing mechanisms may be utilized such as an ultrasonic and heat-sealing mechanism. For instance, a heat sealer may be utilized such that the application of heat onto the lid 114 to seal first extension 128A to seal the lid 114 thereon may not materially alter the strength of the peelable infusion of the energy director 137A onto the rim 120 provided in earlier step 508 so that the first extension 128A may separate from the rim 120 as intended by the application of a predetermined N-force, as discussed above. FIG. 10H shows an assembled pod 100A which may be place onto a conveyer belt 618 to dispense the assembled pod 100A from the first assembly apparatus 600.

Figure 11B:
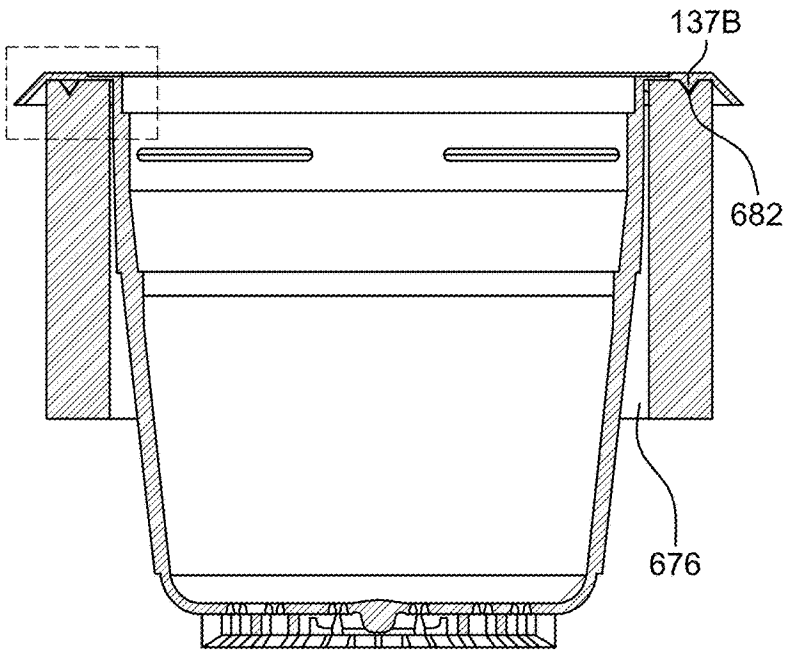
FIG. 11B illustrates the drum adapted to receive the filter such that a cavity formed within the drum receives the energy director, and forming a gap between the cavity and the energy director.
Figure 11A:
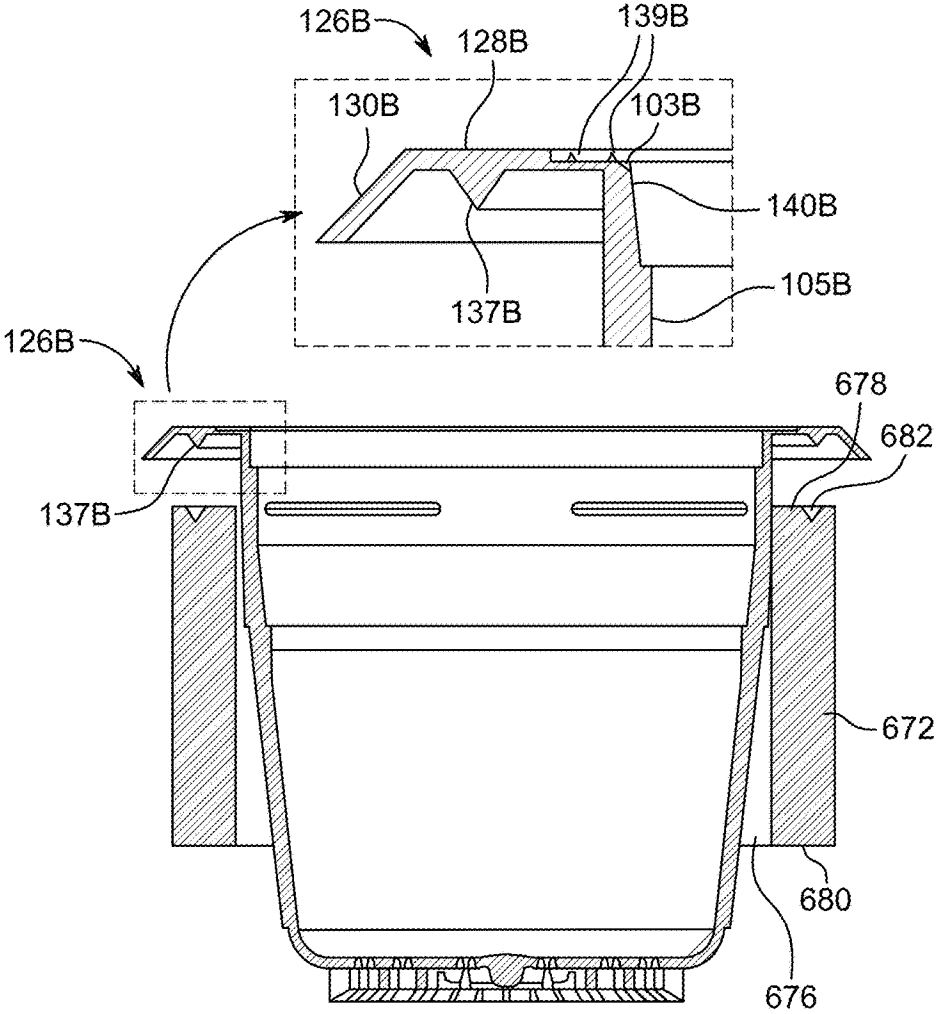
FIG. 11A illustrates one of the drums in the second assembly apparatus adapted to receive a filter.
Figure 11D:
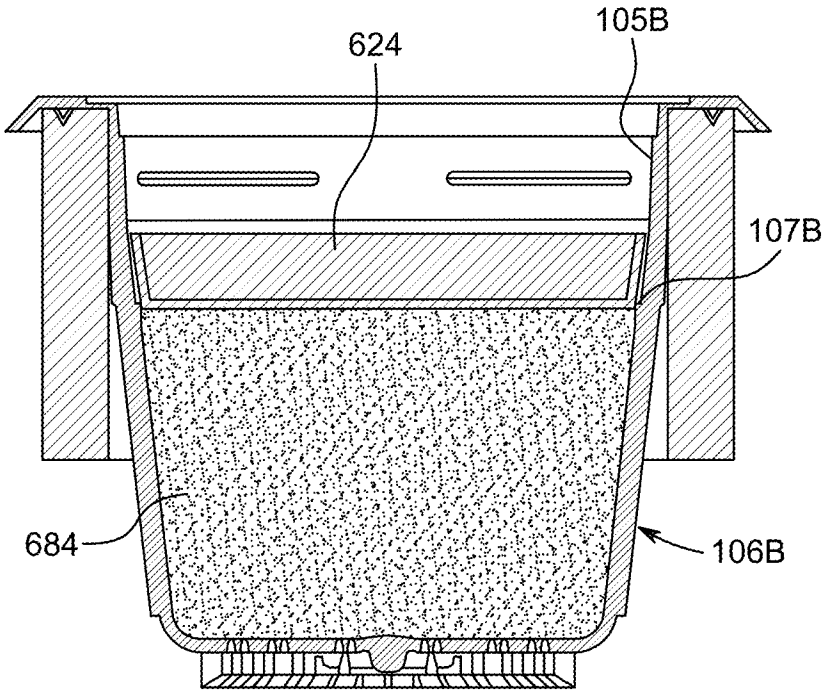
FIG. 11D illustrates a tamper pressing down into the second beverage ingredient to minimize air pockets within the second beverage ingredient.
Figure 11C:
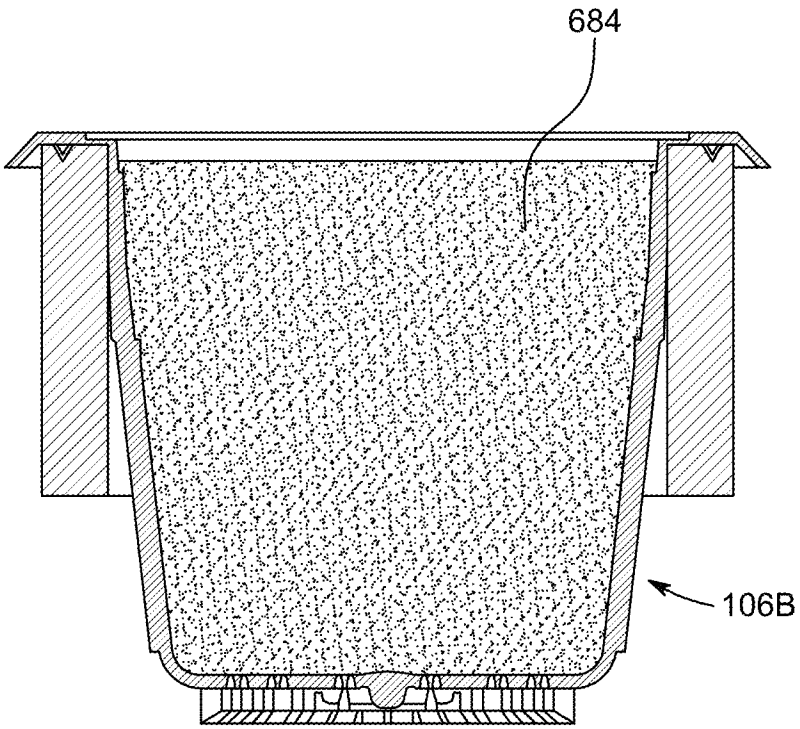
FIG. 11C illustrates the filter receiving a predetermined amount of the second beverage ingredient.
Figure 11F:
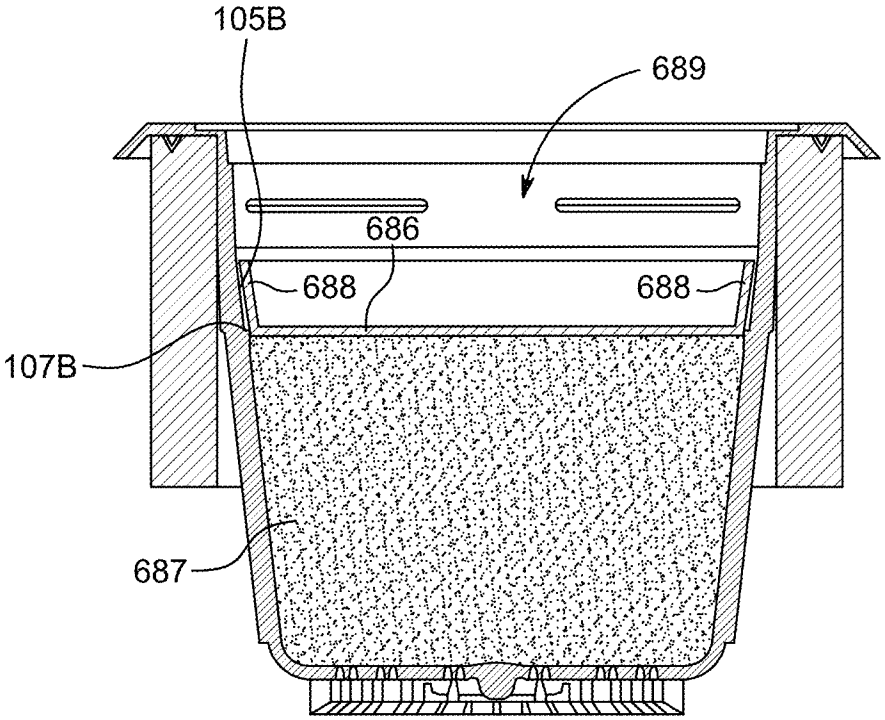
FIG. 11F illustrates sealing the perforated barrier over the second beverage ingredient.
Figure 11E:
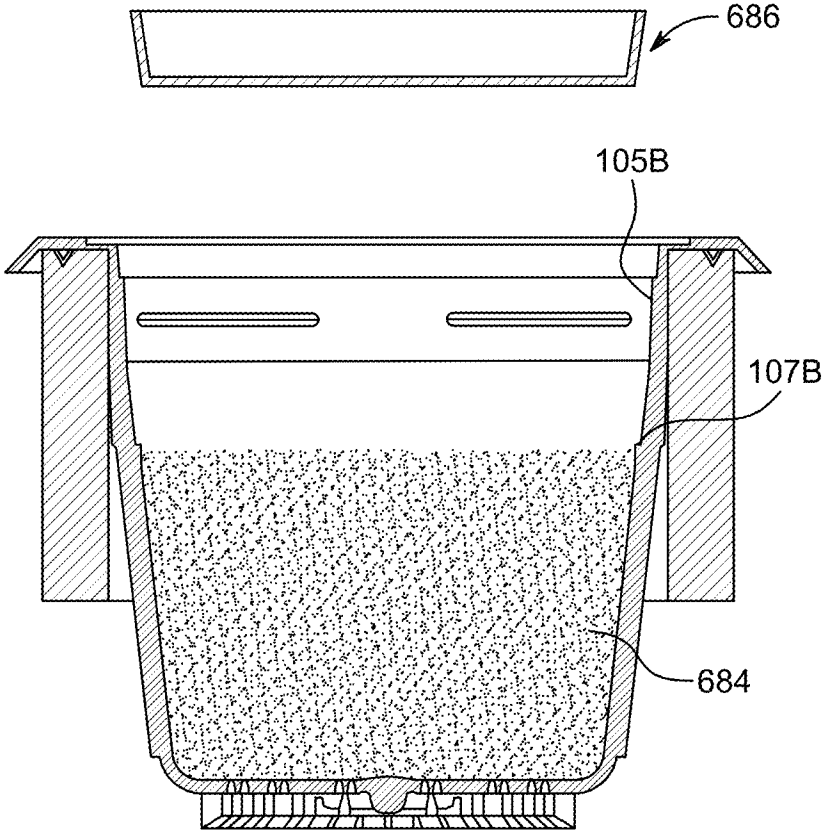
FIG. 11E illustrates a perforated barrier above the second beverage ingredient.
Figure 11H:
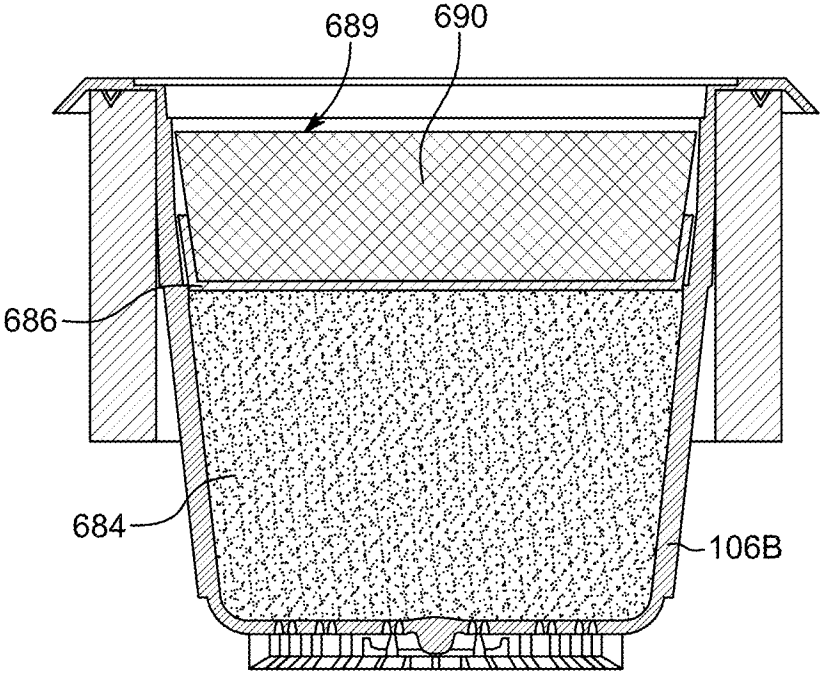
FIG. 11H illustrates tampering the third beverage ingredient into the filter.
Figure 11G:
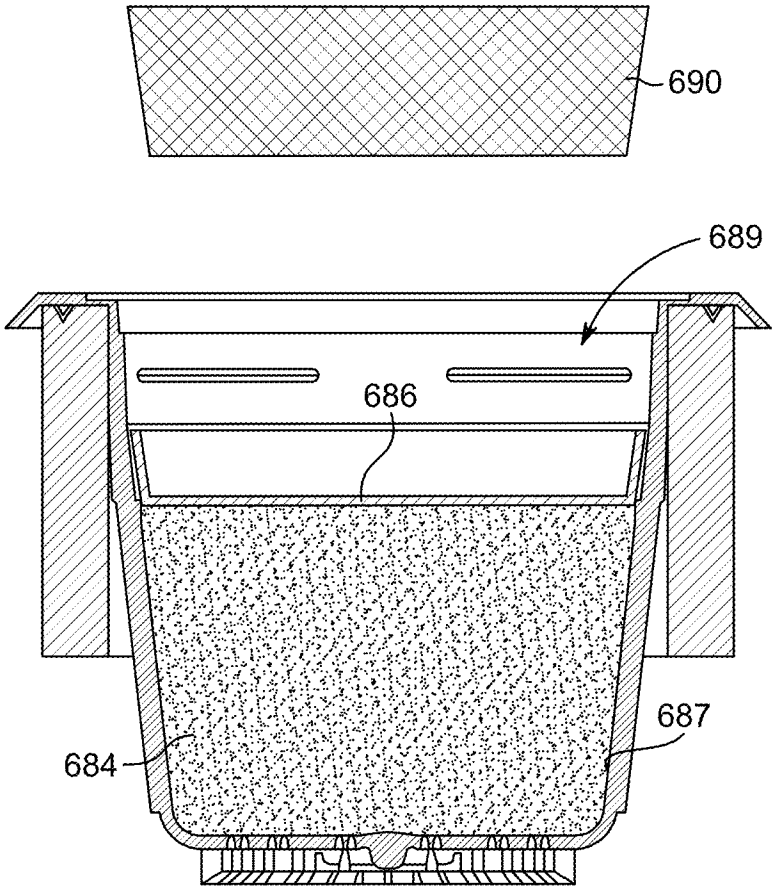
FIG. 11G illustrates filling a third beverage ingredient above the perforated barrier within the filter.
Figure 11J:
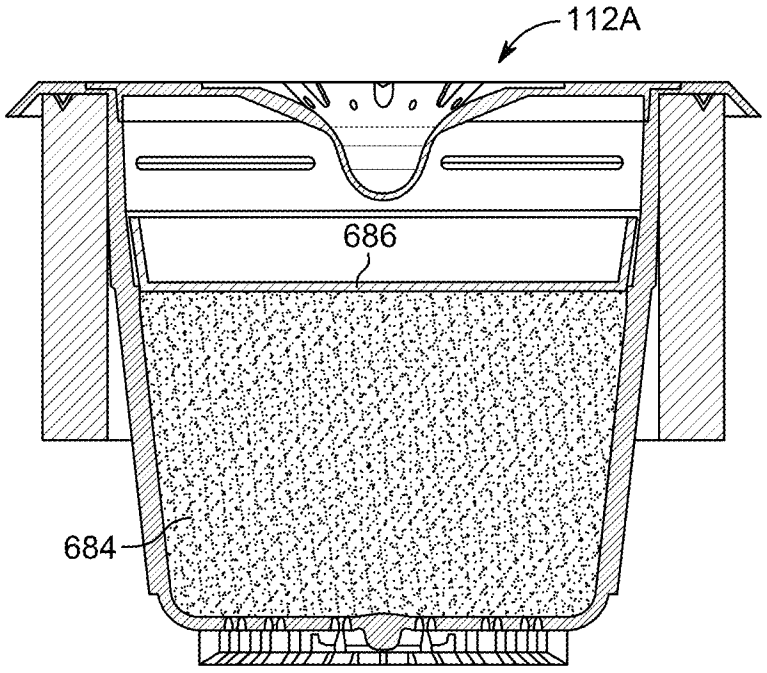
FIG. 11J illustrates placing outwardly extending portion of the distributor onto the step formed within the filter.
Figure 11I:
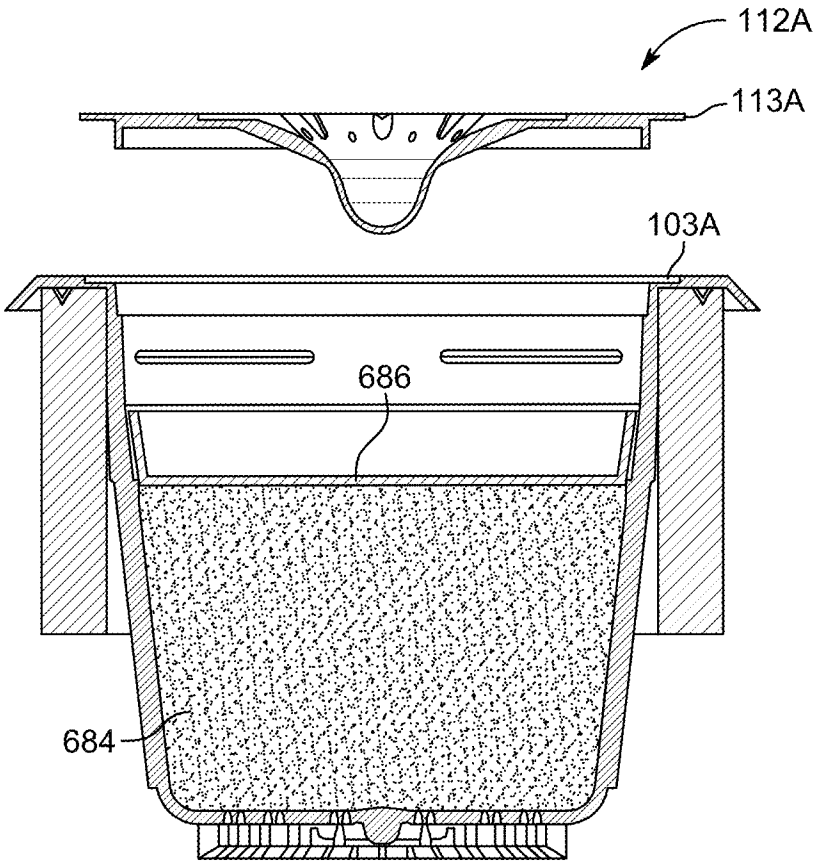
FIG. 11I illustrates placing a distributor into the filter.
Figure 11L:
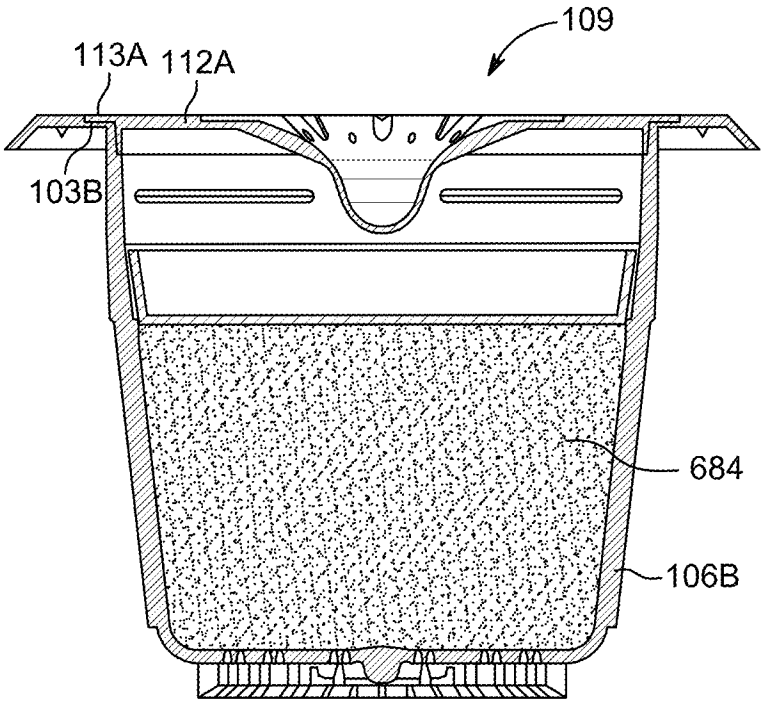
FIG. 11L illustrate an assembled filter with one or two different type of beverage ingredients packed therein which may be provided to the first assembly apparatus for further assembly process.
Figure 11K:
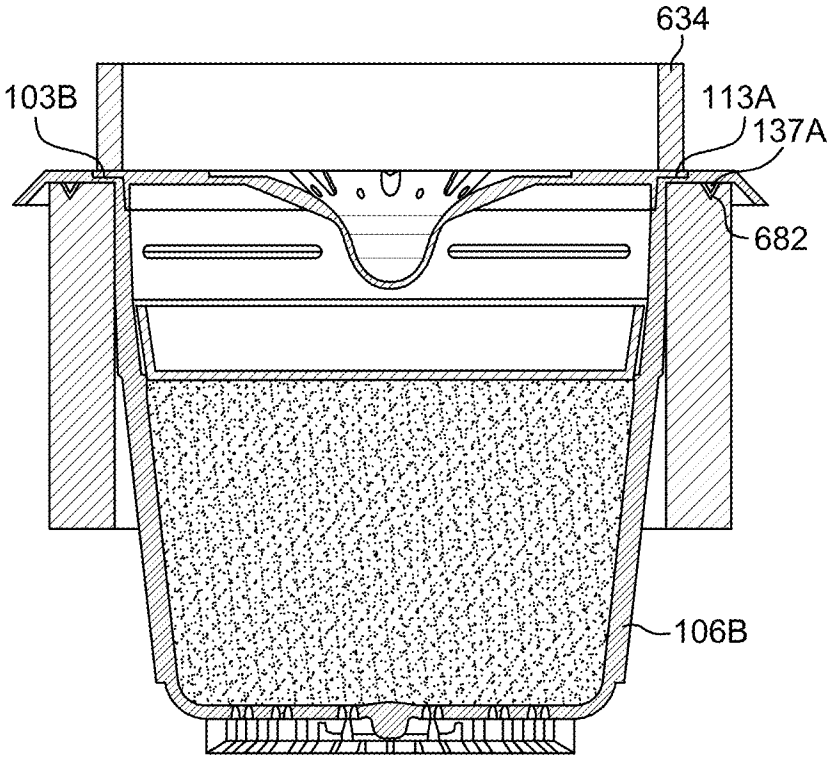
FIG. 11K illustrate a sealing machine sealing the outwardly extending portion of the distributor to the step of the second filter.
Figure 11N:
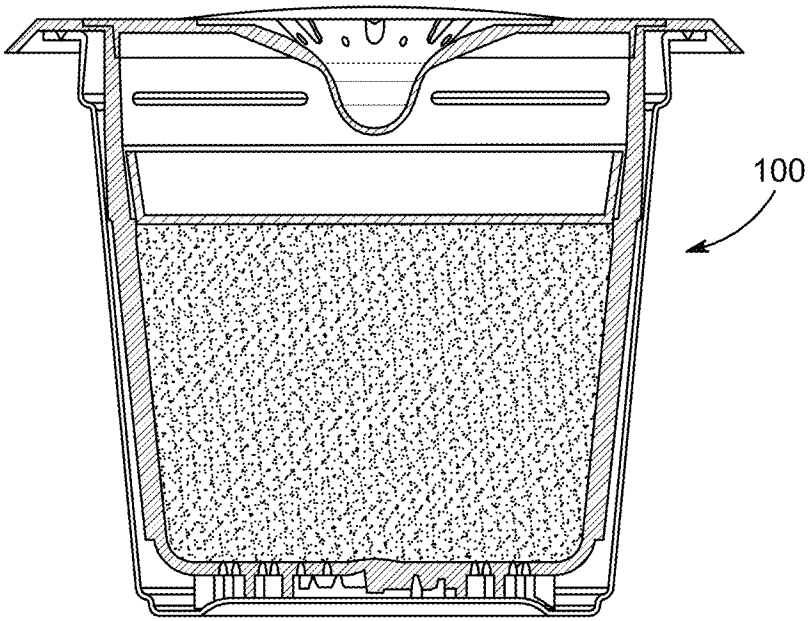
FIG. 11N illustrates peelably sealing the energy director to the rim of the container to assembly a pod such as a second high-pressure pod.

FIGS. 11A through 11N illustrate, by way of example, some of the elements of the second assembly apparatus 601 configured to assemble the second type of pods 100B in accordance with the steps discussed above in reference to the second assembly process 503. FIGS. 11A and 11B illustrate in reference to the step 520, where the fourth picker 620 picks a filter 106B from the shoot and places the filter 106B into the slot 676 of the drum 676 as the drum moves juxtaposed to the fourth picker 620. Note that the filter 106B may be placed into the slot 676 in an upright orientation such that the extension 128B may face upwards. The drum 676 may have a first end 678 and a second end 680 where the first end 678 may have a cavity 682 adapted to receive the energy director 137B. FIG. 11A also shows the expanded view of the extension 126B of the filter 106B with the first extension 128B having the step 103B formed in the inner side 140B juxtaposed to the first extension 128A, and the energy director 137A formed underneath the first extension 128A. The first extension 128 may also have one or more second energy directors 139B protruding from the step 103B to infuse with the flange 113A of the distributor 112A to infuse the flange 113A to the step 103B in more consistent manner as discussed below in reference to FIG. 11K. Note that the first type of filter 106A may not have the second energy director(s) protruding from the step 103A since the first type of filters 106A may be utilized for low-pressure brewing applications such as brewing coffee; whereas, the second type of filter 106B may have the second energy director(s) 138B since it may be utilized for high-pressure brewing applications such as brewing espresso. That is, it is within the scope of the invention to have both of the first and second types of filters 106A and 106B to have or not have the second energy director(s), and the second type of filter 106B to have the second energy director(s) but not the first type of filter 106A.

As illustrated in FIG. 11B, once the filter 106B is fully inserted into the slot 676 the energy director 137B may rest within the cavity 682 such that a gap may be formed between the cavity and the energy director 137B. FIG. 11C illustrates in reference to the step 522, a filler 622 may pour a predetermined amount of the second beverage ingredient 684 into the filter 106B. FIG. 11D illustrates in reference to step 524, which may be an optional step, where a tamper 624 may press the second beverage ingredient 684 into the filter 106B to minimize air pockets within the second beverage ingredient 684. For example, the tamper 624 may press the second beverage ingredient 684 to a level at about the step 107B formed in the inner side 105B of the filter.

FIGS. 11E and 11F illustrate in reference to step 526, which may be an optional step, where a divider apparatus 626 may apply a perforated barrier 686 over the second beverage ingredient 684. For instance, the divider apparatus 626 may cut a round perforated barrier 686 from a roll of perforated film, and the divider apparatus 626 may engage with the step 107B within the filter and use heat to seal the side 688 of the barrier 686 to the inner sidewall 105B juxtaposed to the step 107B. The barrier 686 may be made of a variety of materials such as a plastic divider with a plurality of holes, paper filter, perforated film and the like. The barrier 686 may divide the space within the filter 106B into a first chamber 687 and a second chamber 689 with the barrier 686 therebetween. In this example, the second beverage ingredient 684 may be provided in the first chamber 687. FIG. 11G illustrates in reference to step 528, which may be an optional step, where a third filler 628 may pour a third beverage ingredient 690 or a different beverage ingredient from the second beverage ingredient 684 into the second chamber 689 of the second filter 106B. For instance, a water-soluble creamer or sweetener may be poured into the second filter 106B and isolated from the coffee ground sealed below by the perforated barrier 686. FIG. 11H illustrates in reference to step 530, which may be an optional step, where a second tamper 630 may be provided to tamper the third beverage ingredient 690 into the second filter 106B.

FIGS. 11I and 11J illustrate in reference to step 533, which may be an optional step, a fifth picker 632 may place a distributor 112A into the filter 106B such that the outwardly extending portion of the flange 113A may rest upon the step 103B. Note that in this example, the second chamber 689 may not be provided with the third beverage ingredient 690 such that the second chamber 689 may be empty by inactivating the step 528. For instance, to brew a single shot of espresso, a lower dose of espresso coffee ground may be needed relative to a double shot of espresso; and for brewing tea, less volume of tea ground may be needed relative to coffee ground such that a partial fill of the first or second type of filters 106A and 106B may be needed. Under such brewing applications where a partial fill may be needed, the second beverage ingredient 684 may be packed in the first chamber and held in place by the barrier 686 so that the second beverage ingredient 684 may be substantially prevented from moving to one side of the sidewall 105B of the filter thereby exposing the holes 136 in the base 122 of the filter as the pod is orientated in the horizontal position during the brewing process. Note that exposing the holes 136 may increase channeling to occur within the filter where the heated water from the inlet needle may flow to the holes 136 and exit the filter with minimal interaction with the partial fill beverage ingredient such that the beverage may taste weak. Note that for other applications such as tea which expands after coming into contact with liquid, the barrier may not be needed.

FIG. 11K illustrate in reference to step 534, which may be an optional step, where a sealing machine 634 may substantially seal the outwardly extending portion of the flange 113A to the step 103B of the second filter 106B. In particular, the flange 113A may be sealed or infused to the step 103B with an ultrasonic weld without altering or damaging the energy director 137B since the energy director 137B may be within the cavity 682 such that the energy from the sealing machine 634 may not be absorbed by the energy director 137B. In particular, the step 103B may have the second energy director(s) 139B, as illustrated in FIG. 11A, where the ultrasonic energy may be directed to the energy director(s) 139B to melt and infuse the flange 113A to the step 103B in more consistent manner. Note that as the second energy director(s) 139B melts, the top surface area of the distributor 112A may be substantially flush with the top surface area of the first extension 128B. This may allow the lid 114 to be applied over the distributor 112A and the first extension 128B in a more consistent manner. With the flange 113A sealed to the step 103B, the high-pressure beverage extracted within the filter 106B may be substantially prevented from flowing between the flange 113A and the step 103B, thereby substantially preventing the beverage from entering the cavity 162A. Moreover, the distributor 112A may resist substantial portion of the pressure within the filter 106B such that the pressure applied to the lid 114 may be lessened. That is, with the flange 113A sealed to the step 103B and the extension 128B, and with the lid 114 sealed to the distributor 112A and the extension 128B, these elements 114, 112A, and 128B may act as a unitary members to substantially resist the high-pressure within the filter 106B such that the high-pressure beverage may flow along the pathway 168 as discussed above in reference to FIGS. 2A through 2D.

Figure 11M:
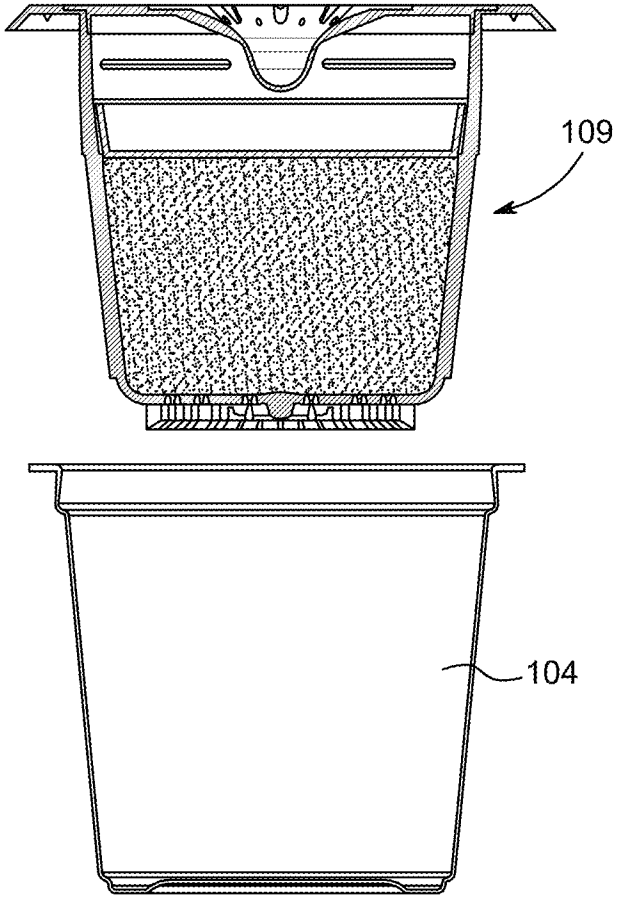
FIG. 11M illustrates utilizing the first assembly apparatus to place the assembled filter into a container.

FIG. 11L illustrate in reference to step 536, the assembled filter 109 with one or two different type of beverage ingredients packed therein with the distributor 112A optionally sealed to the step 103B of the filter 106A or 106B therein. The assembled filter may be placed on the conveyor belt 636 to pass the assembled filter to the first assembly apparatus 600 between the second picker 606 and the sealer 608 as indicated by the dotted direction arrow 636 in FIG. 9A and in FIG. 9C. For the purpose of assembling the first or second type of pods 106A and 106B, FIG. 11M illustrates placing the assembled filter 109 into a container 104 with the first assembly apparatus 600 such as by activating, for example, the element 604 to place a container 104 into the drum 652, then activating the element 608 to peelably weld the energy director 137B to the rim 120 of the container 104, and then activating the sealer 616 to cut and seal a lid 114 onto the distributor 112A and the first extension 128 of the filter but inactivating the elements 606, 610, 612, and 614 to produce the first or second type of pod 100A and 100B as illustrated in FIG. 11N. Accordingly, it is within the scope of the invention to activate and/or inactivate one or more steps or a variety of combination of steps in the flow chart 500 to assemble a desired pod depending on the application.

Figure 12B:
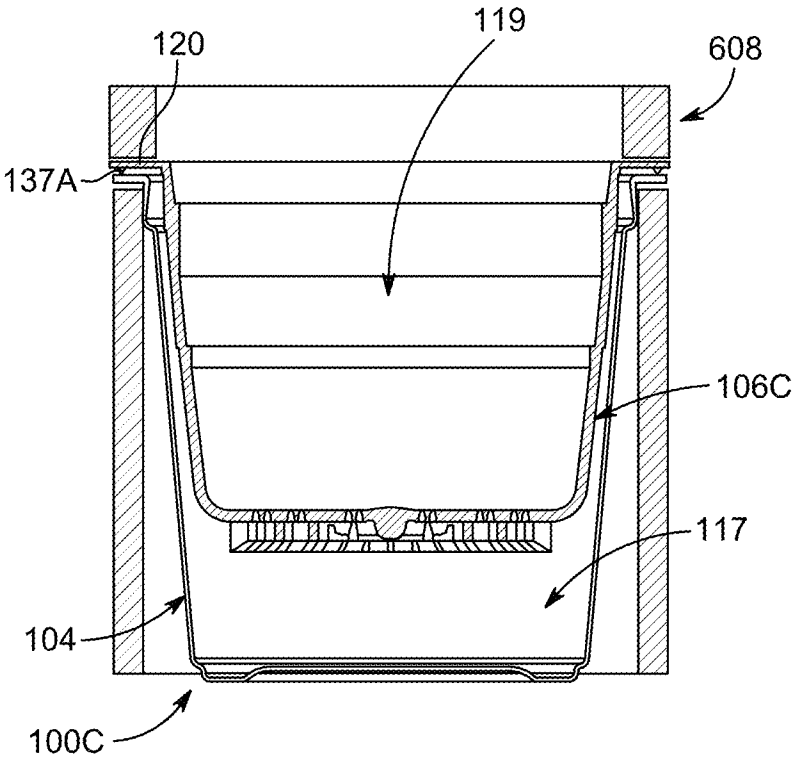
FIG. 12B illustrates releasably sealing the energy director of the shorter filter to the rim of the container.
Figure 12A:
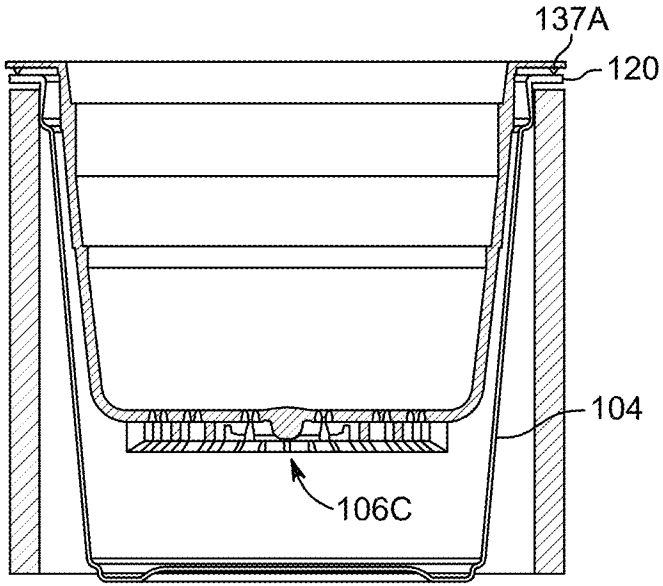
FIG. 12A illustrates utilizing a shorter filter with a pod.

FIGS. 12A and 12B illustrate a shorter filter 106C may be utilized within the container 104 in step 506 and releasably sealed to the rim 120 of the container in reference to step 508. The pod 100C may have a container 104 with a first chamber 117 between the filter 106C and the container 104, and a second chamber 119 within the filter 106C. The filter 106C may be filled with a first beverage ingredient 660 although a lesser amount than with the filter 106A since the space of the first chamber 119 within the filter 106C is less than that of the filter 106C. For applications where a lesser amount of beverage ingredient may be needed, the filter 106C may be suitable for such applications. Moreover, the filter 106C may allow the assembled pod to be used with a brewing system where an outlet needle may be utilized to drain the beverage such as the Keurig® brewing system. With such a system, the distributor 112A may not be utilized.

While various embodiments of the invention have been described, it will be apparent to those ordinarily skilled in the art that many more embodiments and implementations are possible within the scope of this invention. Moreover, various features and functionalities described in this application and Figures may be combined individually and/or a plurality of features and functionalities with others. Accordingly, the invention is not to be restricted except in light of the attached claims and their equivalents.

What is claim is:

1. A method of assembling a beverage pod including a filter having an extension, and a container having a rim, the method comprising:

positioning the extension of the filter juxtaposed to the rim of the container;

sealing peelably the extension to the rim where a predetermined amount of sealing force is formed between the extension and the rim such that an application of force upon the extension of at least the predetermined amount of sealing force separates the extension from the rim; and sealing a lid to the extension with heat to minimize increasing the predetermined amount of sealing force between the extension and the rim, where the predetermined amount of sealing force is from about 5N to about 45N.

2. The method according to claim 1, where the predetermined amount of sealing force is from about 10N to about 35N.

3. The method according to claim 1, where the predetermined amount of sealing force around the circumference of the rim is from about 5N to about 45N.

4. The method according to claim 1, where the predetermined amount of sealing force around the circumference of the rim is from about 10N to about 55N.

5. The method according to claim 1, further including a step of placing a distributor juxtaposed to the extension of the filter, and the step of sealing the lid seals the lid to at least a portion of the distributor and the extension.

6. The method according to claim 5, where the distributor has a flange, and the extension has an inner side adapted to receive the flange.

7. The method according to claim 1, further including a step of filling the filter with a predetermined amount of beverage ingredient where ground size of the beverage ingredient substantially releases pressure within the beverage ingredient to brew a low-pressure beverage.

8. The method according to claim 1, where the filter is shorter than the container to form a first chamber between the filter and the container, and a second chamber within the filter.

9. The method according to claim 1, where the filter and the container are positioned in an upright orientation.

10. A method of assembling a beverage pod including a filter having an extension, distributor having an outer flange, and a container having a rim, the method comprising:

filling the filter with a first beverage ingredient;

sealing the flange of the distributor to the extension of the filter;

placing the filter filled with the beverage ingredient into the container with the extension juxtaposed to the rim;

sealing peelably the extension to the rim where a predetermined amount of sealing force is formed between the extension and the rim such that an application of force upon the extension of at least the predetermined amount of sealing force separates the extension from the rim; and sealing a lid to the extension with heat to minimize increasing the predetermined amount of sealing force between the extension and the rim.

11. The method according to claim 10, where the predetermined amount of sealing force is from about 5N to about 45N.

12. The method according to claim 10, where the predetermined amount of sealing force is from about 10N to about 35N.

13. The method according to claim 10, where the predetermined amount of sealing force around the circumference of the rim is from about 5N to about 45N.

14. The method according to claim 10, where the predetermined amount of sealing force around the circumference of the rim is from about 10N to about 55N.

15. The method according to claim 10, where the step of sealing the lid includes sealing at least a portion of the flange to the lid.

16. The method according to claim 10, further including placing a perforated barrier over the first beverage ingredient.

17. The method according to claim 16, further including filling a second beverage ingredient over the perforated barrier.

18. The method according to claim 16, where the container is in an upright orientation.

* * * * *